US007543361B2

(12) United States Patent
Borchardt et al.

(10) Patent No.: US 7,543,361 B2
(45) Date of Patent: Jun. 9, 2009

(54) CLOSURE DEVICE PROVIDING VISUAL CONFIRMATION OF OCCLUSION

(75) Inventors: Michael G. Borchardt, Willowbrook, IL (US); Ronald J. Cisek, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 775 days.

(21) Appl. No.: 10/831,801

(22) Filed: Apr. 26, 2004

(65) Prior Publication Data

US 2006/0008184 A1 Jan. 12, 2006

(51) Int. Cl.
*A44B 19/16* (2006.01)

(52) U.S. Cl. ..... 24/399; 24/400; 383/61.2; 383/63

(58) Field of Classification Search ..... None
See application file for complete search history.

(56) References Cited

U.S. PATENT DOCUMENTS

| | | | | |
|---|---|---|---|---|
| 4,186,786 | A | 2/1980 | Kirkpatrick | |
| 4,285,105 | A | 8/1981 | Kirkpatrick | |
| 4,736,496 | A | 4/1988 | Fisher et al. | |
| 4,829,641 | A * | 5/1989 | Williams | 24/585.12 |
| 4,907,321 | A * | 3/1990 | Williams | 24/585.12 |
| 5,059,036 | A | 10/1991 | Richison et al. | |
| 5,070,584 | A | 12/1991 | Dais et al. | |
| 5,138,750 | A | 8/1992 | Gundlach et al. | |
| 5,140,727 | A | 8/1992 | Dais et al. | |
| 5,248,201 | A | 9/1993 | Kettner et al. | |

(Continued)

FOREIGN PATENT DOCUMENTS

| | | |
|---|---|---|
| EP | 0510797 | 10/1992 |
| GB | 1260764 | 1/1972 |

*Primary Examiner*—Jack W. Lavinder
(74) *Attorney, Agent, or Firm*—Thomas C. Feix

(57) ABSTRACT

A closure device providing a visual confirmation of occlusion. The closure device includes a first and a second interlocking fastening strips which are arranged to be interlocked over a predetermined length, at least one of the fastening strips having a surface alteration providing visual confirmation of occlusion of the closure device. The surface alteration may be a slit which opens or closes upon occlusion of said closure device. In one embodiment, the surface alteration may extend into a coextruded portion. The color of the coextruded portion is exposed when the surface alteration is open and hidden when the surface alteration is substantially closed. In another embodiment, the surface alteration may extend into an edge glow material which produces an edge glow effect when the surface alteration is open. In a third embodiment, the surface alteration may extend through an opaque side wall to expose the color of the base. The surface alteration may be located on the mating side, the non-mating side or both sides of one or both of the bases. In addition, the surface alteration may be located on the closure element. The opening or closing of the surface alteration may be achieved by a deformation in the closure device upon occlusion of the closure device. The deformation may be an inward deformation or an outward deformation on the fastening strip. This deformation may also allow a user to tactually confirm that the closure device has been occluded, even after the closure device has been occluded. The deformation may be on one or both of the fastening strips. In addition, the fastening strip may include multiple deformations.

18 Claims, 45 Drawing Sheets

U.S. PATENT DOCUMENTS 5,307,552 A 5/1994 Dais et al.
5,356,222 A * 10/1994 Kettner et al. ..... 383/63
5,363,540 A 11/1994 Dais et al.
5,403,094 A 4/1995 Tomic
5,405,478 A 4/1995 Richardson et al.
5,554,093 A 9/1996 Porchia et al.
5,647,100 A 7/1997 Porchia et al.
5,689,866 A * 11/1997 Kasai et al. ..... 24/585.12
5,722,128 A 3/1998 Toney et al.
5,774,955 A * 7/1998 Borchardt et al. ..... 24/584.1
5,829,884 A 11/1998 Yeager
5,839,831 A 11/1998 Mazzocchi
5,878,468 A 3/1999 Tomic et al.
5,911,508 A 6/1999 Dobreski et al.
6,082,897 A 7/2000 Galomb
6,152,600 A 11/2000 Tomic
6,217,215 B1 4/2001 Tomic
6,231,236 B1 5/2001 Tilman
6,371,644 B1 4/2002 Forman
6,594,872 B2 7/2003 Cisek
6,692,147 B2 2/2004 Nelson
6,713,152 B2 3/2004 Chen et al.
7,316,052 B2 * 1/2008 Pawloski et al. ..... 24/585.12
2004/0013323 A1 1/2004 Withers
2004/0047521 A1 3/2004 Berich et al.
2004/0074799 A1 4/2004 Bell et al.
2004/0234170 A1 11/2004 Pawloski et al.
2004/0234171 A1 11/2004 Dais et al.
2004/0252915 A1 12/2004 Nelson

* cited by examiner

CLOSURE DEVICE PROVIDING VISUAL CONFIRMATION OF OCCLUSION

FIELD OF THE INVENTION

The present invention pertains to an interlocking closure device, and, more particularly, to a closure device providing visual confirmation of occlusion. In addition, the closure device may also provide tactile confirmation of occlusion. The closure device of the present invention may be employed in traditional fastener areas, and is particularly suited for use as a fastener for storage containers, such as plastic bags.

BACKGROUND OF THE INVENTION

The use of fastening devices for the closure of containers, including plastic bag bodies, is generally known. Furthermore, the manufacture of fastening devices made of plastic materials is generally known to those skilled in the art relating to closure devices, as demonstrated by the numerous patents in this area.

A particularly well-known use for fastening devices is in connection with flexible containers, such as bag bodies. The closure device and the associated container may be formed from thermoplastic materials, and the closure device and sidewalls of the container can be integrally formed by extrusion as a single piece. Alternatively, the closure device and sidewalls may be formed as separate pieces and then connected by heat sealing or any other suitable connecting process. The closure devices when incorporated as fasteners on bag bodies have been particularly useful in providing a closure means for retaining the contents within the bag body.

Conventional closure devices utilize mating male and female closure elements which are occluded. When conventional closure devices are employed, it often is difficult to determine when the male and female closure elements are occluded. This problem is particularly acute when the closure devices are relatively narrow. Accordingly, when conventional closure devices are employed, there exists a reasonable likelihood that the closure device is at least partially open.

The occlusion problem arises from the inability of a user to perceive when the male and female closure are occluded to form a seal between the contents of the bag and the environment external to the bag. A number of solutions to this problem have been attempted. For example, U.S. Pat. Nos. 4,186,786, 4,285,105, and 4,829,641, as well as in Japanese patent application No. 51-27719, disclose fasteners that provide a visual indication that the male and female closure elements are properly occluded. Specifically, a color change means for verifying the occlusion of the male and female members of the closure is provided wherein male and female members having different colors are employed, and, upon occlusion, provide yet a different color. For example, the female member of the closure may be opaque yellow and the male member of the closure may be translucent blue. Upon occlusion of the male member and female member a composite color with a green hue results. This use of a color change greatly improves the ability of the user of the interlocking closure device to determine when the male and female members are occluded.

The change in color that is viewed when dissimilarly colored male and female members are occluded is demonstrated in a commercially available product sold under the trademark GLAD-LOCK (Glad-Lock is the registered trademark of The Glad Products Company, Oakland, Calif.). This color change effect may be enhanced by the incorporation of a color change enhancement member in the closure device, as disclosed in U.S. Pat. No. 4,829,641.

However, if the first fastening strip is opaque and the second fastening strip is translucent, the color change can only be observed from the translucent side of the closure device. Therefore, one of the objects of this invention is to provide visual confirmation of occlusion from both sides of the closure device.

In addition, another object of this invention is to provide a visual confirmation of occlusion wherein one of the fastening strips can be transparent.

Furthermore, color-blind users may not be able to perceive the color change effect. Thus, a further object of the invention is to provide a visual confirmation of occlusion which does not rely upon color change. It is another object of the invention to provide a visual confirmation which appears or disappears upon occlusion of the closure device.

The prior art includes references which have slits or notches to the surface. Such references include U.S. Pat. Nos. 5,070,584, 5,307,552, 5,363,540 and 5,403,094, and French Patent 2,022,865. However, these references do not use the slits or notches to show visual confirmation of occlusion or unocclusion.

Another object of this invention is to combine visual confirmation of occlusion with a tactile and/or audible indication of occlusion.

For example, the color-change effect is imperceptible in the dark, thus mooting the color-change advantage of the closure devices when they are used under such conditions. In addition, sight-impaired or color-blind people may not be able to perceive the color-change effect. Accordingly, it would be desirable to provide a closure device that affords other indications of occlusion.

The prior art has attempted to furnish a fastener that provides a tactile or audible indication of occlusion. For example, U.S. Pat. Nos. 4,736,496, 5,138,750, 5,140,727, 5,403,094, and 5,405,478, as well as EP 510,797, disclose closure devices that allegedly provide a tactually or audibly perceptive indication of proper interlocking of the closure elements. It is said that, upon occlusion of the disclosed closure devices, a user is able to feel or hear that full closure is accomplished. For example, U.S. Pat. No. 4,736,946 discloses the use of additional ribs on either side of the closure elements. These ribs are said to give an improved "feel" to the closure, thus aiding a user in aligning the closure elements.

The devices shown in these references are able only to provide a dynamic tactile indication of occlusion, that is, the user is able to tactually perceive that the closure device is functioning properly only at the time the user is manually closing the device. Such devices do not provide a static tactile indication of occlusion, that is, they do not "feel" closed after occlusion has been effected. Accordingly, if a plastic bag containing such a closure device is sealed by one person, a second person will not readily be able to tactually determine that the bag is sealed. The ability to make such a determination is desirable.

It is a general object of the present invention to provide visual confirmation of occlusion for a closure device. It is a further general object of the present invention to provide a container that is closeable and sealable by means of such a closure device.

BRIEF SUMMARY OF THE INVENTION

The present invention satisfies these general objects by providing a closure device in which a user is able to visually determine that the closure device has been occluded. In addition, the user may be able to tactually determine that the closure device has been occluded. The closure device comprises first and second interlocking fastening strips arranged to be interlocked over a predetermined length, at least one of the fastening strips having a visual indication upon occlusion of the closure device. Thus, a user will be able to visually confirm that the closure device has been properly occluded, not only while the user is in the process of occluding the closure device, but also after the closure device has been occluded. In addition, one of the fastening strips may have a deformation upon occlusion. This deformation may provide tactile confirmation of occlusion of the closure device.

DESCRIPTION OF THE EMBODIMENTS

The present invention provides interlocking closure devices in which a visual indication occurs upon proper occlusion. In addition, the device may provide a deformation which is formed upon proper occlusion. A user thus is able to visually and, possibly tactually, perceive whether the closure device is properly occluded. In one embodiment, the closure device comprises interlocking male and female fastening strips arranged to be interlocked over a predetermined length.

As used herein and as generally understood in the art, the terms "male" and "female" closure elements refer to closure elements wherein the element that interlocks into the other closure element and having outwardly projecting hooks is referred to as the "male closure element" and the outer element is referred to as the "female closure element" and has inwardly projecting hooks.

Further, as used herein, the term "edge glow effect" refers to the appearance at a surface alteration which is different from the surrounding material and that is visually evident when the first and second closure fastening strips are in a non-occluded position or an occluded position.

In accordance with this embodiment of the present invention, the male fastening strip flexes when the male and female fastening strips interlock. This flexure creates a deformation in the male fastening strip and the deformation is locked into place by the interlocking male and female closure elements. The deformation causes a surface alteration to open and/or close which provides a visual confirmation of occlusion. In addition, the deformation may provide tactile confirmation of occlusion of the closure device.

Figure 1:
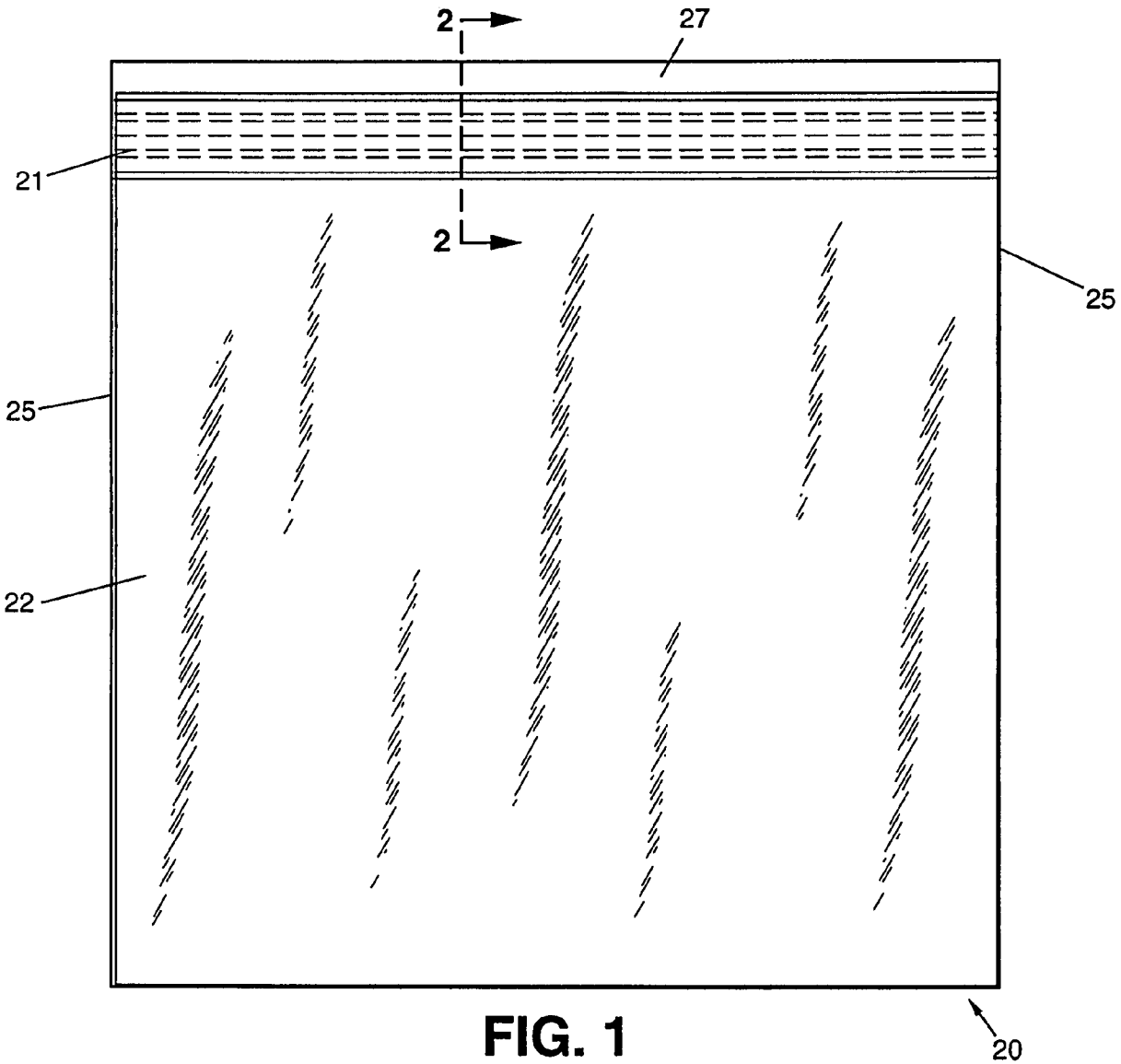
FIG. 1 is a perspective view of a container according to the present invention in the form of a plastic bag.

FIG. 1 illustrates a container according to the present invention in the form of a plastic bag 20 having a sealable closure device 21. The bag 20 includes side walls 22 joined at seams 25 to form a compartment sealable by means of the closure device 21. The side walls 22 extend above the closure device 21 to form mouth portions 27. Mouth portions 27 enable a user to grip the plastic bag 20 in a fashion to more conveniently be able to deocclude or open the closure device 21 to thereby open the bag 20.

Figure 2:
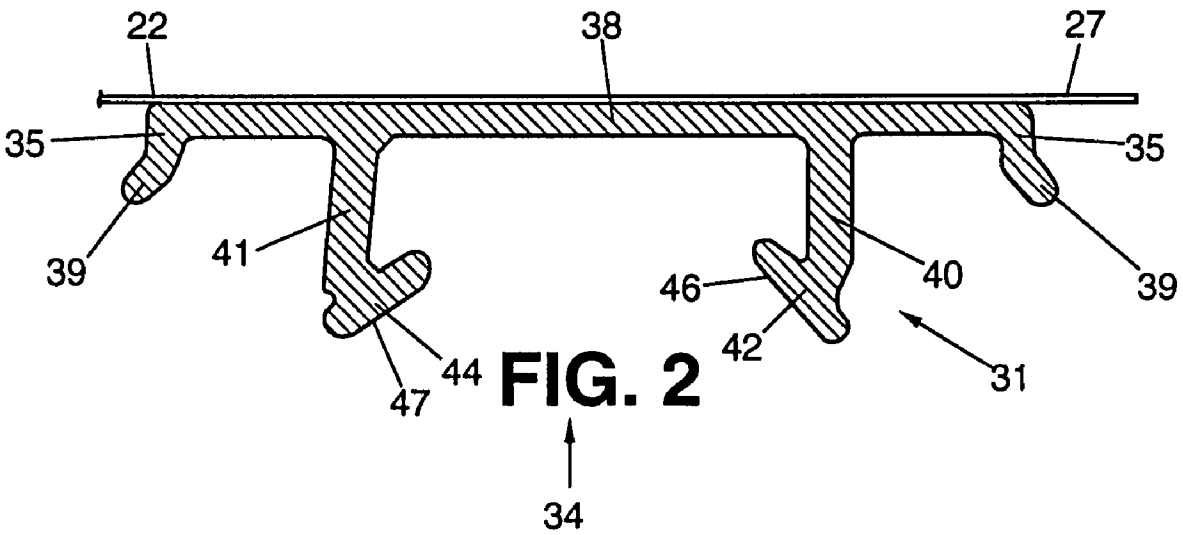
FIG. 2 is an enlarged partial cross-sectional view taken along line 2-2 in FIG. 1 illustrating the female fastening strip of a closure device of the present invention.
Figure 3:
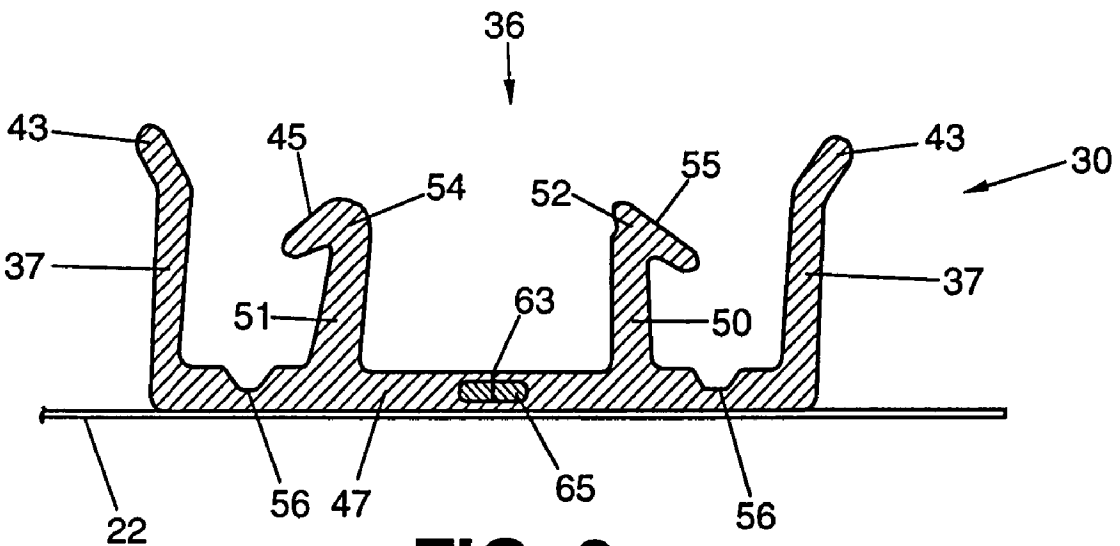
FIG. 3 is an enlarged partial cross-sectional view taken along line 2-2 in FIG. 1 illustrating the male fastening strip of a closure device of the present invention.

FIGS. 2 and 3 together illustrate a closure device according to one embodiment of the present invention. The closure device comprises male and female fastening strips 30, 31. As shown in FIG. 2, the female fastening strip 31 includes a female closure element 34 and a pair of female wings 35 spaced apart on the female fastening strip 31 on each side of the female closure element 34. As illustrated in FIG. 3, the male fastening strip 30 comprises a male closure element 36 for engaging the female closure element 34, and further comprises a pair of male wings 37 spaced-apart on the male fastening strip on each side of the male closure element 36.

The female closure element 34 comprises a base portion 38 having a pair of spaced-apart parallely disposed webs 40, 41 extending from the base portion 38. The webs 40, 41 include female hook portions 42, 44 extending from the webs 40, 41 respectively, and facing towards each other. The female hook portions 42, 44 include guide surfaces 46,47 which serve to guide the hook portions 42, 44 for occluding with the male hook portions of a mating closure element.

The male closure element 36 comprises a base portion 47 including a pair of spaced-apart, parallely disposed webs 50, 51 extending from the base portion 47. The webs 50, 51 include male hook portions 52, 54 extending from the webs 50, 51 respectively and facing away from each other. The male hook portions 52, 54 include guide surfaces 45, 55, which generally serve to guide the hook portions 52, 54 for occlusion with the female hook portions 42, 44 of the mating female closure element. The guide surface 45 may also have a rounded crown surface 45. In addition, the hooks may be designed so that the hooks 44, 54 adjacent the interior of the container provide a greater resistance to opening of the closure device. Notches 56 may be provided in the base portion 47 of the male closure element to facilitate deflection of the base.

The base 47 is made from a material which has a first color. In this embodiment, the first color would be opaque. The base 47 includes a coextruded portion 65 which has a second color. The second color may be surrounded by the first color in the base. For example, the first color may be yellow and the second color may be blue. A second example, the first color may be white and the second color may be red; A third example, the first color may be white and the second color may be black. A fourth example, the first color may be red and the second color may be green. The base 47 includes a surface alteration 63 which extends into the coextruded portion 65. The surface alteration 63 may also facilitate deflection of the base. While this embodiment has one surface alteration, the base 47 may include two, three, four or more surface alterations. In addition the coextruded portion may extend along each of the surface alterations or the base may include a separate coextruded portion for each surface alteration. Furthermore, the separate coextruded portions may have a different color than the second color of the first coextruded portion. In addition, the surface alteration may be on the mating side of the fastening strip or the non-mating side of the fastening strip or both sides of the fastening strip. In addition, the coextruded portion may be continuous along the length of the fastening strip or the coextruded portion may be discontinuous along the length to provide an intermittent visual effect. Furthermore, the surface alteration may be continuous along the length of the fastening strip or the surface alteration may be discontinuous along the length to provide an intermittent visual effect. Additionally, the depth of the surface alterations may vary depending upon the location of the surface alteration and the depth of any other surface alterations. Also, the surface alteration may be substantially closed to hide the color when the fastening strips are unoccluded and open to expose the color when the fastening strips are occluded. Conversely, the surface alteration may be open to expose the color when the fastening strips are unoccluded and substantially closed to hide the color when the fastening strips are occluded. The surface alteration can be substantially perpendicular to the surface, such as, the surface alteration 63 in FIG. 3 or the surface alteration can be at an angle to the surface. In addition, the surface alteration can be linear, such as surface alteration 63 in FIG. 3, or L-shaped, or Y-shaped, or curved, such as, a serpentine shape or any combination of shapes, curves or linear portions. The surface alteration and coextruded portion may be used with any embodiment described herein.

Figure 3A:
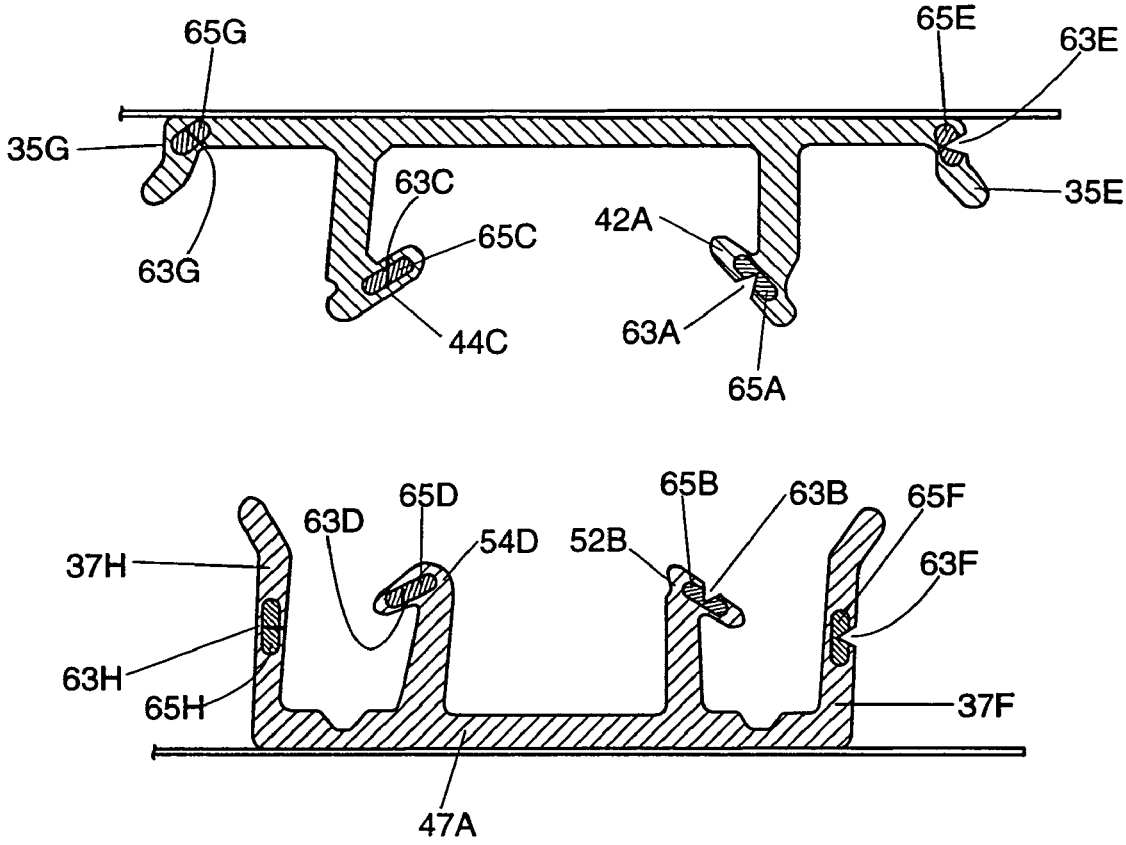
FIG. 3A is a cross-sectional view of another embodiment of the fastening strips in FIGS. 2 and 3 in the unoccluded position.
Figure 3B:
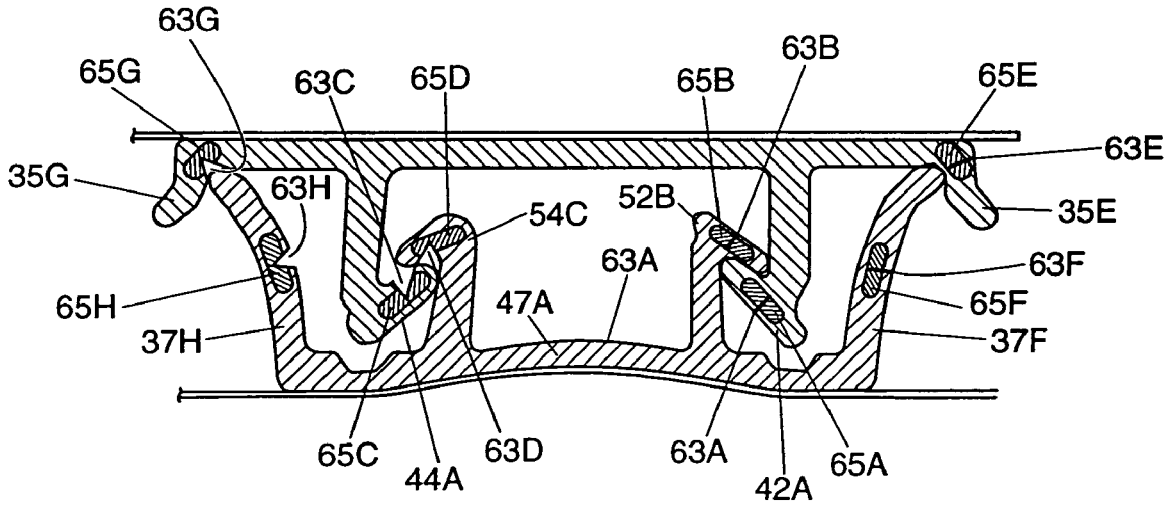
FIG. 3B is a cross-sectional view of the fastening strips in FIG. 3A in the occluded position.

In addition, the location of the surface alteration and coextruded portion is not limited to the base, and the surface alteration and coextruded portion may be positioned in other locations on the closure device. More specifically, the surface alteration and coextruded portion may be located in any location which flexes during occlusion and provides a viewing point. For example, referring to FIGS. 3A and 3B, the surface alteration and coextruded portion may be located in the hooks 42A, 44C, 52B, 54D or in the wings 35E, 35G, 37F, 37H. Specifically, a surface alteration 63A and coextruded portion 65A may be located in the hook 42A. The surface alteration 63A is open and exposing the coextruded portion 65A when the closure device is unoccluded. When the closure device is occluded, the hook 42A flexes and is retained in the flexed or deflected position. Thus, the surface alteration 63A is closed and hiding the coextruded portion 65A when the closure device is occluded. A similar example is surface alteration 63B and coextruded portion 65B in hook 52B. Conversely, a surface alteration and a coextruded portion may be located in a hook so that the surface alteration is closed when the closure device is unoccluded and the surface alteration is open when the closure device is occluded. Such examples are surface alteration 63C and coextruded portion 65C in hook 44C or surface alteration 63D and coextruded portion 65D in hook 54D.

Similarly, a surface alteration 63E, 63F, 63G, 63H and coextruded portion 65E, 65F, 65G, 65H may be located in the wings 35E, 35F, 37G, 37H. Specifically, a surface alteration 63E and coextruded portion 65E may be located in the wing 35E. The surface alteration 63E is open and exposing the coextruded portion 65E when the closure device is unoccluded. When the closure device is occluded, the wing 35E flexes and is retained in the flexed or deflected position. Thus, the surface alteration 63E is closed and hiding the coextruded portion 65E when the closure device is occluded. A similar example is surface alteration 63F and coextruded portion 65F in wing 37F. Conversely, a surface alteration and a coextruded portion may be located in a wing so that the surface alteration is closed when the closure device is unoccluded and the surface alteration is open when the closure device is occluded. Such examples are surface alteration 63G and coextruded portion 65G in wing 35G or surface alteration 63H and coextruded portion 65H in wing 37H.

The surface alteration and coextruded portion may be positioned in any, location on the closure device for any embodiment described herein. For example, the surface alteration and coextruded portion may be positioned in the spacing member 259 shown in FIGS. 13-15.

Figure 3C:
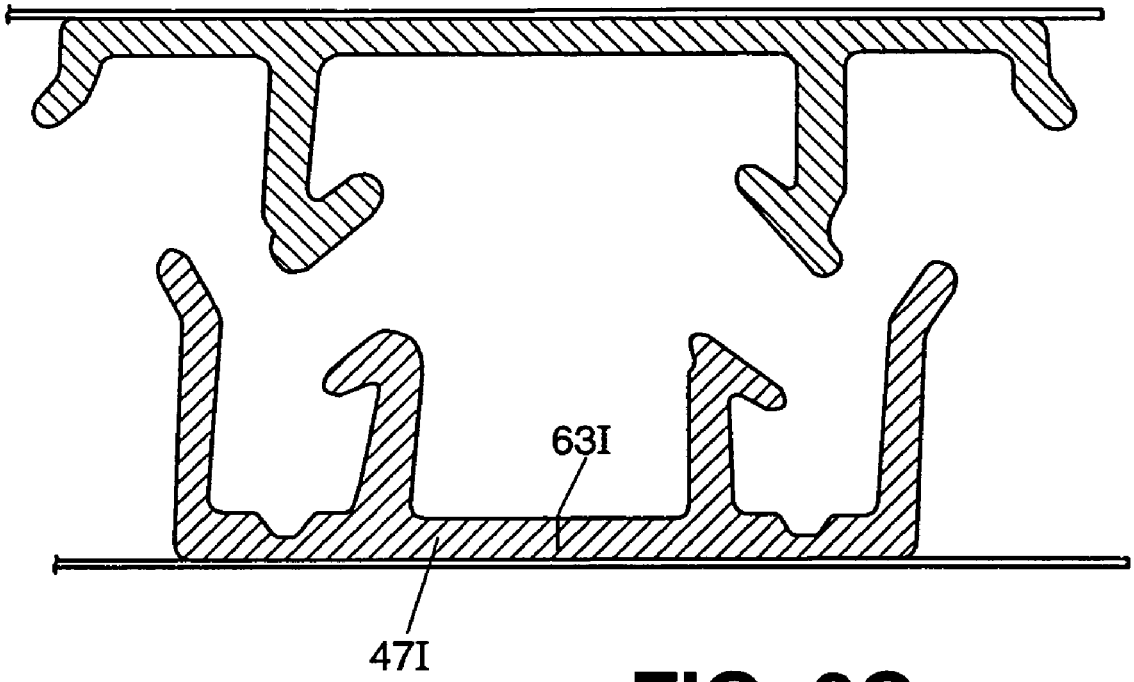
FIG. 3C is a cross-sectional view of another embodiment of the fastening strips in FIGS. 2 and 3 in the unoccluded position.
Figure 3D:
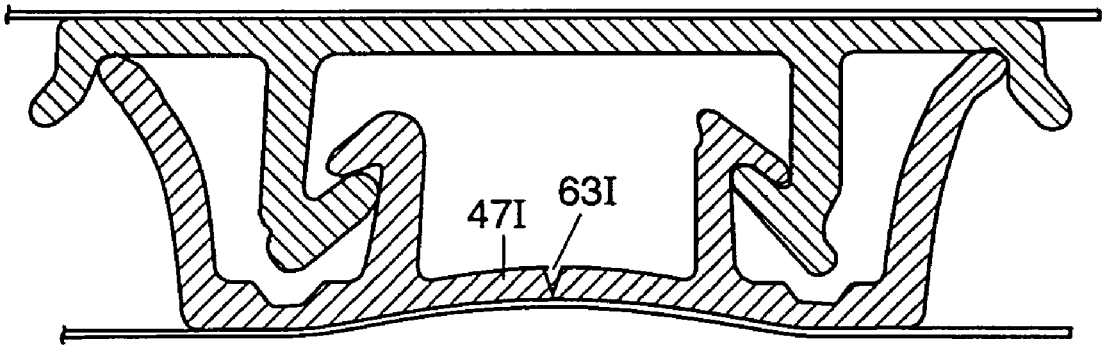
FIG. 3D is a cross-sectional view of the fastening strips in FIG. 3C in the occluded position.

In other embodiments, the base 471 is made from an edge glow material, such as, FIGS. 3C and 3D. The material provides an edge glow effect when the surface alteration 63I is open. The surface alteration 63I may be substantially closed to hide the edge glow effect when the fastening strips are unoccluded as in FIG. 3C and open to expose the edge glow effect when the fastening strips are occluded as in FIG. 3D. Conversely, in another embodiment, the surface alteration may be open to expose the edge glow effect when the fastening strips are unoccluded and substantially closed to hide the edge glow effect when the fastening strips are occluded. In addition, the surface alteration may be continuous along the length of the closure element or the surface alteration may be discontinuous along the length to provide an intermittent visual effect. Furthermore, in another embodiment, the coextruded portion may include a fluorescent material. The surface alteration and fluorescent material may be used with any embodiment described herein.

Figure 3E:
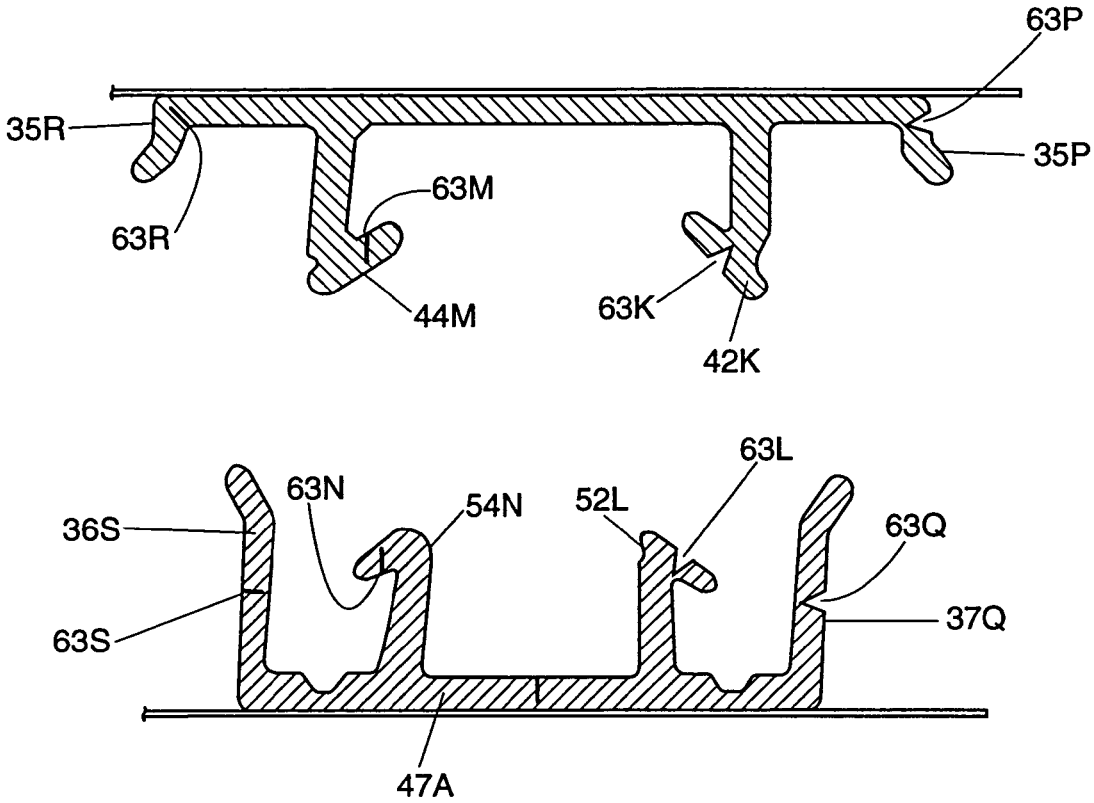
FIG. 3E is a cross-sectional view of another embodiment of the fastening strips in FIGS. 2 and 3 in the unoccluded position.
Figure 3F:
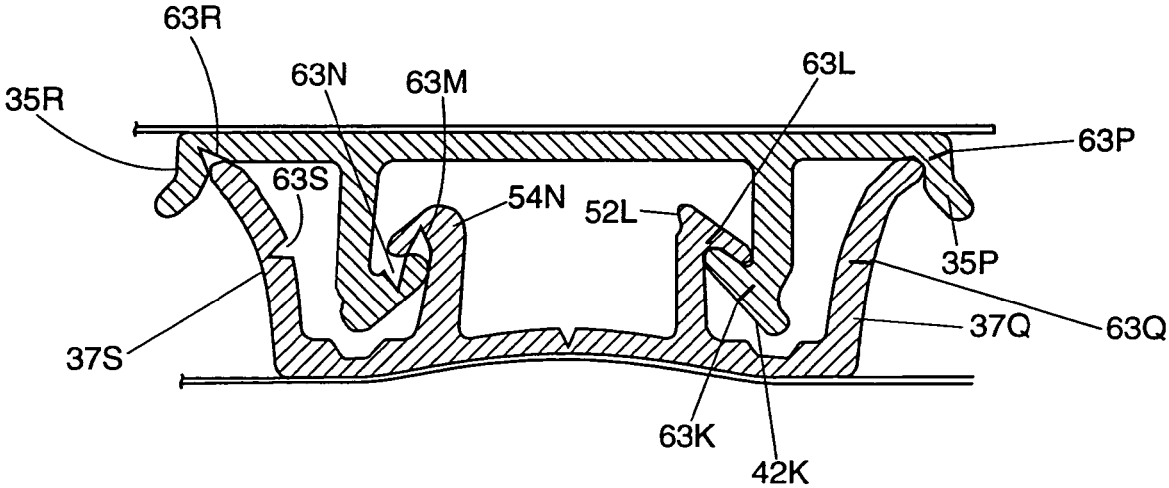
FIG. 3F is a cross-sectional view of the fastening strips in FIG. 3E in the occluded position.

In yet other embodiments, the surface alteration and the edge glow material may be positioned in other locations on the closure device. More specifically, the surface alteration and edge glow material may be located in any location which flexes during occlusion and provides a viewing point. For example, referring to FIGS. 3E and 3F, the surface alteration and edge glow material may be located in the hooks 42K, 44M, 52L, 54N or in the wings 35P, 35R, 37Q, 37S. Specifically, a surface alteration 63K may be located in the hook 42K. The surface alteration 63K is open and exposing the edge glow effect when the closure device is unoccluded. When the closure device is occluded, the hook 42K flexes and is retained in the flexed or deflected position. Thus, the surface alteration 63K is closed and hiding the edge glow effect when the closure device is occluded. A similar example is surface alteration 63L in hook 52L. Conversely, a surface alteration and an edge glow material may be located in a hook so that the surface alteration is closed when the closure device is unoccluded and the surface alteration is open when the closure device is occluded. Such examples are surface alteration 63M in hook 44M or surface alteration 63N in hook 54N.

Similarly, a surface alteration 63P, 63R, 63Q, 63S may be located in the wings 35P, 35R, 37Q, 37S. Specifically, a surface alteration 63P may be located in the wing 35P. The surface alteration 63P is open and exposing the edge glow effect when the closure device is unoccluded. When the closure device is occluded, the wing 35P flexes and is retained in the flexed or deflected position. Thus, the surface alteration 63P is closed and hiding the edge glow effect when the closure device is occluded. A similar example is surface alteration 63Q in wing 37Q. Conversely, a surface alteration and an edge glow material may be located in a wing so that the surface alteration is closed when the closure device is unoccluded and the surface alteration is open when the closure device is occluded. Such examples are surface alteration 63R in wing 35R or surface alteration 63S in wing 37S.

The surface alteration and the edge glow material may be positioned in any location on the closure device for any embodiment described herein. For example, the surface alteration and edge glow material may be positioned in the spacing member 259 shown in FIGS. 13-15.

Furthermore, the entire fastening strip could be made of edge glow material or only the portions with surface alterations would be edge glow material coextruded with another material. For example, only the base would be edge glow material, or only the hook would be edge glow material or only the wing would be edge glow material or only a selected area in the base, hook or wing would be edge glow material, such as, the coextruded portions in FIGS. 3A and 3B.

The fastening strips further include wings as shown in FIGS. 2 and 3. The male wings 37 shown in FIG. 3 are flexible and extend further from the base of the fastening strip than does the male closure element 30. Each wing terminates in an end portion 43 which projects outwardly from the wing 37. Although two wings are shown, a greater or lesser number of wings may be used, such as, one, three, four or more wings. A pair of female wings 35 is included with the female fastening strip in order to engage the male wings 37. The female wings 35 extend from the female fastening strip 31 and terminate in end portions 39 which project outwardly from the wings 35. The number of female wings may be equal to, greater than, or less than the number of male wings.

Figure 4A:
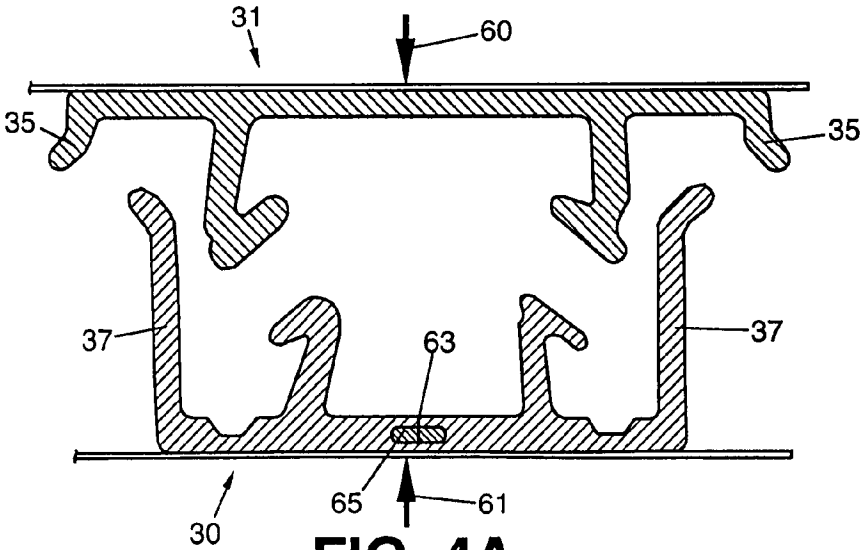
FIGS. 4A-4C are cross-sectional views of the male and female fastening strips illustrated in FIGS. 2 and 3 shown in various positions.
Figure 4B:
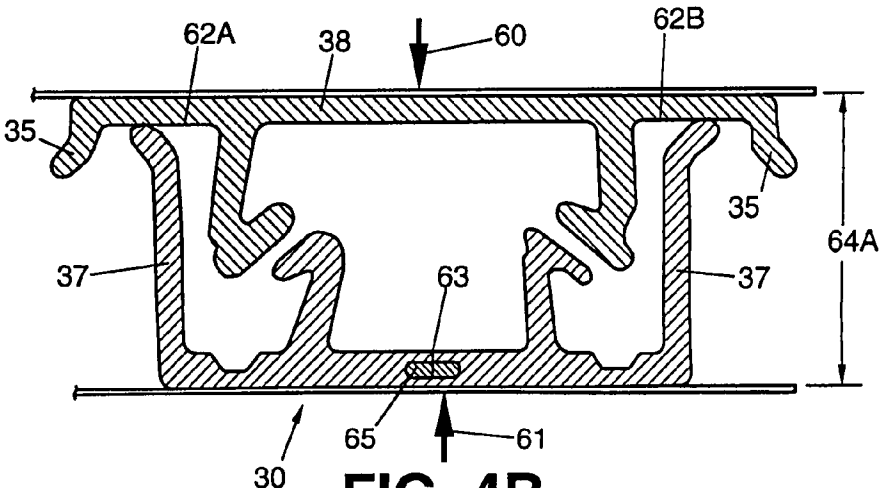
Figure 4C:
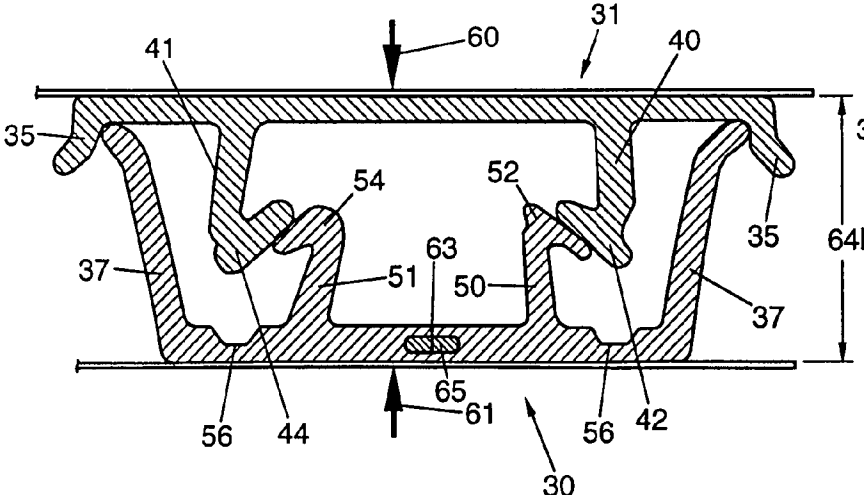

FIGS. 4A-4D illustrate occlusion of the closure device. In accordance with the invention, compression forces are applied to the opposed fastening strips 30, 31 in the direction denoted by the arrows 60, 61 shown in FIGS. 4A-4C. These forces are typically applied as the user depresses or pinches his or her fingers along a desired length of the fastening strips 30, 31. As the user begins to occlude the fastening strips, the male wings 37 engage the base portions 62A, 62B as shown in FIG. 4B. In this position, the fastening strips are separated by distance 64A. As the user continues to apply the forces 60, 61, the male wings 37 slide towards the female wings 35 until the female wings 35 contact the male wings 37 as shown in FIG. 4C. In this position the fastening strips are separated by distance 64B which is less than distance 64 due to the movement of the wings 37. Also, the female hooks 42, 44 have contacted the male hooks 52, 54 as shown in FIG. 4C.

Figure 4D:
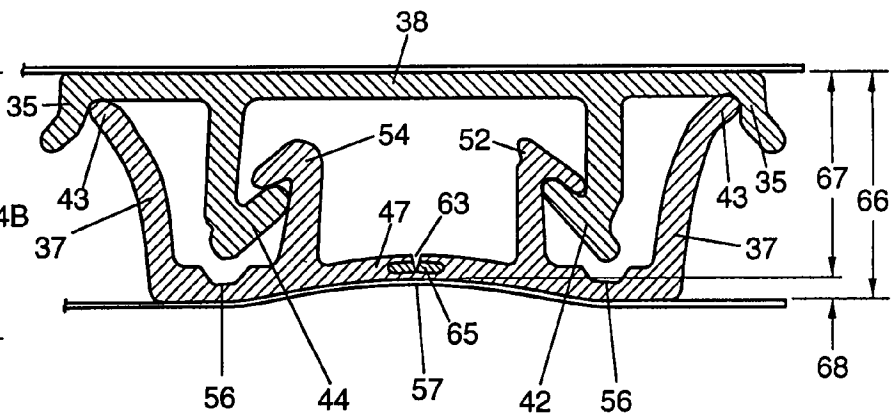
FIG. 4D is a cross-sectional view of the fastening strip of FIGS. 2-3 in the occluded position, and illustrating the visual changing portion and the inward deformation of the male fastening strip upon occlusion.

In order to hold the fastening strips in an occluded position, the female hooks 42, 44 must engage the male hooks 52, 54. As the user continues to apply the forces 60, 61, the female webs 40, 41 deflect outwardly and the male webs 50, 51 deflect inwardly in order to allow the female hooks 42, 44 and the male hooks 52, 54 to pass each other. In addition, the hooks may also deflect during this process. As the user continues to apply the forces 60, 61, the female hooks 42, 44 engage the male hooks 52, 54 as shown in FIG. 4D. During this process, the base of the male fastening strip deflects inward and forms an inward deformation 57. The deformation 57 is retained because the male wings 37 are more rigid than the base and because the male wings 37 are prevented from further outward movement by the wings 35. In addition, the force exerted by the deflected base is less than the force required to disengage the hooks. In order to facilitate the deflection of the base, the fastening strip may include notches 56.

As the base deflects inward, the surface alteration 63 opens and exposes the coextruded portion 65 as shown in FIG. 4D. The mating fastening strip 31 is translucent or transparent. Thus, the second color of the coextruded portion is visible to the user through the mating fastening strip 31 as shown in FIG. 7A. Prior to occlusion, the second color of the coextruded portion is not visible because the first color of the base surrounds the second color. After occlusion, the user is able to determine that occlusion has occurred because the surface alteration 63 will be open and the second color will be visible.

The fastening strips are separated a distance 66 near the male wings 37 and a distance 67 near the center of the fastening strips. The difference between distance 66 and distance 67 is the depth 68 of the deformation 57.

With respect to the edge glow embodiment shown in FIGS. 3C and 3D, the occlusion occurs in a similar fashion. As the base deflects inward, the surface alteration 63I opens and exposes the edge glow material as shown in FIG. 3D. The mating fastening strip is translucent or transparent. Thus, the edge glow effect is visible to the user through the mating fastening strip as shown in FIG. 7A. Prior to occlusion, the edge glow effect is not visible because the surface alteration 63I is closed. After occlusion, the user is able to determine that occlusion has occurred because the surface alteration 63I will be open and the edge glow effect will be visible.

The wings employed in this embodiment of the present invention have the additional advantage of serving as guide members. Guide members sometimes are incorporated into conventional closure devices to provide a further improved "feel" and further accuracy to such devices. Such guide members have been provided in the shape of triangles, rectangles or other suitable shapes and are generally provided by extrusion as integrally connected to one or both of the closure elements. In this embodiment of the present invention, the wings provide a funneling-type action as the fastening strips are brought together and the female closure element is brought into contact with the male closure element.

Figure 7:
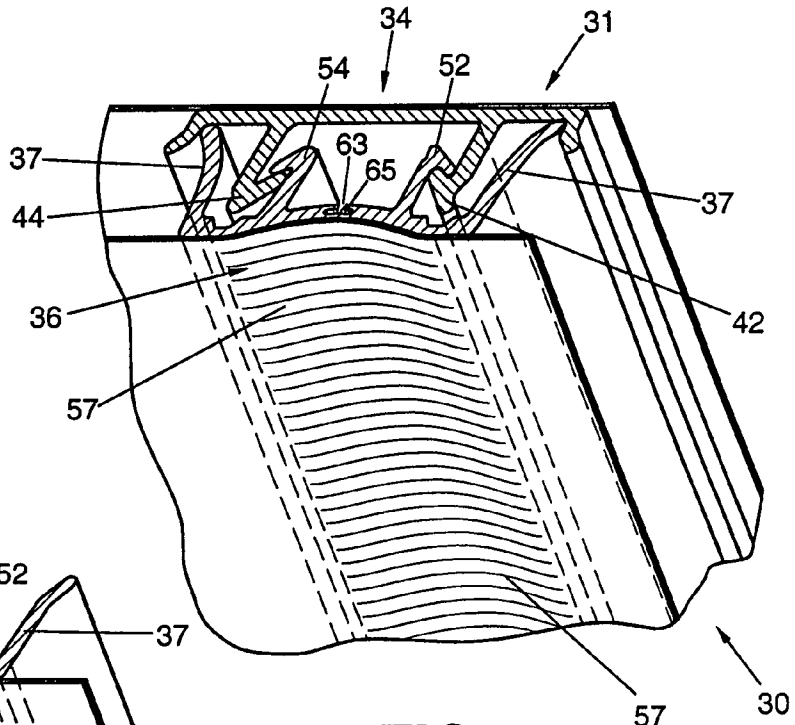
FIG. 7 is an enlarged perspective view of a closure device according to the present invention when occluded, illustrating the visual changing portion and the inward deformation formed upon occlusion of the closure device.
Figure 6:
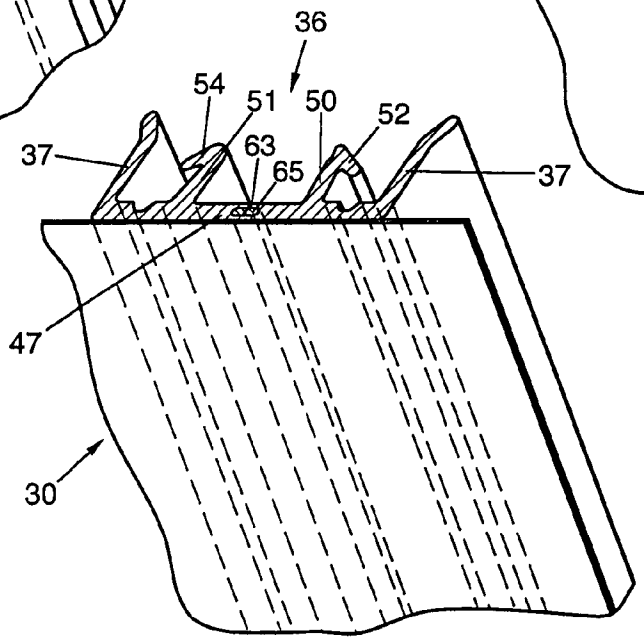
FIG. 6 is a perspective view of the male fastening strip illustrated in FIG. 3, including a male closure element and a pair of wings.
Figure 5:
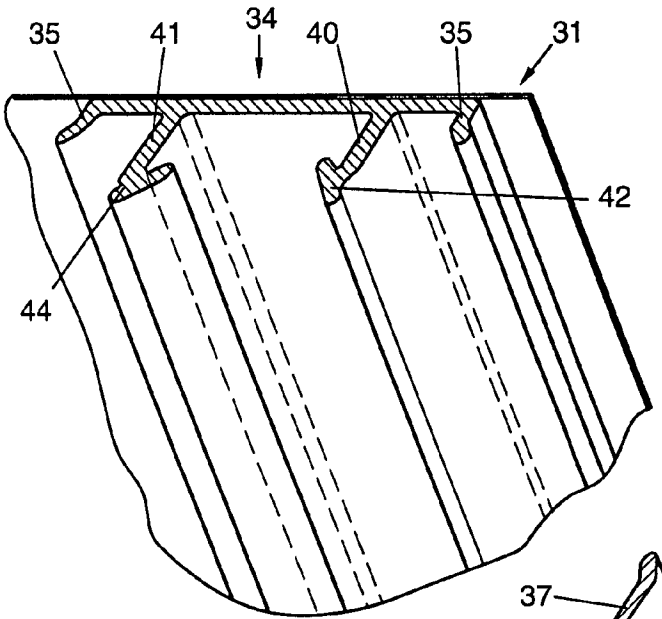
FIG. 5 is a perspective view of the female fastening strip illustrated in FIG. 2, including a female closure element and a pair of wings.
Figure 7A:
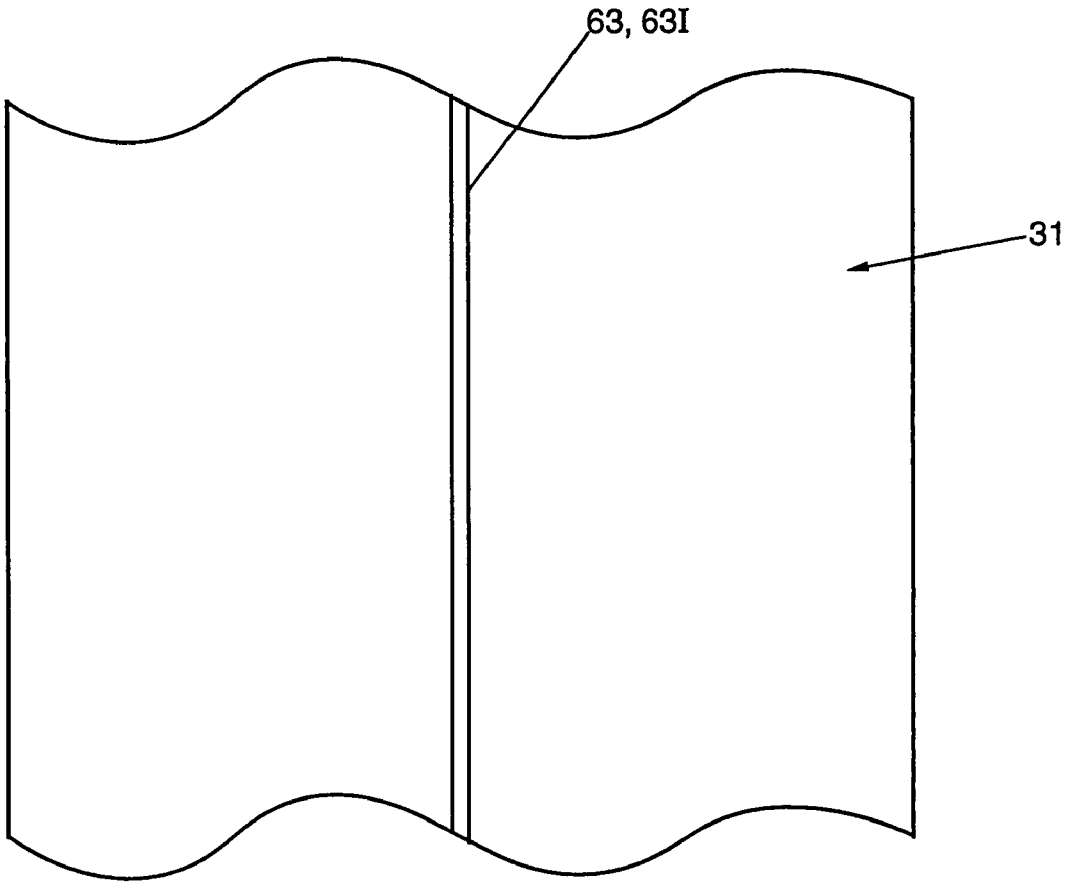
FIG. 7A is a top view of the closure device when occluded showing the visually changing portion.

FIG. 7 illustrates the inward deformation 57 formed by the flexure of the male fastening strip. This deformation 57 provides a tactile confirmation of occlusion of the closure device. Accordingly, a user need only run his or her finger along the male fastening strip to confirm that the container is properly sealed.

In addition to the visual and tactile confirmations of occlusion noted above, other visual indications of occlusion may be provided. For example, the male and female fastening strips may include pigments so as to provide a visual indication of occlusion of the closure device. The conventional use of such pigments is known in the art and has been discussed above. For example, the male element may be translucent and the female element may be opaque. When the male and female element portions are occluded, a different color is provided for establishing visually the occlusion. The closure device may also include a color change closure as disclosed in U.S. Pat. No. 4,829,641. U.S. Pat. No. 4,829,641 is incorporated herein by reference. Thus, the closure device could have two visual indications of occlusion. The first visual indication would be the color from the opened surface alteration as noted above. The second visual indication would be the different color provided when the opaque female element is occluded with the translucent male element as noted above.

Figure 10:
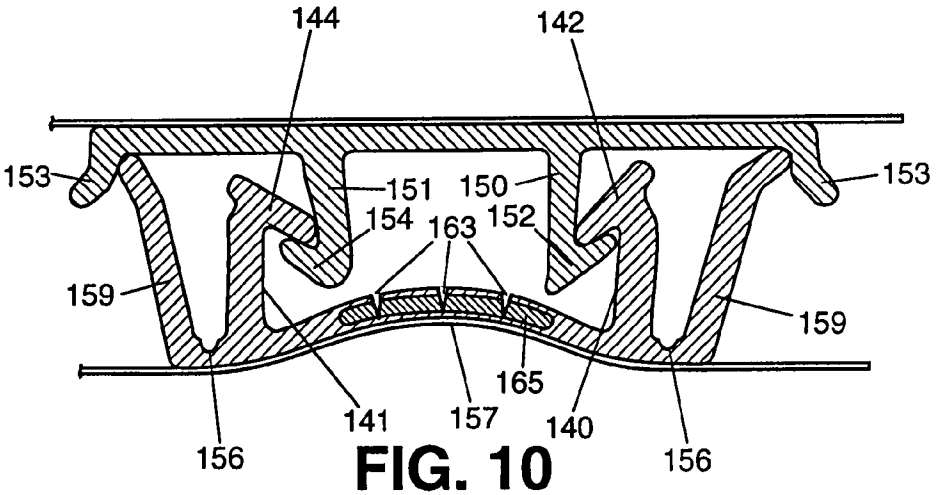
FIG. 10 is a cross-sectional view of the closure device formed by the male and female fastening strips illustrated in FIGS. 8 and 9 when occluded, illustrating in cross-section the visual changing portions and the deformation formed by flexure of the female closure element upon occlusion of the closure device.
Figure 8:
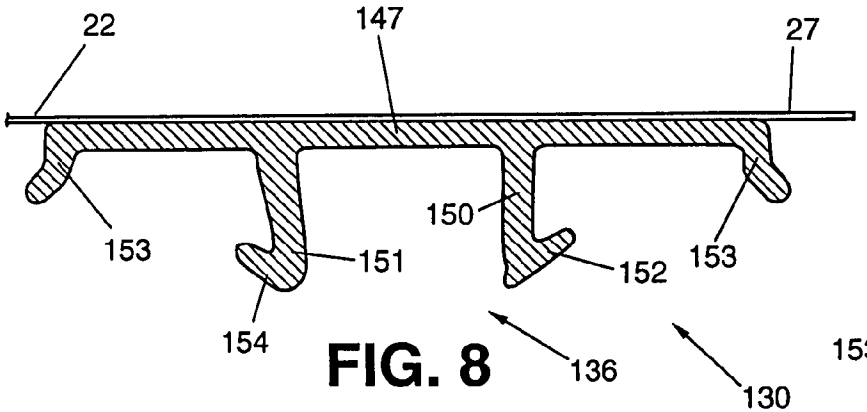
FIG. 8 is a cross-sectional view of the male fastening strip of another embodiment of the closure device according to the present invention, including a male closure element and a pair of wings on each side of the male closure element.
Figure 9:
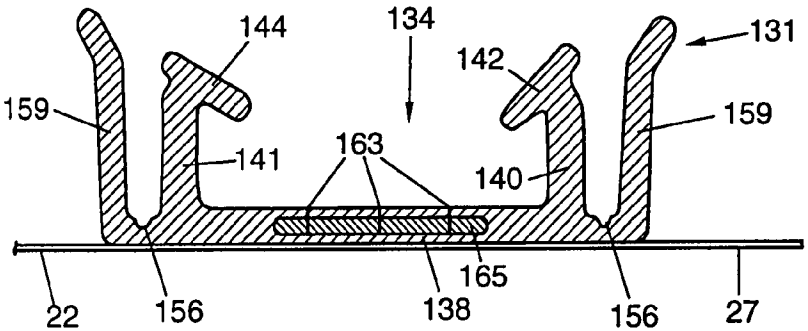
FIG. 9 is a cross-sectional view of the female fastening strip according to the present invention, complementary to the male fastening strip shown in FIG. 8, including visual changing portions, a female closure element and a pair of wings on each side of the female closure element.
Figure 12:
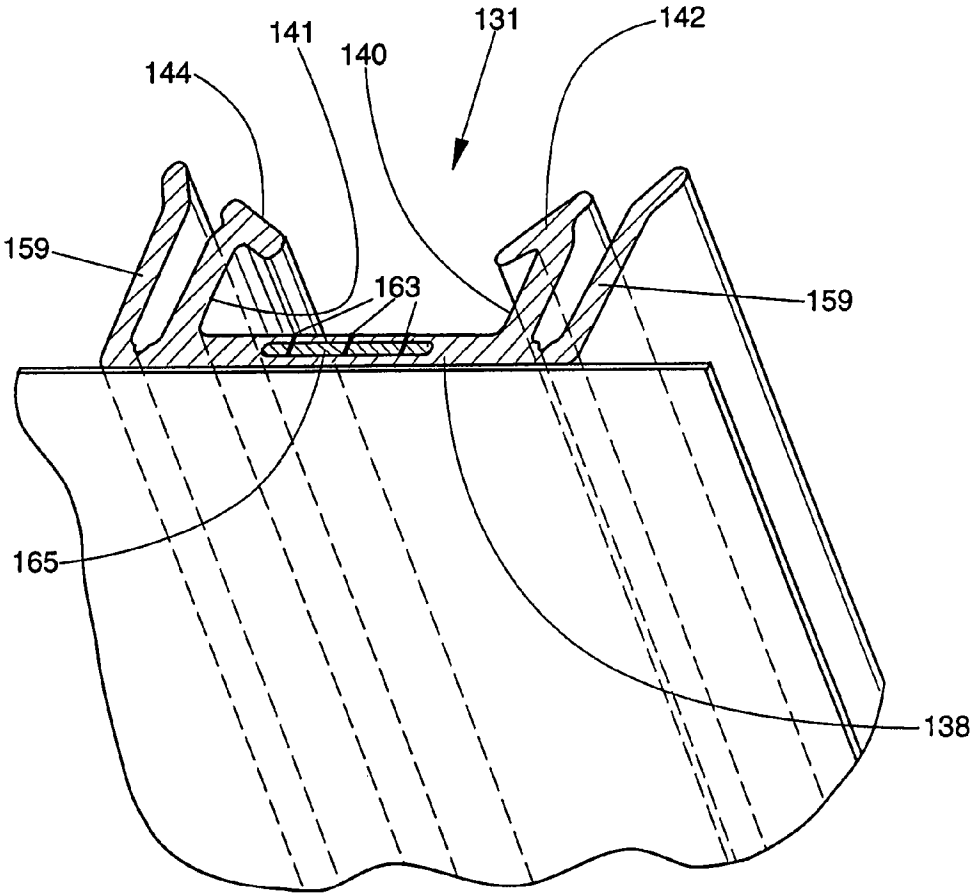
FIG. 12 is a perspective view of the female fastening strip illustrated in FIG. 9, having visual changing portions, a female closure element and a pair of wings on each side of the female closure element.
Figure 11:
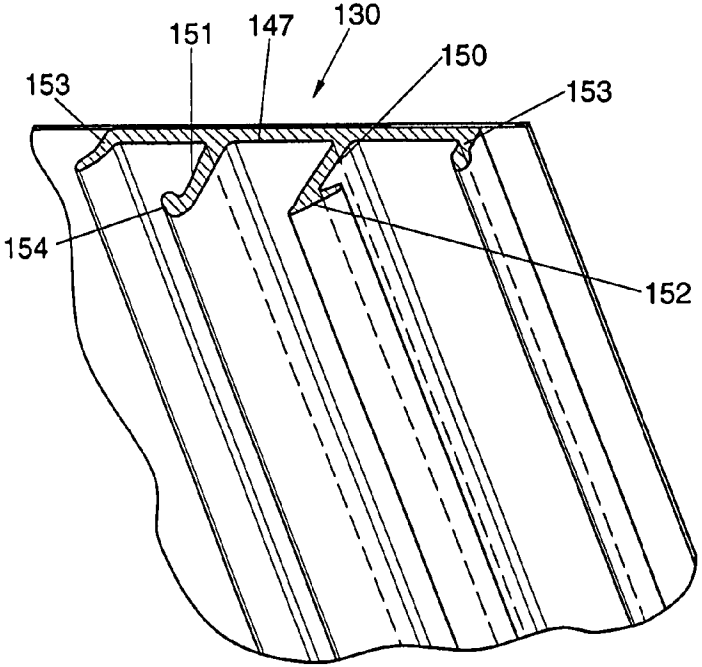
FIG. 11 is a perspective view of the male fastening strip illustrated in FIG. 8, having a male closure element and a pair of wings on each side of the male closure element.

FIGS. 8 and 9 illustrate male and female fastening strips according to another embodiment of the present invention. As shown in FIG. 8, the male fastening strip 130 includes a pair of female wings 153, whereas, as shown in FIG. 9, the female fastening strip 131 includes a pair of male wings 159. The function of the closure device formed by the fastening strips shown in FIGS. 8 and 9 is analogous to that of the closure device illustrated in FIGS. 2-6, except that the female fastening strip 131 flexes to form an inward deformation 157 when the closure device is occluded rather than the male fastening strip 130. In addition, the female fastening strip 131 has three surface alterations 163 which open to expose the coextruded portion 165. FIG. 10 illustrates the closure device formed by the fastening strip shown in FIGS. 8 and 9 in an occluded position. FIGS. 11 and 12 illustrate in further detail the fastening strips shown in FIGS. 8 and 9.

Specifically, female fastening strip 131 includes a female closure element 134 similar to female closure element 34 in FIG. 2. The female fastening strip 131 also includes a pair of male wings 159 similar to male wings 37 in FIG. 3 described above. The male fastening strip 130 includes a male closure element 136 similar to male closure element 36 in FIG. 3. The male fastening strip 130 also includes a pair of female wings 153 similar to female wings 35 in FIG. 2.

The female closure element 134 includes a base portion 138 similar to base portion 38 in FIG. 2 and includes webs 140, 141 similar to webs 40, 41 in FIG. 2. The webs 140, 141 include female hook portions 142, 144 similar to female hook portions 42, 44 in FIG. 2.

The male closure element 136 includes a base portion 147 similar to base portion 47 in FIG. 3 and includes webs 150, 151 similar to webs 50, 51 in FIG. 3. The webs 150, 151 include male hook portions 152, 154 similar to male hook portions 52, 54 in FIG. 3. Finally, the base portion 138 may be provided with notches 156 which are similar to notches 56 in FIG. 3.

Figure 10B:
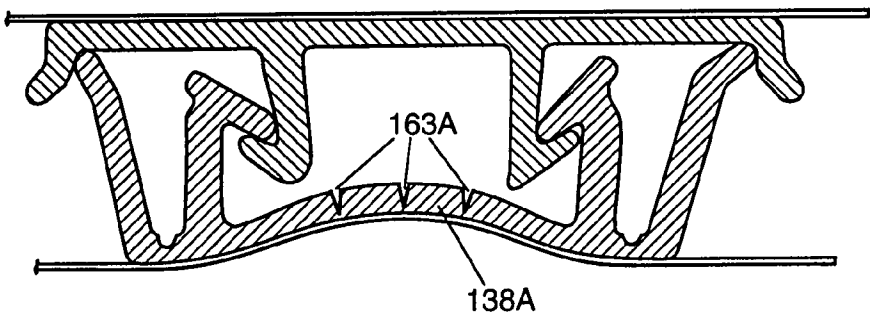
FIG. 10B is a cross-sectional view of the closure device in FIG. 10A in the occluded position.
Figure 10A:
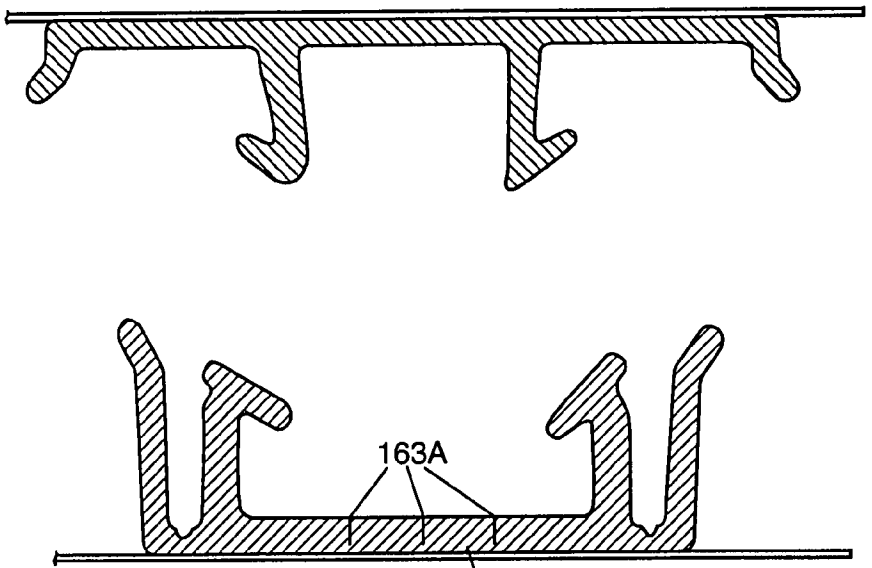
FIG. 10A is a cross-sectional view of another embodiment of the fastening strips in FIGS. 8 and 9 in the unoccluded position.

The base portion 138 is provided with surface alterations 163 and coextruded portion 165 which are similar to surface alterations 63 and coextruded portion 65. However, the base could include any other surface alterations embodiment described herein. For example, as shown in FIGS. 10A and 10B, the base portion 138A may include an edge glow material and the surface alterations 163A would extend through the edge glow material. In this embodiment, the center surface alteration 163A extends further into the base than the outer surface alterations 163A. Thus, the center surface alteration 163A has a greater depth than the outside surface alterations 163A.

As the base deflects inward, the surface alterations 163 open and expose the coextruded portion 165 as shown in FIG. 10. The mating fastening strip 130 is translucent or transparent. Thus, the second color of the coextruded portion is visible to the user through the mating fastening strip 130. Prior to occlusion, the second color of the coextruded portion 165 is not visible because the first color of the base surrounds the second color. After occlusion, the user is able to determine that occlusion has occurred because the surface alteration 163 will be open and the second color will be visible.

With respect to the edge glow embodiment shown in FIGS. 10A and 10B, the occlusion occurs in a similar fashion. As the base deflects inward, the surface alterations 163A open and expose the edge glow effect as shown in FIG. 10B. The mating fastening strip is translucent or transparent. Thus, the edge glow effect is visible to the user through the mating fastening strip. Prior to occlusion, the edge glow effect is not visible because the surface alteration 163A is closed. After occlusion, the user is able to determine that occlusion has occurred because the surface alteration 163A will be open and the edge glow effect will be visible.

Figure 13:
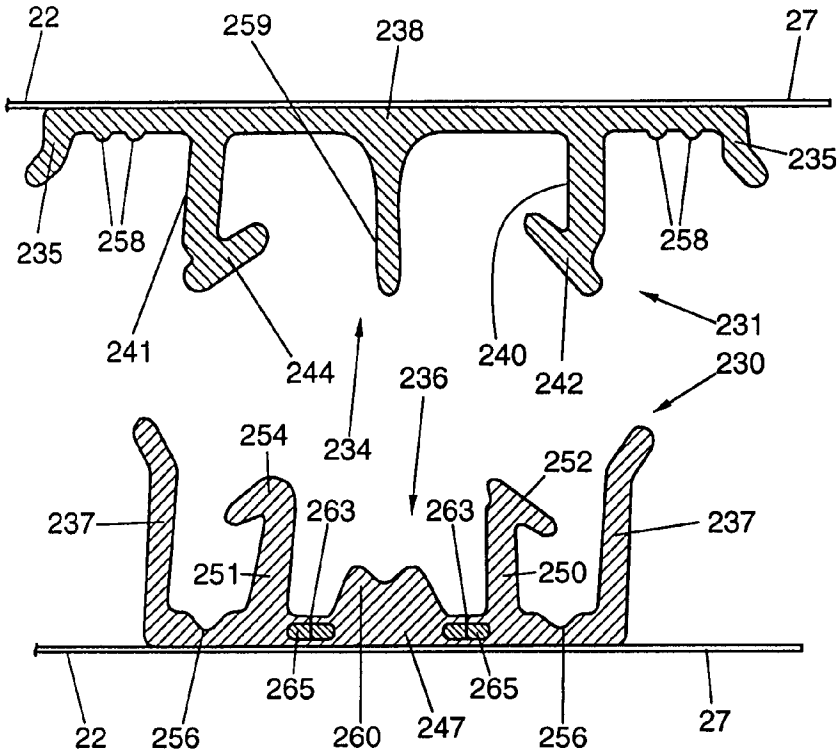
FIG. 13 is a cross-sectional view of a closure device according to the present invention wherein the female fastening strip includes visual changing portions, a female closure element, a pair of wings on each side of the female closure element, a plurality of protrusions between each wing and the female closure element, and a spacer member.

FIG. 13 illustrates yet another embodiment of the closure device of the present invention. In this embodiment, the closure device includes a plurality of protrusions which engage wings to provide a dynamically tactile indication of proper occlusion, in addition to the visual indication.

Figure 14:
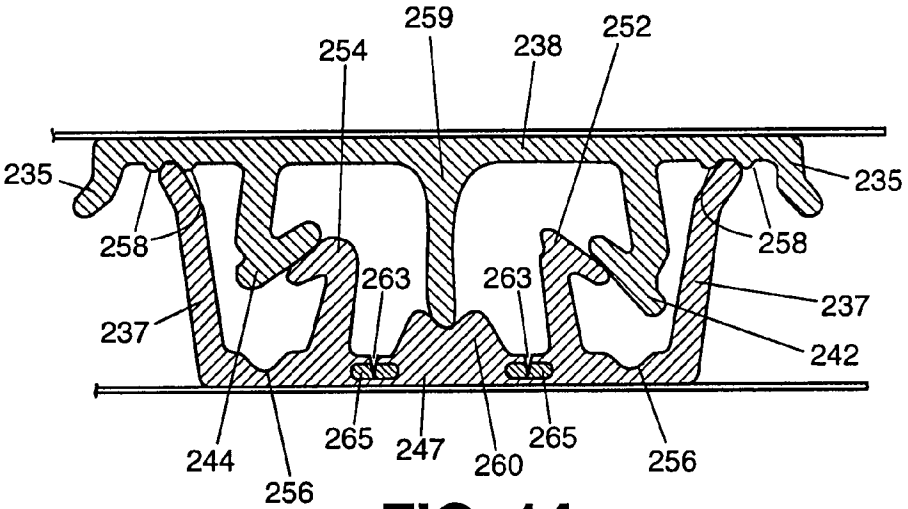
FIG. 14 is a cross-sectional view of the closure device illustrated in FIG. 13 as it is in the process of becoming occluded.
Figure 15:
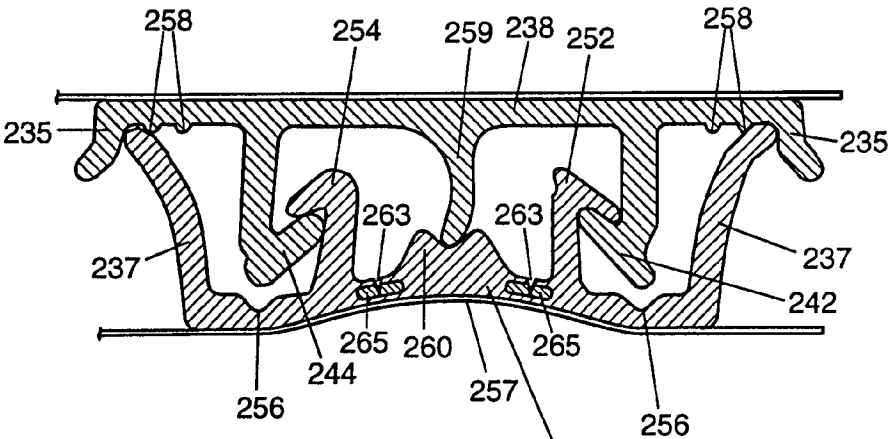
FIG. 15 is a cross-sectional view of the closure device illustrated in FIG. 13 when fully occluded.
Figure 15A:
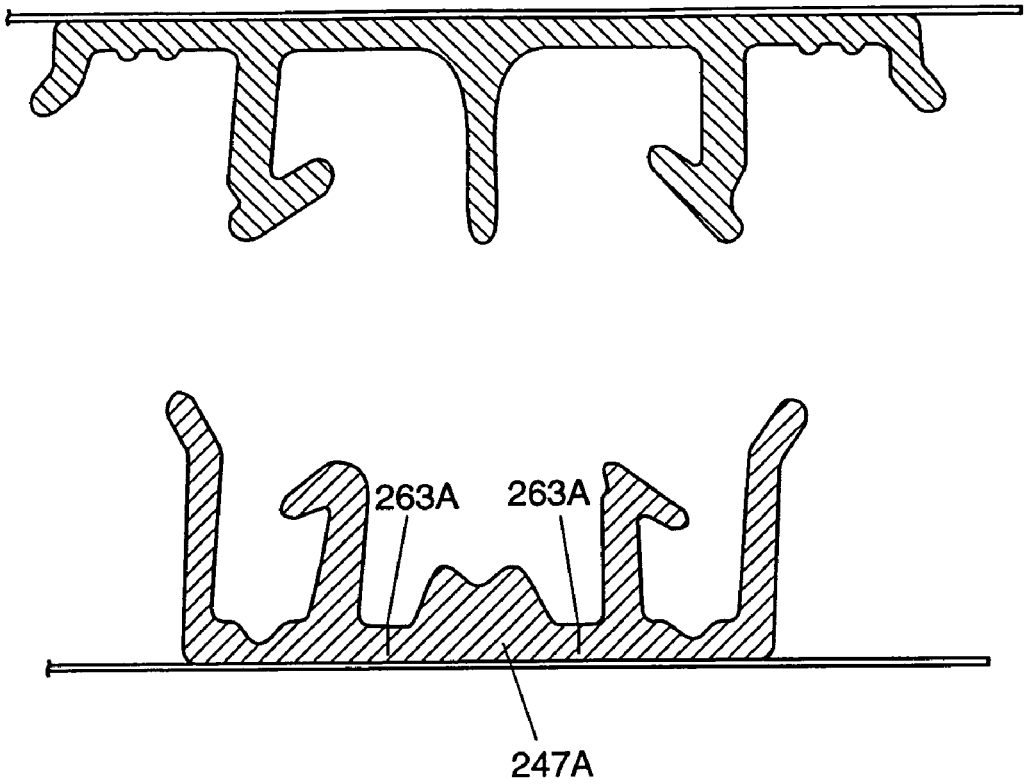
FIG. 15A is a cross-sectional view of another embodiment of the closure device in FIG. 13 in the unoccluded position.
Figure 15B:
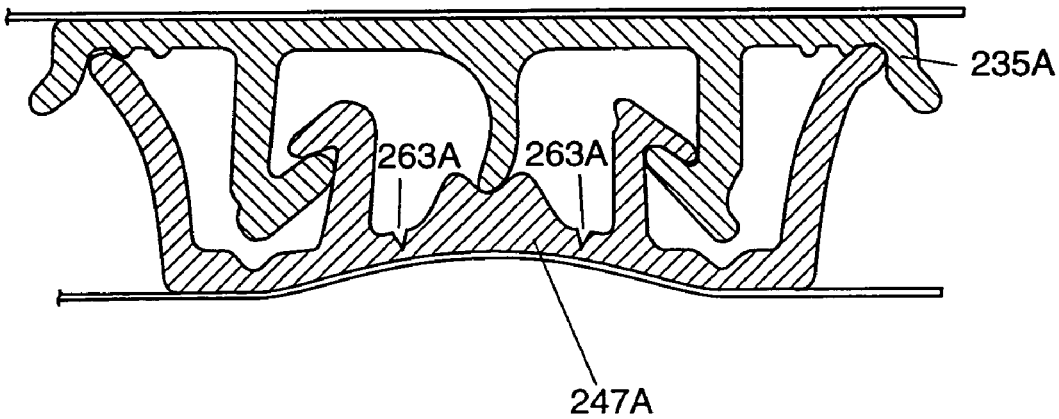
FIG. 15B is a cross-sectional view of the closure device in FIG. 15A in the occluded position.

Many of the components in FIGS. 13-15 are similar to FIGS. 2-6. Referring to FIG. 13, the closure device comprises male and female fastening strips 230, 231 similar to fastening strips 30, 31 in FIGS. 2 and 3. The female fastening strip 231 includes a female closure element 234 and a pair of wings 235 similar to female closure element 31 and wings 35 in FIG. 2. The male fastening strip 230 includes a male closure element 236 and a pair of wings 237 similar to male closure element 36 and wings 37 in FIG. 3. The female closure element 234 includes a base portion 238 and webs 240, 241 similar to base portion 38 and webs 40, 41 in FIG. 2. The webs 240, 241 include hook portions 242, 244 similar to hook portions 42, 44 in FIG. 2. The male closure element 236 includes a base portion 247 and webs 250, 251 similar to base portion 47 and webs 50, 51 in FIG. 3. The webs 250, 251 include hook portions 252, 254 similar to hook portions 52, 54 in FIG. 3. The base portion 247 is provided with surface alterations 263 and coextruded portions 265 which are similar to surface alteration 63 and coextruded portion 65. However, the base could include any other surface alteration embodiment described herein. For example, as shown in FIGS. 15A and 15B, the base 247A may include a fluorescent material and the surface alteration 263A would extend through the fluorescent material. As another example, one of the coextruded portions 265 may have a different color than the other coextruded portion 265. Furthermore, the base portion 247 may be provided with notches 256 which are similar to the notches 56 in FIG. 3.

As the base deflects inward, the surface alterations 263 open and expose the coextruded portions 265 as shown in FIG. 15. The mating fastening strip 231 is translucent or transparent. Thus, the second color of the coextruded portion 265 is visible to the user through the mating fastening strip 231. Prior to occlusion, the second color of the coextruded portion 265 is not visible because the first color of the base 247 surrounds the second color. After occlusion, the user is able to determine that occlusion has occurred because the surface alteration 263 will be open and the second color will be visible.

With respect to the edge glow embodiment shown in FIGS. 15A and 15B, the occlusion occurs in a similar fashion. As the base deflects inward, the surface alterations 263A open and expose the edge glow effect as shown in FIG. 15B. The mating fastening strip is translucent or transparent. Thus, the edge glow effect is visible to the user through the mating fastening strip. Prior to occlusion, edge glow effect is not visible because the surface alteration 263A is closed. After occlusion, the user is able to determine that occlusion has occurred because the surface alteration 263A will be open and the edge glow effect will be visible.

In this embodiment shown in FIGS. 13-15, the female fastening strip 231 includes a plurality of protrusions 258 spaced apart along the fastening strip on each side of the female closure element 234. These protrusions 258 are spaced apart to engage the wings 237 of the male closure element. The wings 237 travel in increments along the length of the female fastening strip 231 as the male and female fastening strips are brought together. This discrete travel is tactually perceptible to a user. Thus, in addition to providing a visual indication and a deformation 257 when the closure device is occluded, the closure device affords a dynamically tactile indication of proper occlusion. A user is thus able to "feel" that the closure device is being properly closed. FIG. 14 illustrates the closure device of FIG. 13 when the wings of the male fastening strip have traversed across one protrusion 258 of the female fastening strip 231. FIG. 15 shows the closure device of FIG. 13 in a fully occluded position.

As shown, the female fastening strip includes four protrusions 258, two on each side of the female closure element. However, the female closure element could include a greater or fewer number of protrusions, such as one, two three, four or more protrusions. The protrusions may have the same size or may be different sizes. For example, the protrusions may be sized such that the outermost protrusions are larger than the innermost protrusions, thus requiring slightly more force to push the wings over the outer protrusions. Alternatively, or in addition thereto, the protrusions may include colorants such as pigments. If the wings of the male fastening strip are opaque, the user will be able to see the protrusions when the closure device is deoccluded or partially occluded, but will not see the protrusions when the closure device is fully occluded. Thus, further visual indication of occlusion of the closure device will be provided. The innermost protrusions may be differently colored from the outermost protrusions which allows the user to visually observe the progression of occlusion of the closure device. The use of the protrusions and wings to provide a dynamically tactile indication of proper occlusion may be used with any of the embodiments in this application as appropriate.

Another feature of the invention is the spacing member 259 which provides a predetermined spacing between the fastening strips and also a predetermined tension among the closure elements. Referring to FIGS. 13-15, the base 238 includes a spacing member 259 and the base 247 includes an engagement surface 260 for the spacing member. The spacing member 259 extends from the base a predetermined distance and is located between the webs 240, 241. The engagement surface 260 is located between the webs 250, 251 and includes a groove which engages the spacing member 259.

Referring to FIG. 14, as the user applies forces to the fastening strips, the spacing member 259 contacts the engagement surface 260. In order to hold the fastening strips in an occluded position, the female hooks 242, 244 must engage the male hooks 252, 254. As the user continues to apply the forces, the female webs 240, 241 deflect outwardly and the male webs 250, 251 deflect inwardly in order to allow the female hooks 242, 244 and the male hooks 252, 254 to pass each other. In addition, the hooks may also deflect during this process.

As the user continues to apply the forces, the female hooks 242, 244 engage the male hooks 252, 254 as shown in FIG. 15. During the process, the base of the male fastening strip deflects inward and forms an inward deformation 257. During the process, the spacing member 259 may also deflect as shown in FIG. 15. The spacing member performs several functions. The spacing member 259 maintains a predetermined distance between the fastening strips. The spacing member 259 also maintains a predetermined depth for the deformation 257 by preventing the deformation 257 from moving too close to the other fastening strip. The spacing member 259 also maintains tension between the female hooks 242, 244 and the male hooks 252, 254.

The deformation 257 is retained because the male wings 237 are more rigid than the base and because the male wings 237 are prevented from further outward movement by the wings 235. In addition, the forces exerted by the deflected base and the deflected spacing member 259 are less than the force required to disengage the hooks. In order to facilitate the deflection of the base, the fastening strip may include notches 256.

The spacing member 259 may be located on the male fastening strip 230 and the engagement surface 260 on the female fastening strip 231 as shown in FIGS. 13-15. Conversely, the spacing member may be located on the female fastening strip and the engagement surface on the male fastening strip. The spacing member 259 and the engagement surface 260 may also include color to provide the user with a visual indication that occlusion has occurred as noted above. In addition, the spacing member may be used with any of the embodiments in this application where appropriate.

Figure 17:
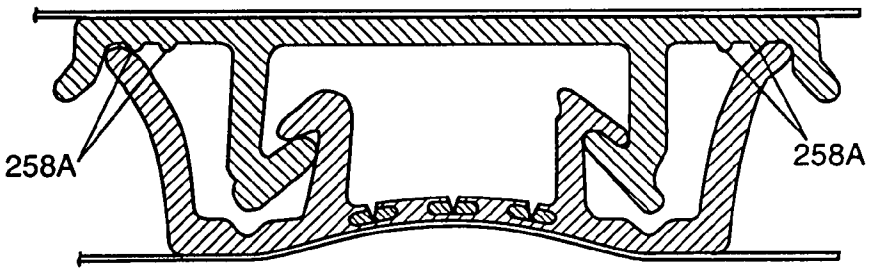
FIG. 17 is a cross-sectional view of another embodiment which includes visual changing portions and a plurality of protrusions.
Figure 16:
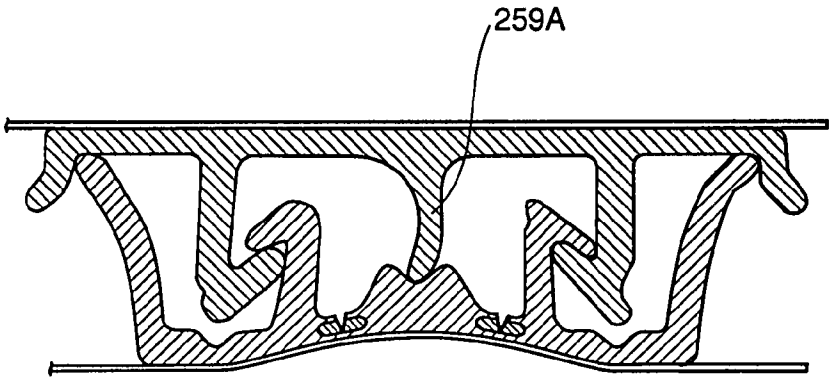
FIG. 16 is a cross-sectional view of another embodiment which includes visual changing portions and a spacer member.

Furthermore, the spacing member 259 and the protrusions 258 can be used independently. For example, FIG. 16 illustrates a closure device which includes a spacing member 259A similar to FIGS. 13-15 but does not include protrusions. Conversely, FIG. 17 illustrates a closure device which includes protrusions 258A similar to FIGS. 13-15 but does not include a spacing member. In addition, FIG. 17 illustrates three separate coextrusions in the base portion.

Figure 18:
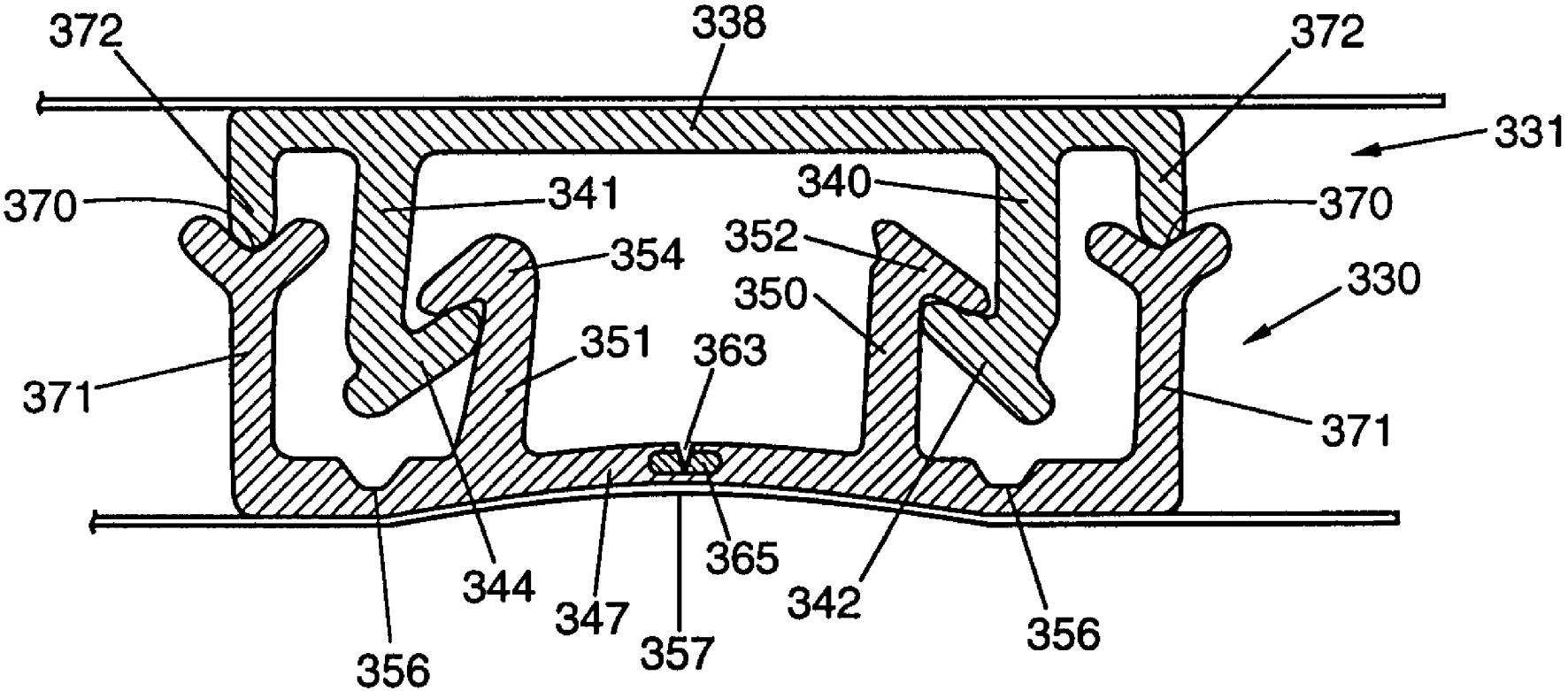
FIG. 18 illustrates a closure device according to the present invention in which the wings of the male fastening strip are Y-shaped.

Other embodiments of the closure elements and wings may be provided. For example, FIG. 18 illustrates a closure device in which the wings 371 of the male fastening strip are Y-shaped. The wings 372 of the female fastening strip are spaced so as to engage the grooves 370 in the wings 371. Referring to FIG. 18, the female fastening strip 331 includes a female closure element 334 similar to female closure element 34 shown in FIG. 2. The female closure element 334 includes a base portion 338 and a pair of webs 340, 341 similar to base 38 and webs 40, 41 in FIG. 2. The webs 340, 341 include female hook portions 342, 344 similar to hooks 42, 44 in FIG. 2. The fastening strip 331 also includes a wing 372 on each side of the female closure element 334.

The male fastening strip 330 includes a male closure element 336 similar to male closure element 36 in FIG. 3. The male closure element 336 includes a base portion 347 and a pair of webs 350, 351 similar to base 47 and webs 50, 51 in FIG. 3. The webs 350, 351 include male hook portions 352, 354 similar to hooks 52, 54 in FIG. 3. The fastening strip 330 also includes a wing 371 on each side of the male closure element 336. The wing 371 includes a groove 370 to engage the wing 372.

The base portion 347 is provided with a surface alteration 363 and a coextruded portion 365 which are similar to the surface alteration 63 and the coextruded portion 65 in FIG. 3. Furthermore, the base could include any other surface alteration embodiment described herein. For example, the base may include a fluorescent material and the surface alterations extend through the fluorescent material.

FIG. 18 shows the closure device in occluded position. As noted above, the user applies compression forces to the fastening strips in order to occlude the closure device. As the user occludes the fastening strips, the male wings 371 engage the female wings 372 as shown in FIG. 18. In order to hold the fastening strips in an occluded position, the female hooks 342, 344 must engage the male hooks 352, 354 as noted above for hooks 42, 44, 52, 54. During this process, the base of the male fastening strip deflects inward and forms an inward deformation 357. The deformation 357 is retained because the male wings 371 are more rigid than the base and because the male wings 371 are held in position by the groove 370 engaging the wings 372. The groove 370 prevents the wings 371 from moving laterally with respect to wings 372. In order to facilitate the deflection of the base, the fastening strip may include notches 356.

As the base deflects inward, the surface alteration 363 opens and exposes the coextruded portion 365 as shown in FIG. 18. The mating fastening strip 331 is translucent or transparent. Thus, the second color of the coextruded portion 365 is visible to the user through the mating fastening strip 331. Prior to occlusion, the second color of the coextruded portion 365 is not visible because the first color of the base 347 surrounds the second color. After occlusion, the user is able to determine that occlusion has occurred because the surface alteration 363 will be open and the second color will be visible.

Figure 19:
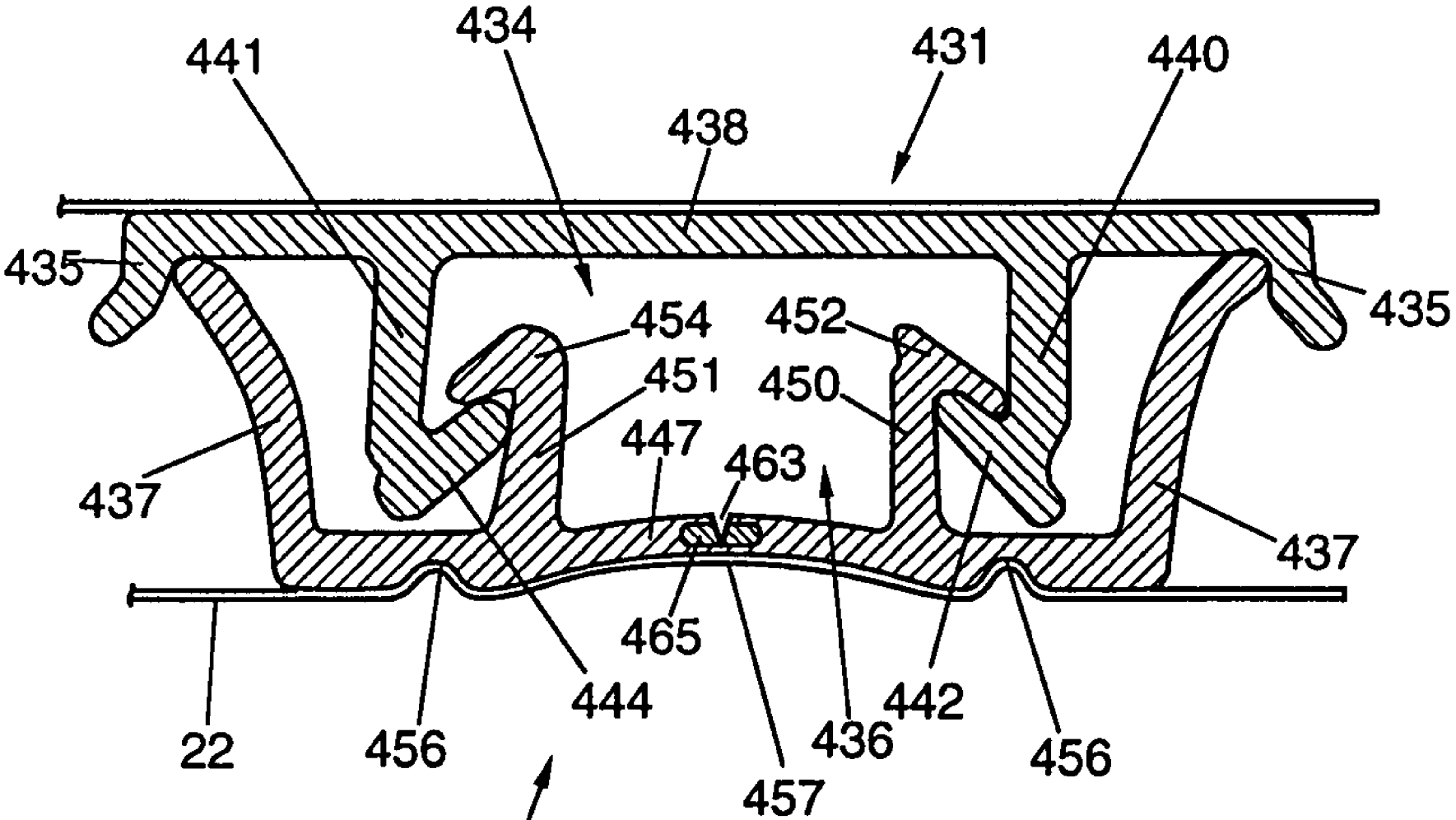
FIG. 19 is a cross-sectional view of another embodiment of a closure device of the present invention in which the notches are located on the non-mating side of the fastening strip.

In another embodiment of the present invention, the notches may be disposed on the other side of the male fastening strip. FIG. 19 illustrates such a male fastening strip 430 including the notches 456 which are disposed on the outside of male fastening strip 430. The notches 456 may also be formed into the side wall 22 of the plastic bag.

Referring to FIG. 19, the female fastening strip 431 includes a female closure element 434 similar to female closure element 34 shown in FIG. 2. The female closure element 434 includes a base portion 438 and webs 440, 441 similar to base 38 and webs 40, 41 in FIG. 2. The webs 440, 441 include female hook portions 442, 444 similar to hooks 42, 44 in FIG. 2. The fastening strip 431 also includes wings 435 similar to wings 35 in FIG. 2.

The male fastening strip 430 includes a male closure element 436 similar to male closure element 36 in FIG. 3. The male closure element 436 includes a base portion 447 and a pair of webs 450, 451 similar to base 47 and webs 50, 51 in FIG. 3. The webs 450, 451 include male hook portions 452, 454 similar to hooks 52, 54 in FIG. 3. The fastening strip 43 also includes a wing 437 on each side of the male closure element 436 similar to the wings 37 in FIG. 3.

The base portion 447 is provided with a surface alteration 63 and a coextruded portion 465 which are similar to the surface alteration 63 and the coextruded portion 65 in FIG. 3. Furthermore, the base could include any other surface alteration embodiment described herein. For example, the base may include an edge glow material and the surface alterations extend through the edge glow material, as illustrated in FIGS. 3A, 3B, 10A, 10B, 15A and 15B.

The fastening strip 430 includes notches 456 which are disposed on the non-mating side of the fastening strip 430. The notches are also formed into the side wall 22 of the plastic bag.

During occlusion, the user applies compression forces to the fastening strips as noted above. As the user occludes the fastening strips, the male wings 437 engage the female wings 435 as shown in FIG. 19. In order to hold the fastening strips in an occluded position, the female hooks 442, 444 must engage the male hooks 452, 454 as noted above for hooks 42, 44, 52, 54. During this process, the base of the male fastening strip deflects inward and forms an inward deformation 457. The deformation 457 is retained because the male wings 437 are more rigid than the base and because the male wings 437 are prevented from further outward movement by the wings 435. In addition, the force exerted by the deflected base is less than the force required to disengage the hooks. The notches 456 facilitate the deflection of the base.

As the base deflects inward, the surface alteration 463 opens and exposes the coextruded portion 465 as shown in FIG. 19. The mating fastening strip 431 is translucent or transparent. Thus, the second color of the coextruded portion 365 is visible to the user through the mating fastening strip 431. Prior to occlusion, the second color of the coextruded portion 365 is not visible because the first color of the base 347 surrounds the second color. After occlusion, the user is able to determine that occlusion has occurred because the surface alteration 463 will be open and the second color will be visible.

In addition, the fastening strip 430 provides an additional tactile sensation. The notches 456 on each side of the deformation 457 assist the user in locating and maintaining contact with the deformation. Furthermore, depending upon the configuration of the notches, the notches may also provide tactile confirmation of the occlusion. For example, the notches may be narrow when the closure device is not occluded. When the closure device is occluded, the notches may become wide enough so that the user can tactilely determine the difference between the narrow notch (i.e. unoccluded) and the wide notch (i.e. occluded).

The base flexes to create a deformation because at least a portion of the base is less rigid than the other portions of the fastening strip. The rigidity of the base can be reduced by having an area of reduced cross-section in the base. This area would be more likely to flex than the surrounding areas. An area of reduced cross-section can be achieved by using notches. In addition, an area of reduced cross-section can be achieved by chemical etching of at least a portion of the fastening strip. The chemical etching could be performed by using a chemical solvent. For example, chemical solvents for polyethylene are Decolin, a strong nitric acid or a strong base.

Figure 19A:
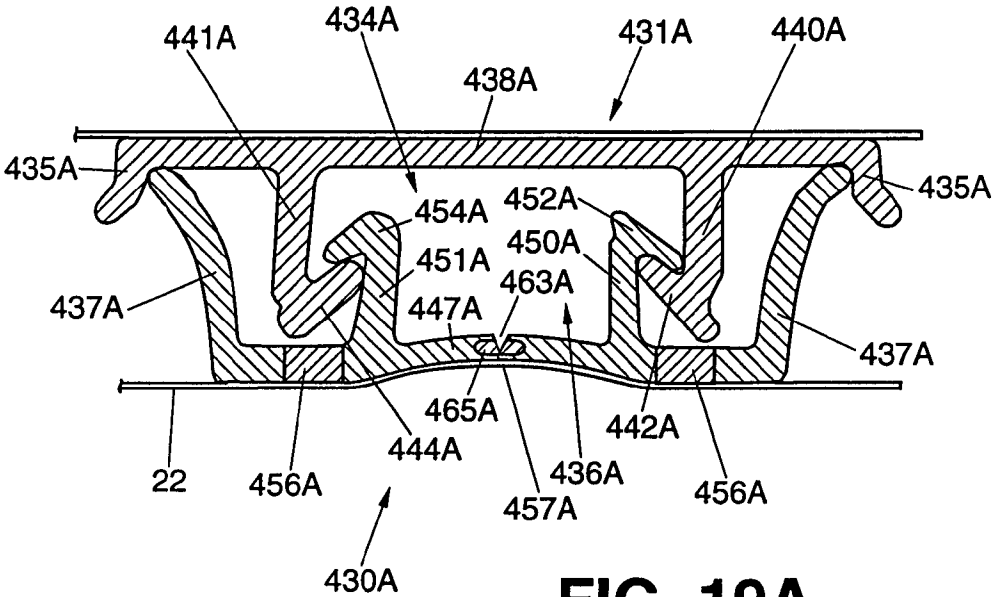
FIG. 19A is a cross-sectional view of another embodiment of a closure device of the present invention with coextruded portions and an inward deformation.

The rigidity of the base can also be reduced by having an area in the base which is made of a different second material, such as, by coextrusion. Referring to FIG. 19A, the male fastening strip 430A includes a base 447A which is made of a first material and coextruded portions 456A which are made of a second material. The second material would be more likely to flex than the first material with the application of the same force, i.e. the first material would have a different modulus of elasticity than the second material. Therefore, the base would more likely flex at the location of the second material.

Referring to FIG. 19A, the female fastening strip 431A includes a female closure element 434A similar to female closure element 434 shown in FIG. 19. The female closure element 434A includes a base portion 438A and webs 440A, 441A similar to base 438 and webs 440, 441 in FIG. 19. The webs 440A, 441A include female hook portions 442A, 444A similar to hooks 442, 444 in FIG. 19. The fastening strip 431A also includes wings 435A similar to wings 435 in FIG. 19.

The male fastening strip 430A includes a male closure element 436A similar to male closure element 436 in FIG. 19. The male closure element 436A includes a base portion 447A and a pair of webs 450A, 451A similar to base 447 and webs 450, 451 in FIG. 19. The webs 450A, 451A include male hook portions 452A, 454A similar to hooks 452, 454 in FIG. 19. The fastening strip 430A also includes a wing 437A on each side of the male closure element 436A similar to the wings 437 in FIG. 19. As noted above, the fastening strip 430A includes extruded portions 456A.

The base portion 447A is provided with a surface alteration 463A and a coextruded portion 465A which are similar to the surface alteration 63 and the coextruded portion 65 in FIG. 3. Furthermore, the base could include any other surface alteration embodiment described herein. For example, as shown in FIG. 19B the base 447B may include an edge glow material and the surface alterations 463B extend through the edge glow material.

During occlusion, the user applies compression forces to the fastening strips as noted above. As the user occludes the fastening strips, the male wings 437A engage the female wings 435A as shown in FIG. 19A. In order to hold the fastening strips in an occluded position, the female hooks 442A, 444A must engage the male hooks 452A, 454A as noted above for hooks 442, 444, 452, 454. During this process, the base of the male fastening strip deflects inward and forms an inward deformation 457A. The deformation 457A is retained because the male wings 437A are more rigid than the base and because the male wings 437A are prevented from further outward movement by the wings 435A. In addition, the force exerted by the deflected base is less than the force required to disengage the hooks. The coextruded portions 456A facilitate the deflection of the base.

As the base deflects inward, the surface alteration 463A opens and exposes the coextruded portion 465A as shown in FIG. 19A. The mating fastening strip 431A is translucent or transparent. Thus, the second color of the coextruded portion 365A is visible to the user through the mating fastening strip 431A prior to occlusion, the second color of the coextruded portion 365A is not visible because the first color of the base 347A surrounds the second color. After occlusion, the user is able to determine that occlusion has occurred because the surface alteration 463A will be open and the second color will be visible.

Figure 19B:
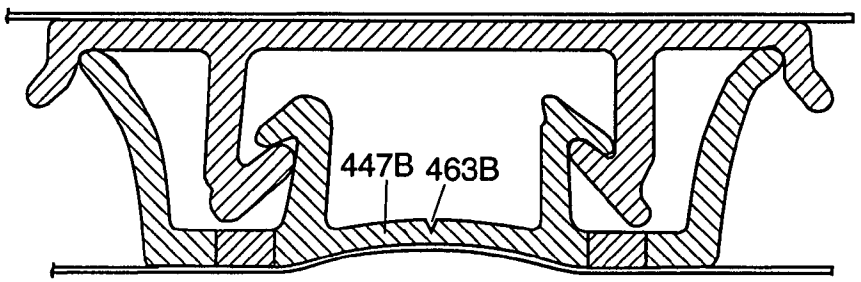
FIG. 19B is a cross-sectional view of another embodiment of the closure device in FIG. 19A. invention which includes a notch between the webs.

With respect to the edge glow embodiment shown in FIG. 19B, the occlusion occurs in a similar fashion. As the base deflects inward, the surface alteration 463B opens and exposes the edge glow effect as shown in FIG. 19B. The mating fastening strip is translucent or transparent. Thus, the edge glow effect is visible to the user through the mating fastening strip. Prior to occlusion, the edge glow effect is not visible because the surface alteration 463B is closed. After occlusion, the user is able to determine that occlusion has occurred because the surface alteration 463B will be open and the edge glow effect will be visible.

Figure 22A:
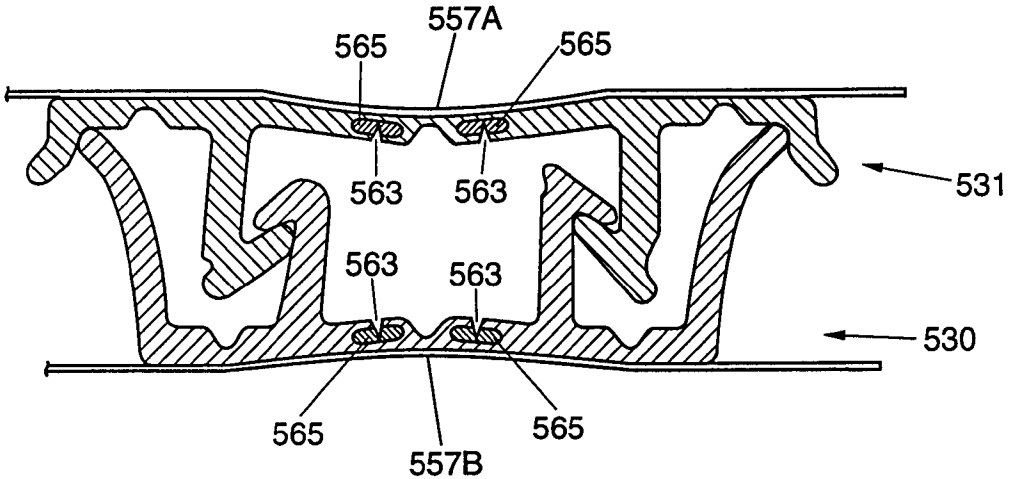
FIG. 22A is a cross-sectional view of another embodiment with a deformation in both the fastening strips.
Figure 22B:
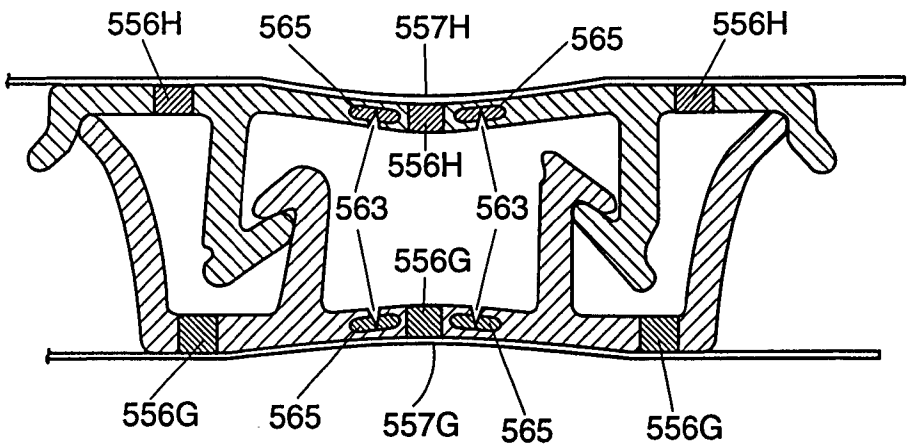
FIG. 22B is a cross-sectional view of another embodiment with coextruded portions and with a deformation in both fastening strips.
Figure 28A:
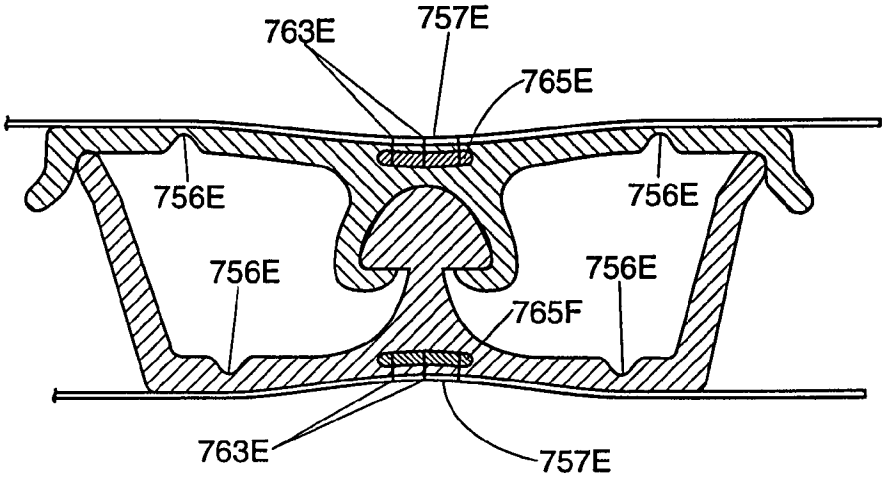
FIG. 28A is a cross-sectional view of another embodiment with visually changing portions and a deformation in both fastening strips.
Figure 28B:
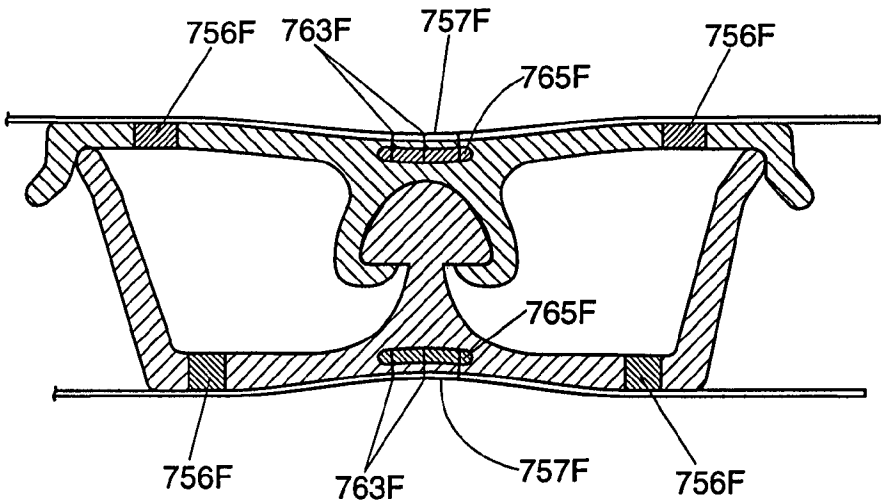
FIG. 28B is a cross-sectional view of another embodiment with coextruded portions, with visual changing portions and with a deformation in both fastening strips.
Figure 34A:
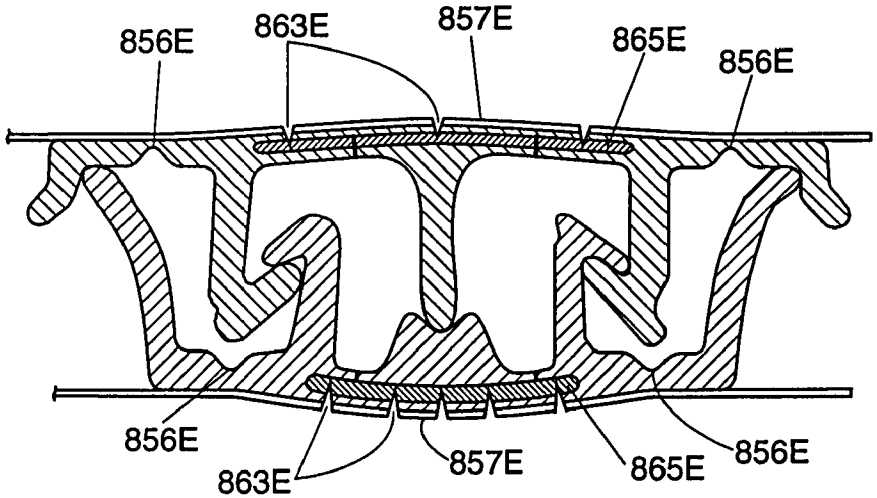
FIG. 34A is a cross-sectional view of another embodiment with visually changing portions and an outward deformation in both of the fastening strips.
Figure 34B:
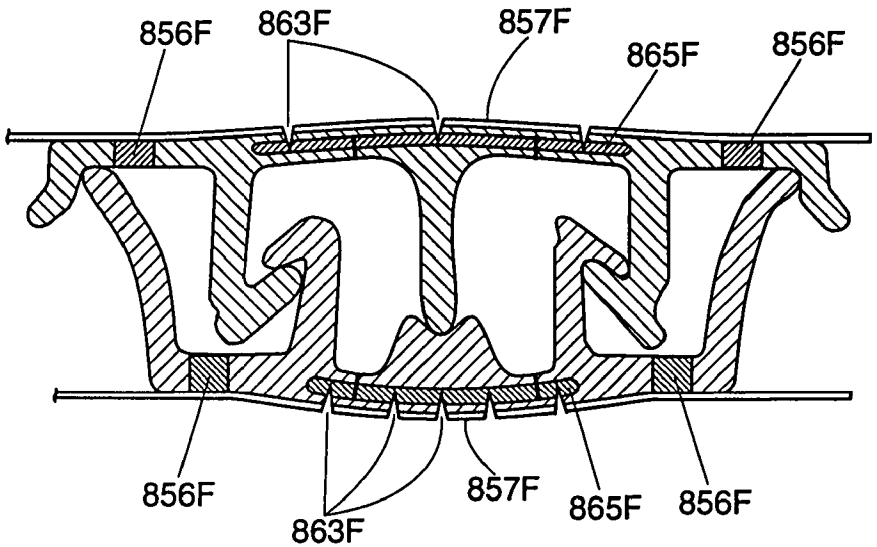
FIG. 34B is a cross-sectional view of another embodiment with coextruded portions, with visually changing portions and an outward deformation in both of the fastening strips.

In addition, the coextruded portion 456A may be continuous along the length of the fastening strip or the coextruded portion may be discontinuous along the length to provide an intermittent deformation effect. Furthermore, the second material could be disposed parallel to the longitudinal axis of the fastening strip as in FIG. 19A. In other embodiments, the second material could be disposed perpendicular to the longitudinal axis of the fastening strip as in U.S. Pat. No. 5,138,750 which is incorporated herein by reference. Finally, FIGS. 22B, 28B and 34B illustrate other embodiments of closure devices with coextruded portions.

Figure 20:
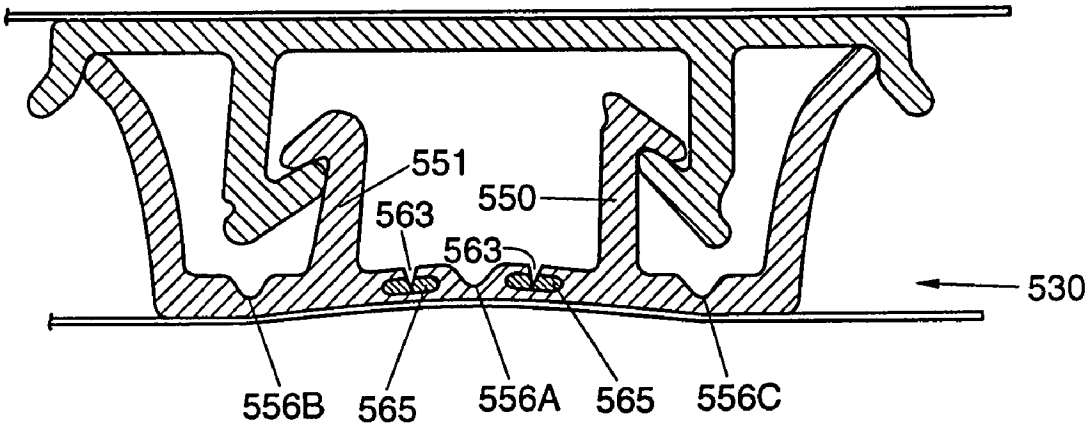
FIG. 20 is a cross sectional view of another embodiment of the present
Figure 21:
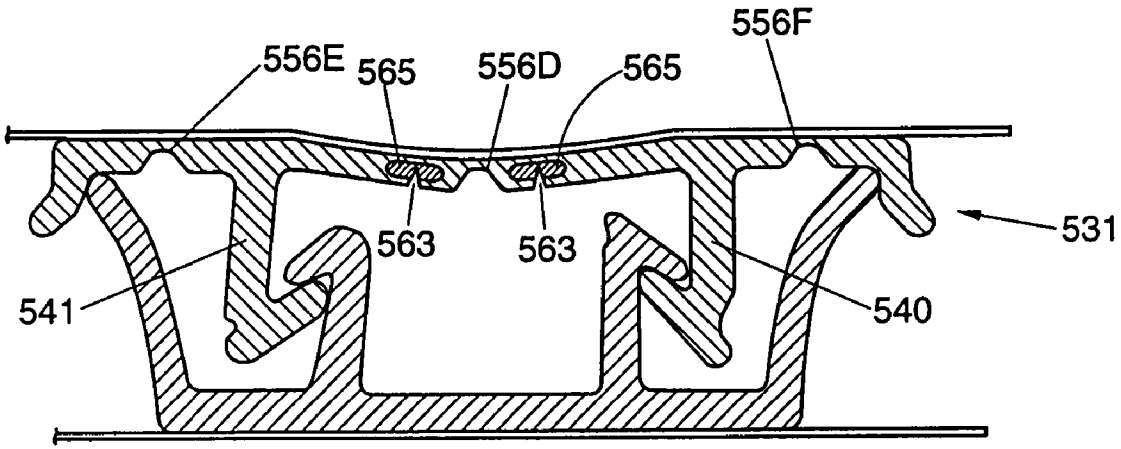
FIG. 21 is a cross-sectional view of another embodiment of the present invention which includes a notch between the webs.

As noted above, notches may be provided to facilitate deflection or deformation. The notch or notches may be placed in various locations on the fastening strip. Referring to FIG. 20, the male fastening strip 530 includes a notch 556A located between webs 550, 551. The notch 556A may be used in conjunction with one or more of the other notches 556B, 556C or the notch 556A may be used without the other notches 556B, 556C. The notch 556A will facilitate the deflection of the base to form the deformation. In addition, the fastening strip may include surface alterations 563 and coextruded portions 565. Conversely, notches may be included on the female fastening strip in order to form the deformation on the female fastening strip. Referring to FIG. 21, the female fastening strip 531 includes a notch 556D located between webs 540, 541. The notch 556D may be used in conjunction with one or more of the other notches 556E, 556F or the notch 556D may be used without the other notches. In addition, the fastening strip may include surface alterations 563 and coextruded portions 565.

Furthermore, if a deformation or deformations are desired on both sides of the closure device, notches and or coextruded portions may be included on both the male fastening strip and the female fastening strip. For example, referring to FIG. 22A, the closure device includes the male fastening strip 530 from FIG. 20 and the female fastening strip 531 from FIG. 21 to form deformations 557A, 558B on each side of the closure device. As another example, referring to FIG. 22B, the closure device includes a male fastening strip with coextruded portions 556G and a female fastening strip with coextruded portions 556H to facilitate the formation of the deformations 557G, 557H on each side of the closure device.

Notches in various locations on the male fastening strip and/or the female fastening strip may be used with any of the embodiments described herein as appropriate. For example, referring to FIGS. 23, 24 and 25, the fastening strips 630, 631 include notches 656 on the non-mating sides of the fastening strips.

The notches may have various configurations. For example, the notches may be composed of arcuate and linear segments, such as, notch 56 in FIG. 3. As another example, the notch may be composed of arcuate segments, such as, notch 156 in FIG. 9 or notch 256 in FIG. 13. As a further example, the notch may be a surface alteration, such as, notches 956A, 956B, 1056A, 1056B in FIGS. 38A, 38B, 39A and 39B. For polyethylene the preferred notch depth should be no less than 15% of the base thickness to maintain the integrity of the base. In addition, the notch may be continuous along the length of the fastening strip or the notch may be discontinuous along the length to provide an intermittent deformation effect.

Figure 23A:
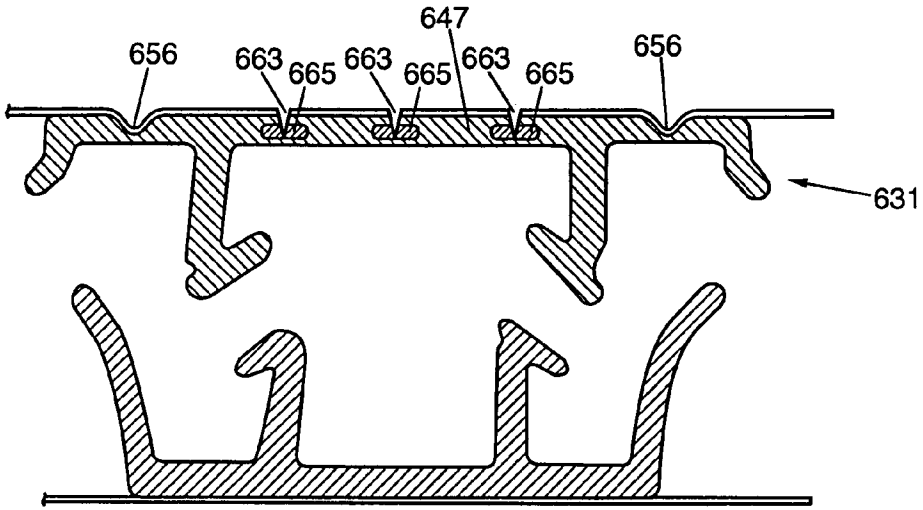
FIG. 23A is a cross-sectional view of another embodiment in the unoccluded position illustrating visual changing portions on the non-mating side of the fastening strip.

FIGS. 23A-25 show fastening strips with surface alterations which are open when the closure device is unoccluded and substantially closed when the closure device is occluded. Referring to FIG. 23A, the base is provided with surface alterations 663 and coextruded portions 665 which are open when the closure device is unoccluded. However, the base could include any other surface alteration embodiment described herein. For example, as shown in FIGS. 23C, 23D and 25A, the base 647A may include an edge glow material and the surface alterations 663A extend through the edge glow material.

Figure 23B:
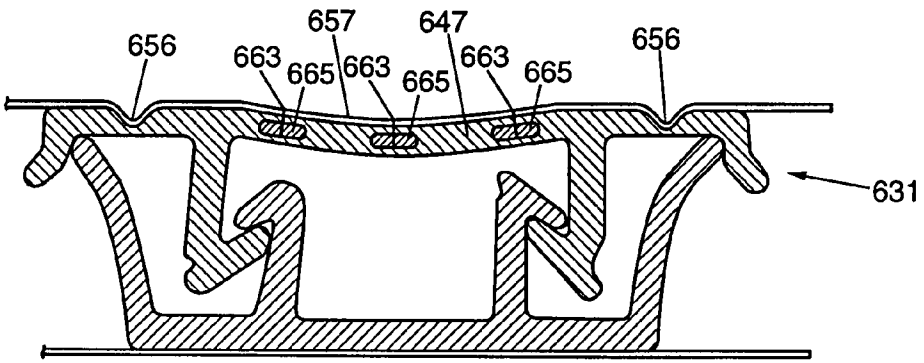
FIG. 23B is a cross-sectional view of the embodiment illustrated in FIG. 23A in the occluded position.
Figure 24:
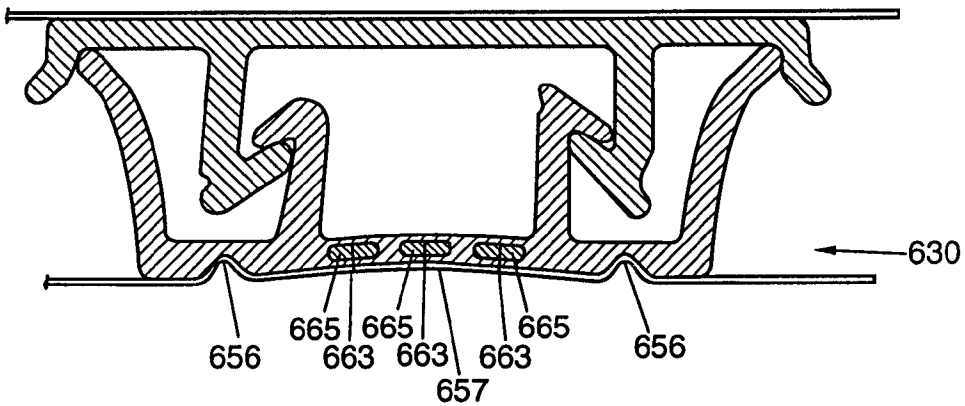
FIG. 24 is a cross sectional view of another embodiment of the present invention which includes visually changing portions and a notch between the webs on the non-mating side of the fastening strip.
Figure 25:
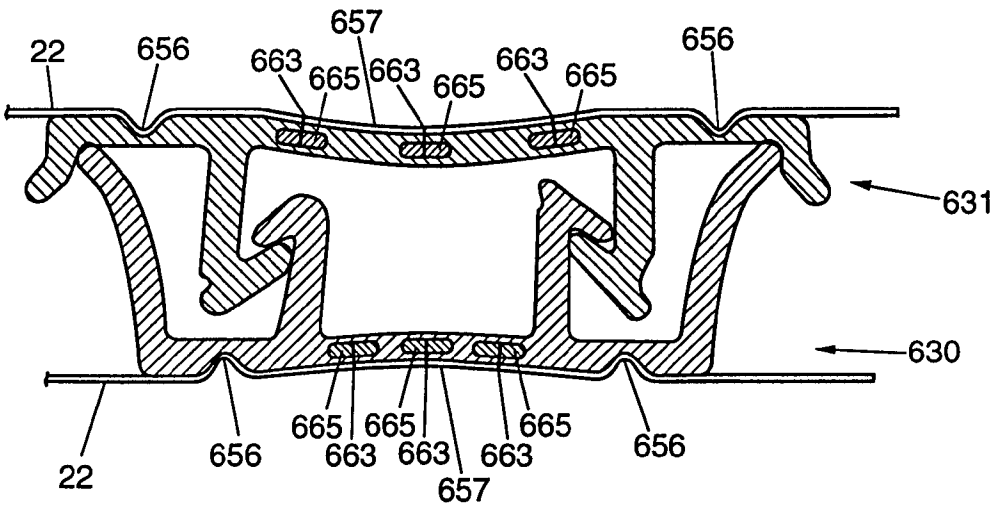
FIG. 25 is a cross-sectional view of another embodiment which includes visually changing portions and notches on the non-mating sides of the fastening strips and a deformation on both fastening strips.

Prior to occlusion, the second color of the extruded portion 665 is visible. As the base deflects inward, the surface alterations 663 close and substantially hide the coextruded portion 665 as shown in FIGS. 23B, 24 and 25. The coextrusion portion is not visible because the first color of the base 647 surrounds the second color. After occlusion, the user is able to determine that occlusion has occurred because the surface alterations 663 will be closed and the second color will not be visible. As shown in FIG. 25, the user is able to determine that occlusion has occurred from either side because the surface alteration 663 will be closed on both fastening strips.

Figure 23C:
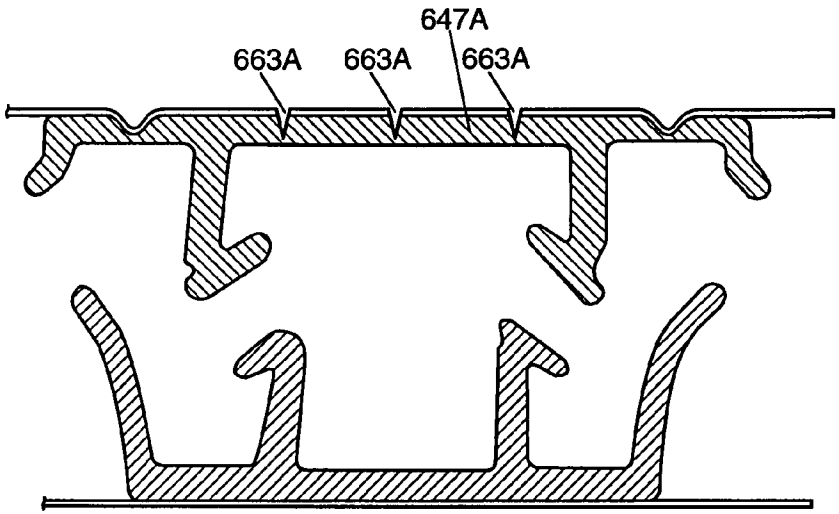
FIG. 23C is a cross-sectional view of another embodiment of the closure device in FIG. 23A in the unoccluded position.
Figure 23D:
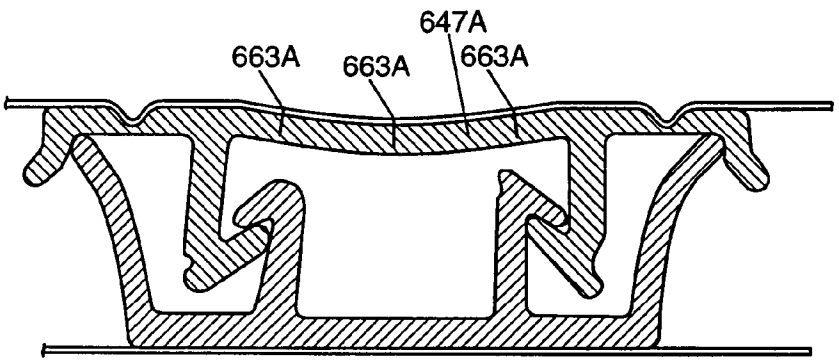
FIG. 23D is a cross-sectional view of the closure device in FIG. 23C in the occluded position.
Figure 25A:
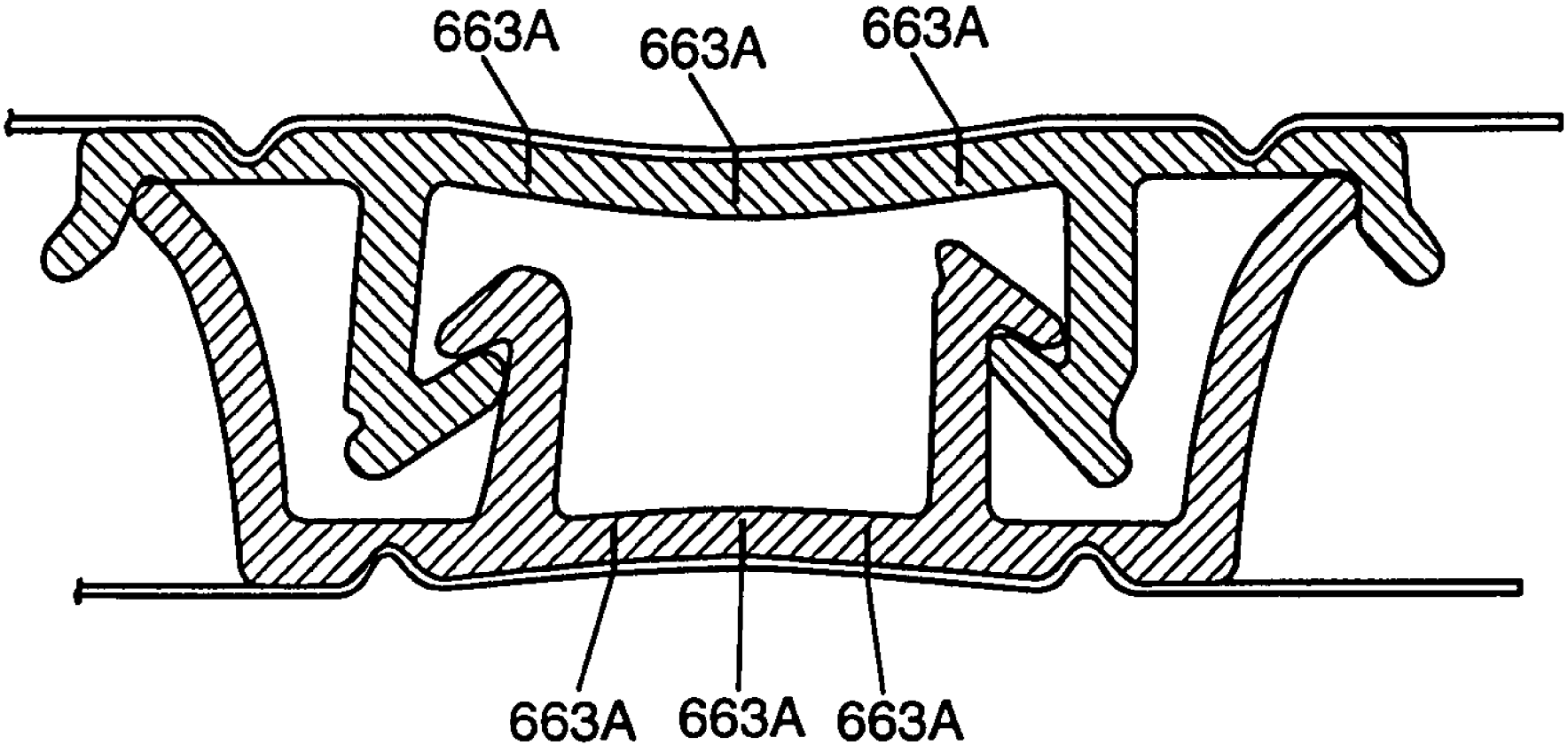
FIG. 25A is a cross-sectional view of another embodiment of the closure device in FIG. 25 in the occluded position.

With respect to the edge glow embodiments shown in FIGS. 23C, 23D and 25A, the occlusion occurs in a similar fashion. Prior to occlusion, the edge glow effect is visible. As the base deflects inward, the surface alterations 663A close and substantially hide the edge glow effect as shown in FIG. 23D. The edge glow effect is not visible because the surface alteration 663A is closed. After occlusion, the user is able to determine that occlusion has occurred because the surface alterations 663A will be closed and the edge glow effect will not be visible. As shown in FIG. 25A, the user is able to determine that occlusion has occurred from either side because the surface alterations 663A will be closed on both fastening strips.

Figure 26:
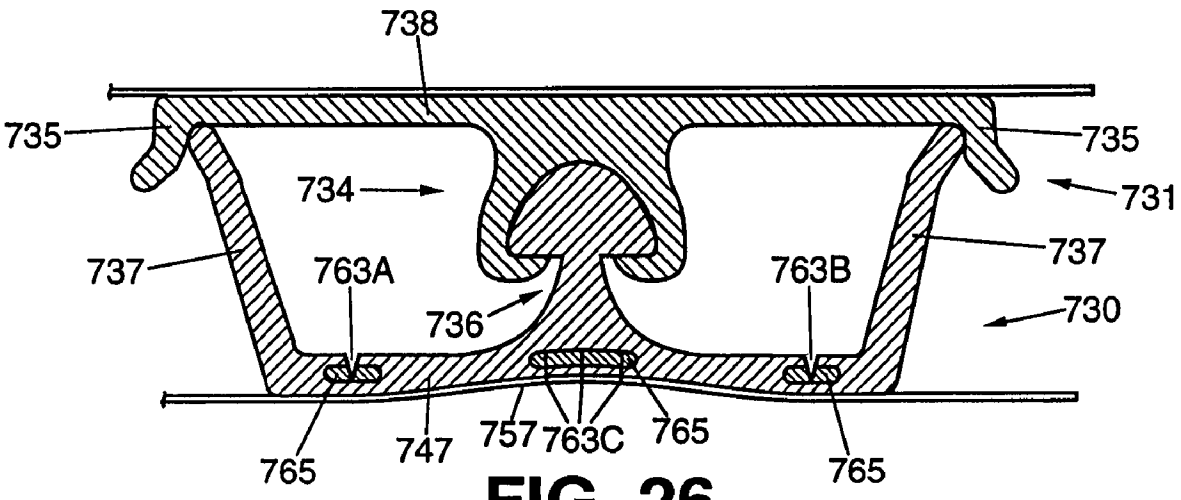
FIG. 26 is a cross-sectional view of another embodiment which includes visually changing portions and another type of closure element.
Figure 28C:
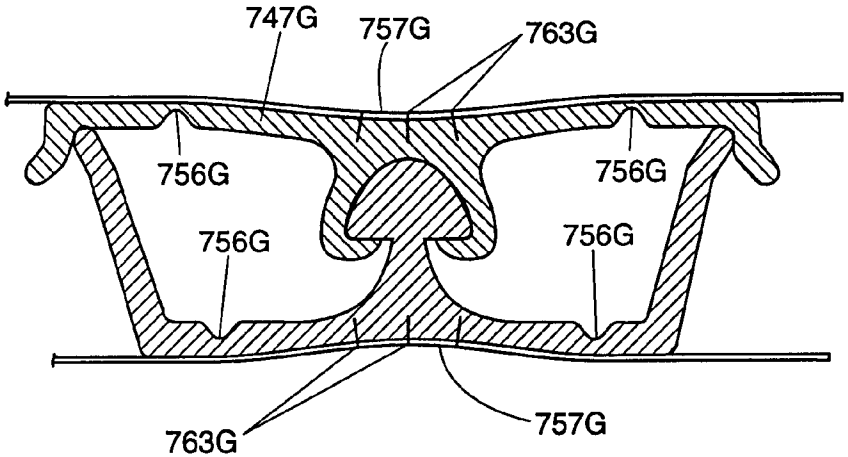
FIG. 28C is a cross-sectional view of another embodiment of the closure device in the occluded position.
Figure 28D:
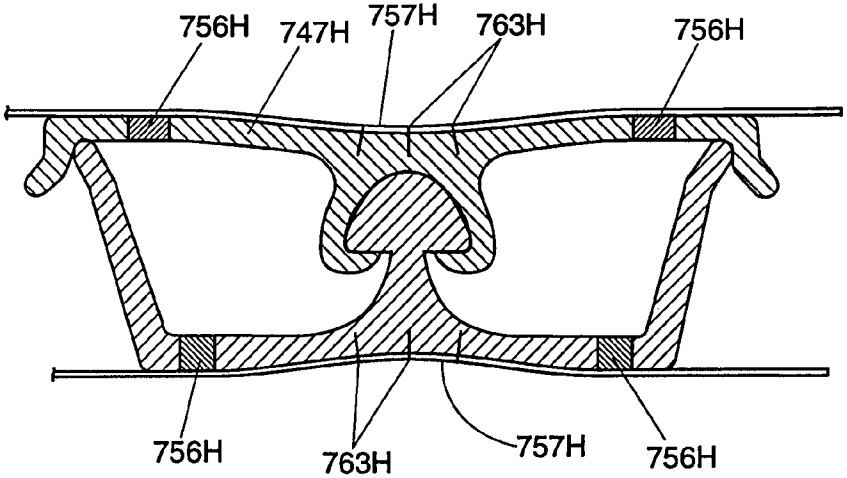
FIG. 28D is a cross-sectional view of another embodiment of the closure device in the occluded position.

In another embodiment, the closure device may include other types of closure elements. Referring to FIG. 26, a male fastening strip 730 includes a male closure element 736 and a female fastening strip 731 includes a female closure element 734. The closure elements 734, 736 are known and described in U.S. Pat. No. 3,198,228 (which was reissued as Re. 28,969), U.S. Pat. Nos. 4,736,496, 5,140,727 and 5,363,540 which are incorporated herein by reference. These closure elements 734, 736 are sometimes referred to as "arrowhead" closure elements. The remaining components of the fastening strips 730, 731, such as, the wings 735, 737, the bases 738, 747 and the notches 756, are similar to the similarly numbered components 35, 37, 38, 47, 56 in FIGS. 2 and 3. When the fastening strips 730, 731 are occluded, a deformation 757 is formed along the fastening strip 730. The base 747 is provided with surface alterations 763A-763C and coextruded portions 765. The surface alterations 763A, 763B on the mating side of the base are closed when the closure device is unoccluded and open when the closure device is occluded similar to surface alteration 63 and coextruded portion 65 in FIG. 3. Conversely, the surface alterations 763C on the non-mating side of the base are open when the closure device is unoccluded and closed when the closure device is occluded similar to surface alterations 663 and coextruded portions 665 in FIGS. 23-25. However, the base could include any other surface alteration embodiment described herein. For example, as shown in FIGS. 28C and 28D, the base 747G, 747H may include an edge glow material and the surface alterations 763G, 763H extend through the edge glow material.

During occlusion, the user applies compression forces to the fastening strips as noted above. As the user occludes the fastening strips, the male wings 737 engage the female wings 735 as shown in FIG. 26. In order to hold the fastening strips in an occluded position, the female closure element 734 engages the male closure element 736. During this process, the base of the male fastening strip deflects inward and forms an inward deformation 757. The deformation is retained because the male wings 737 are more rigid than the base and because the male wings 737 are prevented from further outward movement by the female wings 735. In addition, the force exerted by the deflected base is less than the force required to disengage the closure elements. The notches 756 facilitate the deflection of the base.

As the base deflects inward, the surface alterations 763A, 763B open and expose the coextruded portions 765 as shown in FIG. 26. The mating fastening strip 731 is translucent or transparent. Thus, the second color of the coextruded portion 765 is visible to the user through the mating fastening strip 731. Prior to occlusion, the second color of the coextruded portion 765 is not visible because the first color of the base 747 surrounds the second color. After occlusion, the user is able to determine that occlusion has occurred because the surface alterations 763A, 763B will be open and the second color will be visible.

With respect to the surface alterations 763C, the second color of the extruded portion 765 is visible prior to occlusion. As the base deflects inward, the surface alterations 763C close and substantially hide the coextruded portion 765 as shown in FIG. 26. The coextrusion portion 765 is not visible because the first color of the base 747 surrounds the second color. After occlusion, the user is able to determine that occlusion has occurred because the surface alterations 763C will be closed and the second color will not be visible. As shown in FIG. 28, the user is able to determine that occlusion has occurred from either side because the surface alterations on the non-mating sides will be closed on both fastening strips.

Figure 27:
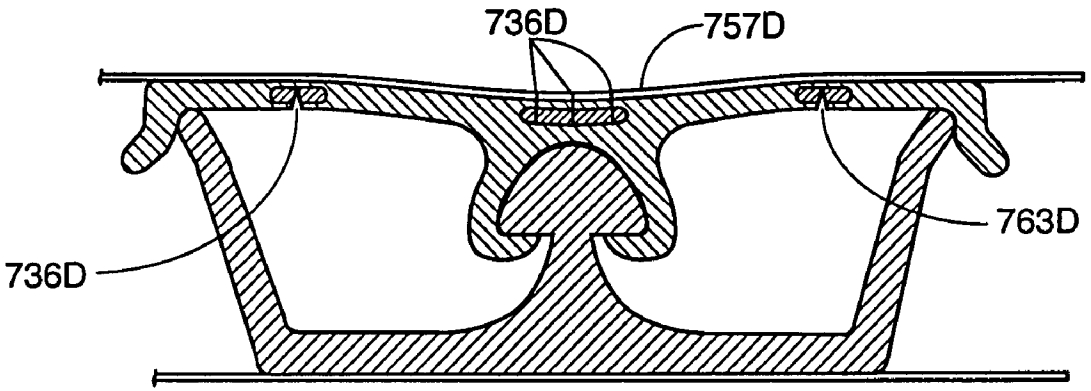
FIG. 27 is a cross-sectional view of another embodiment which includes the closure element in FIG. 26.

FIGS. 27-31 illustrate other embodiments of the invention using the arrowhead closure elements 734, 736 and having different locations for the deformations, surface alterations and notches. For example, FIG. 27 shows the surface alterations 763D and deformation 757D on the female fastening strip. FIG. 28A shows the notches 756E, the surface alterations 763E, the coextruded portions 765E and deformations 757E on both the fastening strips. FIG. 28B shows coextruded portions 756F, the deformations 757F, the surface alterations 763F and the coextruded portions 765F on both the fastening strips.

Figure 29:
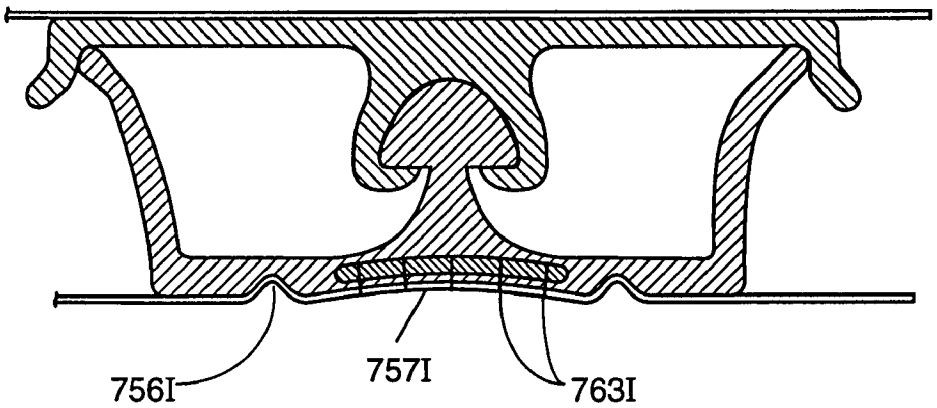
FIG. 29 is a cross-sectional view of another embodiment with visually changing portions and a deformation in one of the fastening strips.
Figure 30:
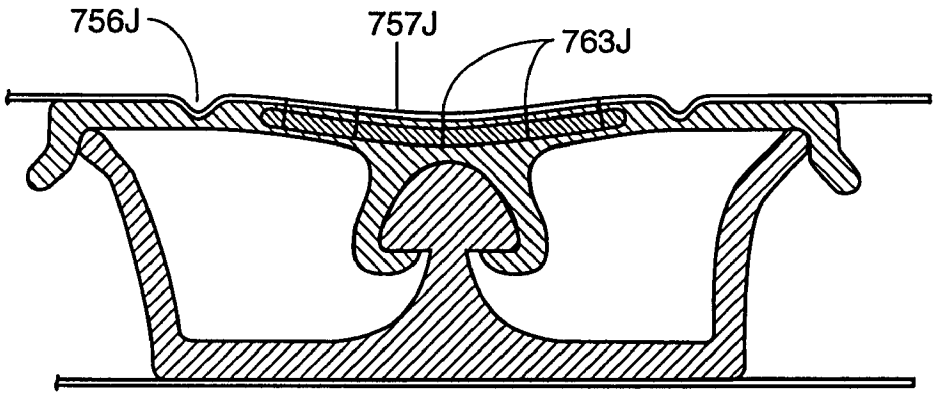
FIG. 30 is a cross-sectional view of another embodiment with visually changing portions and a deformation in one of the fastening strips.
Figure 31:
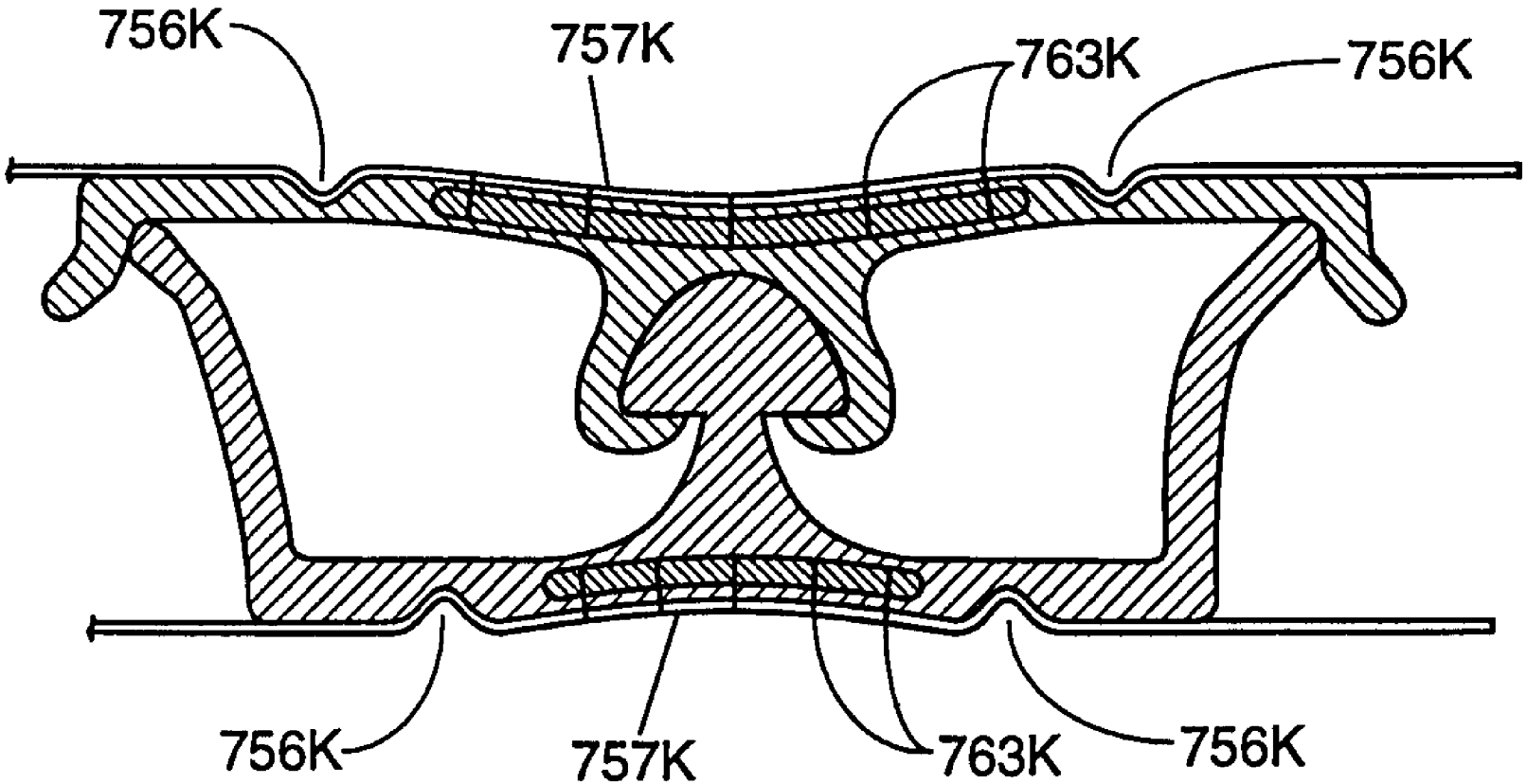
FIG. 31 is a cross-sectional view of another embodiment with visually changing portions and a deformation in both of the fastening strips.

FIG. 28C shows the edge glow embodiment wherein the base 747G includes an edge glow material and the surface alterations 763G extend through the edge glow material. The base 747G also includes notches 756G and the base forms deformations 757G. When the closure device is unoccluded, the surface alterations 763G are open and the edge glow effect will be visible on both sides of the closure device. FIG. 28D shows another edge glow embodiment with an edge glow base 747H, coextruded portions 756H and surface alterations 763H. When the closure device is unoccluded, the deformations 757H are created, the surface alterations 763H are opened and the edge glow effect will be visible on both sides of the closure device. FIGS. 29 and 30 show the surface alterations 763I, 763J and notches 756I, 756J on the non-mating side and the deformation 757I, 757J on only one of the fastening strips. FIG. 31 shows the surface alterations 763K and notches 756K on the non-mating sides and deformations 757K on both of the fastening strips.

Figure 32:
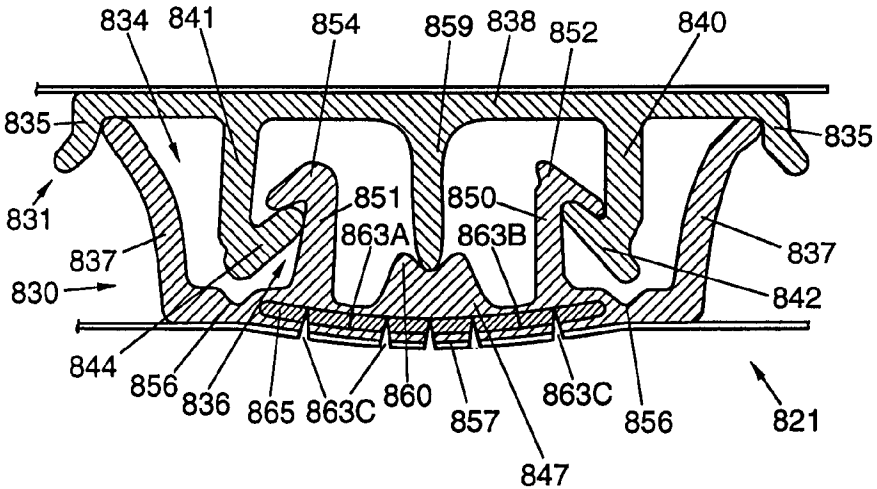
FIG. 32 is a cross-sectional view of another embodiment with visually changing portions and an outward deformation in one of the fastening strips.

Referring to FIGS. 32-37, the closure device may also form an outward deformation when occluded. As shown in FIG. 32, the closure device 821 includes male and female fastening strips 830, 831 similar to fastening strips 230, 231 in FIG. 13. The female fastening strip 831 includes a female closure element 834 and a pair of wings 835 similar to female closure element 231 and wings 235 in FIG. 13. The male fastening strip 830 includes a male closure element 836 and a pair of wings 837 similar to male closure element 236 and wings 237 in FIG. 13. The female closure element 834 includes a base portion 838 and webs 840, 841 similar to base portion 238 and webs 240, 241 in FIG. 13. The webs 840, 841 include hook portions 842, 844 similar to hook portions 242, 244 in FIG. 13. The male closure element 836 includes a base portion 847 and webs 850, 851 similar to base portion 247 and webs 250, 251 in FIG. 13. The webs 850, 851 include hook portions 852, 854 similar to hook portions 252, 254 in FIG. 13. The base portion 847 may be provided with notches 856 which are similar to notches 256 in FIG. 13.

Figure 34C:
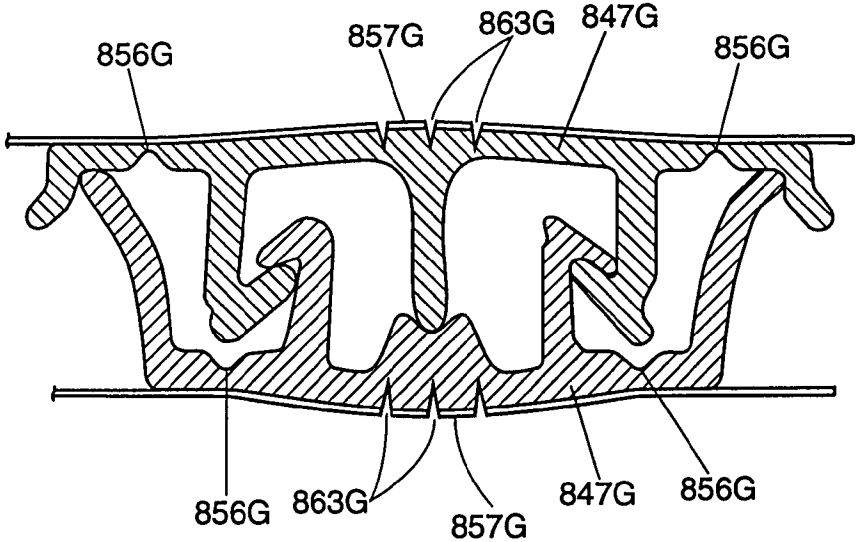
FIG. 34C is a cross-sectional view of another embodiment of the closure device in the occluded position.
Figure 34D:
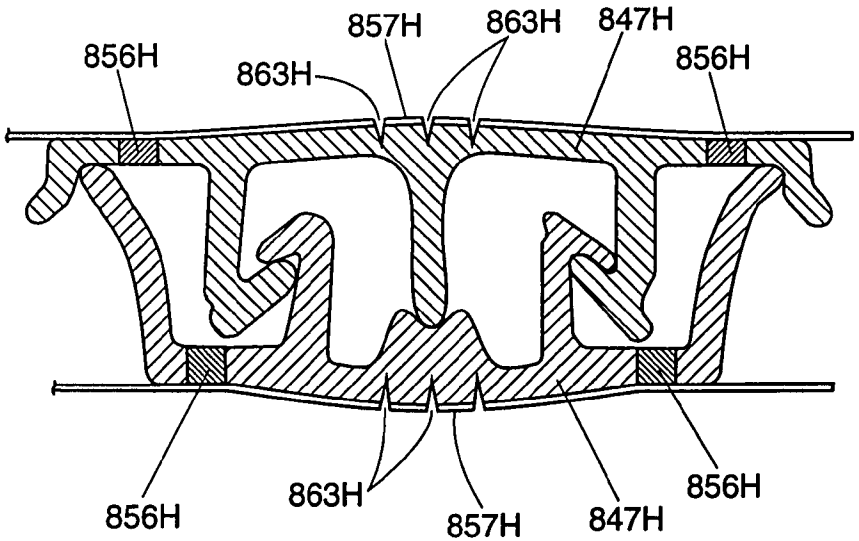
FIG. 34D is a cross-sectional view of another embodiment of the closure device in the occluded position.

The base 847 is provided with surface alterations 863A-863C and coextruded portions 865. The surface alterations 863A, 863B on the mating side of the base are open when the closure device is unoccluded and closed when the closure device is occluded similar to surface alterations 663 and coextruded portions 665 in FIGS. 23A-25. Conversely, the surface alterations 863C on the non-mating side of the base are closed when the closure device is unoccluded and open when the closure device is occluded similar to surface alterations 63 and coextruded portion 65 in FIG. 3. However, the base could include any other surface alterations embodiment described herein. For example, as shown in FIGS. 34C and 34D, the base 847G, 847H may include a fluorescent material and the surface alterations 863G, 863H extend through the fluorescent material.

A spacing member 859 provides a predetermined spacing between the fastening strips and also a predetermined tension among the closure elements. Referring to FIG. 32, the base 838 includes a spacing member 859 and the base 847 includes an engagement surface 860 for the spacing member. The spacing member 859 extends from the base a predetermined distance and is located between the webs 840, 841. The engagement surface 860 is located between the webs 850, 851 and includes a groove which engages the spacing member 859.

Referring to FIG. 32, as the user applies forces to the fastening strips, the spacing member 859 contacts the engagement surface 860. In order to hold the fastening strips in an occluded position, the female hooks 842, 844 must engage the male hooks 852, 854. As the user continues to apply the forces, the female webs 840, 841 deflect outwardly and the male webs 850, 851 deflect inwardly in order to allow the female hooks 842, 844 and the male hooks 852, 854 to pass each other. In addition, the hooks may also deflect during this process.

As the user continues to apply the forces, the female hooks 842, 844 engage the male hooks 852, 854 as shown in FIG. 32. During the process, the base of the male fastening strip deflects outward and forms an outward deformation 857. During the process, the spacing member 859 may also deflect. The spacing member performs several functions. The spacing member 859 maintains a predetermined distance between the fastening strips. The spacing member 859 also maintains a predetermined height for the deformation 857. The spacing member 859 also maintains tension between the female hooks 842, 844 and the male hooks 852, 854.

The deformation 857 is retained because the male wings 837 are more rigid than the base and because the male wings 837 are prevented from further outward movement by the wings 835. In addition, the forces exerted by the deflected base and the deflected spacing member 859 are less than the force required to disengage the hooks. In order to facilitate the deflection of the base, the fastening strip may include notches 856.

As the base deflects outward, the surface alterations 863A, 863B close and substantially hide the coextruded portion 865 as shown in FIG. 32. The mating fastening strip 831 is translucent or transparent. Thus, the second color of the coextruded portion 865 is visible to the user through the mating fastening strip 831. After occlusion, the second color of the coextruded portion is not visible because the first color of the base 847 surrounds the second color. The user is able to determine that occlusion has occurred because the surface alterations 863A, 863B will be closed and the second color will not be visible.

Figure 37:
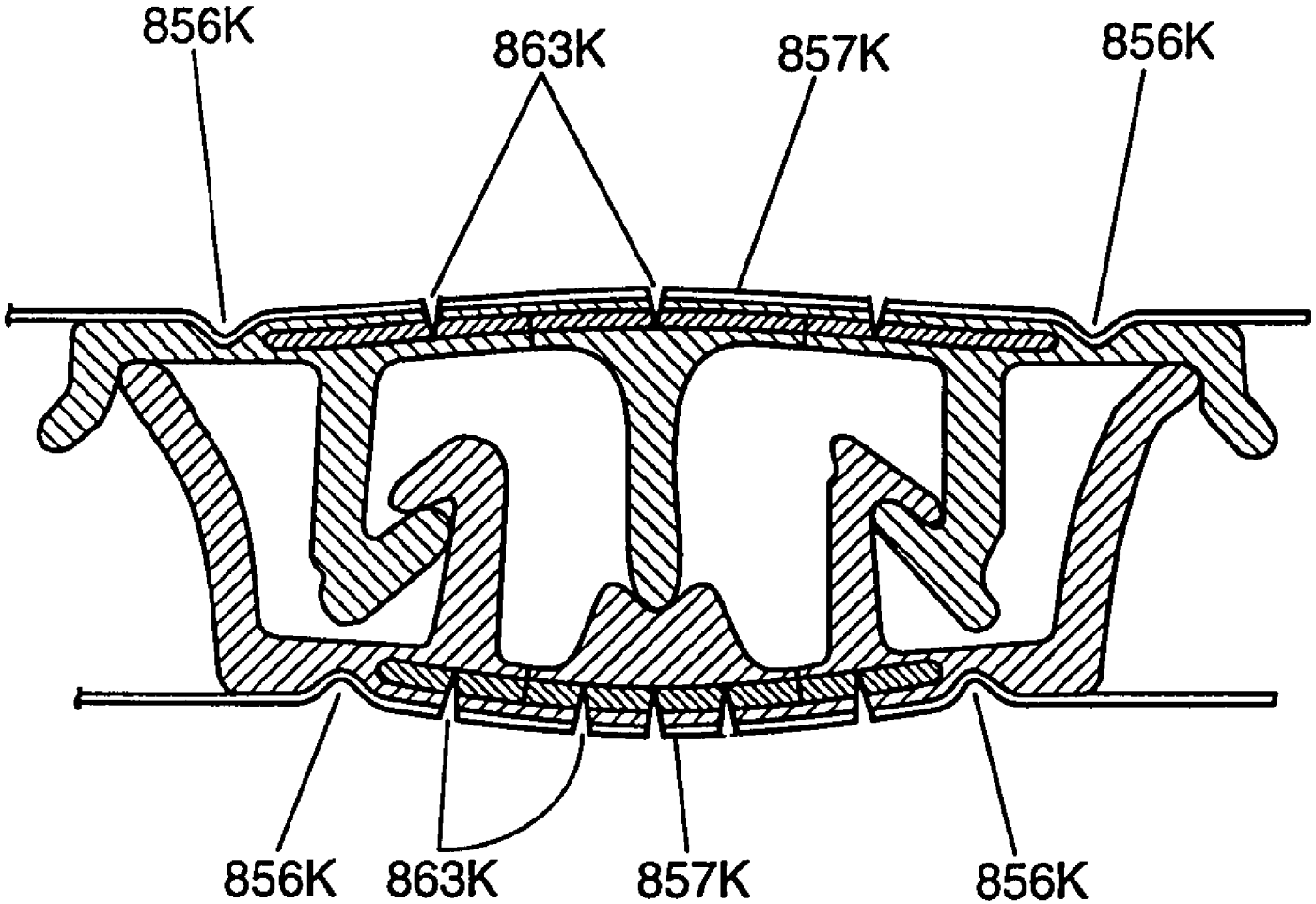
FIG. 37 is a cross-sectional view of another embodiment with visually changing portions and an outward deformation in both of the fastening strips.

With respect to the surface alterations 863C, the second color of the extruded portion 865 is not visible prior to occlusion. As the base deflects outward, the surface alterations 863C open and expose the coextruded portion 865 as shown in FIG. 32. Prior to occlusion, the coextrusion portion 865 is not visible because the first color of the base 847 surrounds the second color. After occlusion, the user is able to determine that occlusion has occurred because the surface alterations 863C will be open and the second color will be visible. As shown in FIGS. 34A, 34B and 37, the user is able to determine that occlusion has occurred from either side because the surface alterations will be open on both fastening strips.

The spacing member 859 and the engagement surface 860 may also include color to provide the user with a visual indication that occlusion has occurred as noted above. In addition, the spacing member may be used with any of the embodiments in this application where appropriate.

Figure 33:
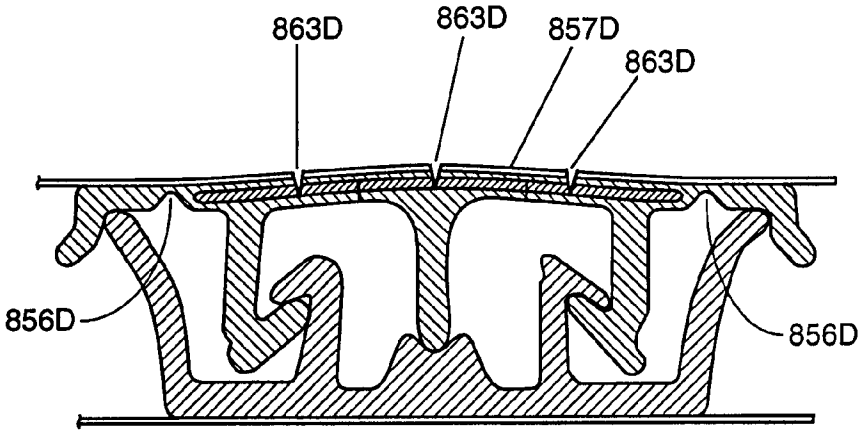
FIG. 33 is a cross-sectional view of another embodiment with visually changing portions and an outward deformation in one of the fastening strips.

FIGS. 33-37 illustrate other embodiments of the invention using the spacing member 859 and having different locations for the deformations, surface alterations and notches. For example, FIG. 33 shows the notches 856D, surface alterations 863D and outward deformation 857D on the female fastening strip. FIG. 34A shows the notches 856E, the surface alterations 863E, outward deformations 857E and the coextruded portions 865E on both the fastening strips. FIG. 34B shows the coextruded portions 856F, the outward deformations 857F and the coextruded portions 865F on both the fastening strips.

Figure 36:
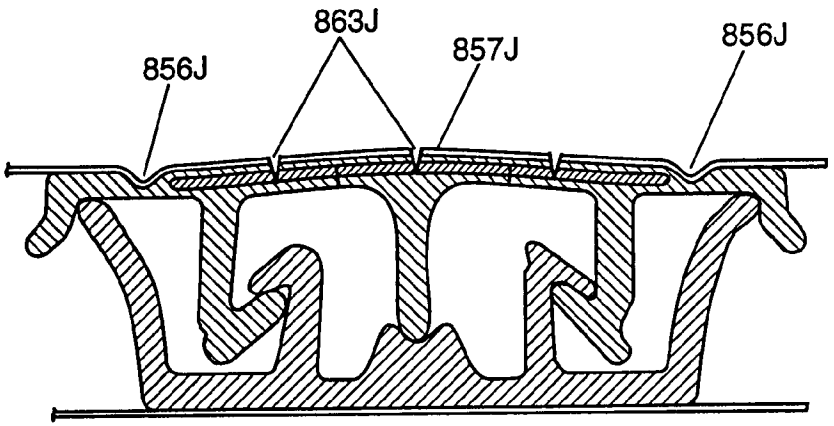
FIG. 36 is a cross-sectional view of another embodiment with visually changing portions and an outward deformation in one of the fastening strips.
Figure 35:
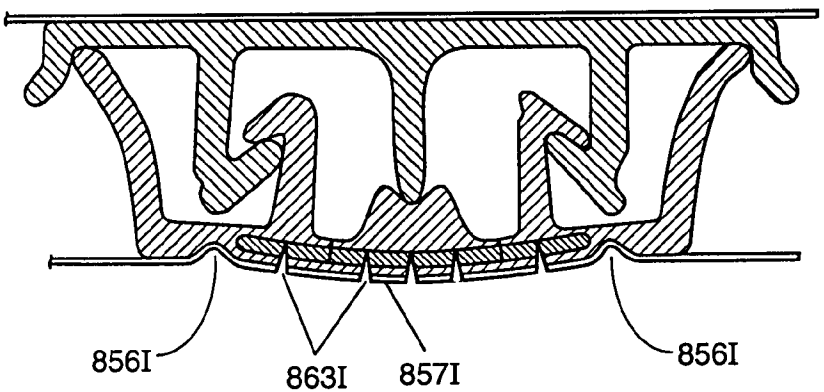
FIG. 35 is a cross-sectional view of another embodiment with visually changing portions and an outward deformation in one of the fastening strips.

FIG. 34C shows the edge glow embodiment wherein the base 847G includes an edge glow material and the surface alterations 863G extend through the edge glow material. The base 847G also includes notches 856G and the base forms deformations 857G. When the closure device is occluded, the surface alterations 863G are open and the edge glow effect will be visible on both sides of the closure device. FIG. 34D shows another edge glow embodiment with an edge glow base 847H, coextruded portions 856H and surface alterations 863H. When the closure device is occluded, the deformations 857H are created, the surface alterations 863H are opened and the edge glow effect will be visible on both sides of the closure device. FIGS. 35 and 36 show the notches 856I, 856J on the non-mating side and the deformation 857I, 857J and the surface alterations 863I, 863J on only one of the fastening strips. FIG. 37 shows the notches 856K on the non-mating sides, and the deformations 857K and the surface alterations 863K on both of the fastening strips. In addition, the closure device may include other closure elements, such as, the arrowhead closure elements, and form an outward deformation when occluded.

Figure 38A:
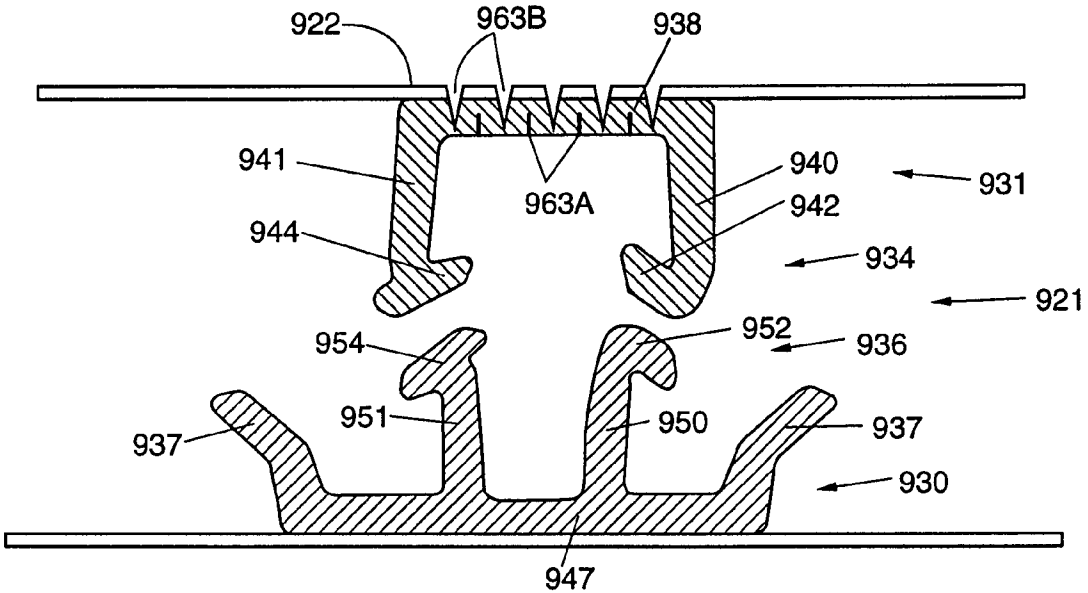
FIG. 38A is a cross-sectional view of another embodiment of the closure device in the unoccluded position.
Figure 38B:
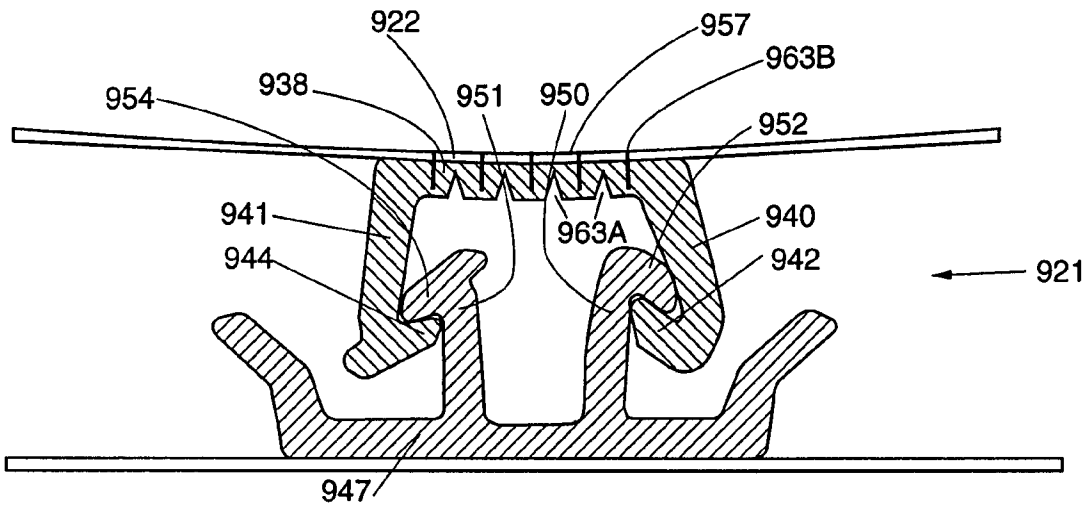
FIG. 38B is a cross-sectional view of the closure device in FIG. 38A in the occluded position with an inward deformation on one of the fastening strips.

FIGS. 38A and 38B illustrate another embodiment of a closure device which has an inward deformation when occluded. The closure device 921 includes a male fastening strip 930 and a female fastening strip 931. The female fastening strip 931 includes a female closure element 934. The female closure element 934 includes a base portion 938 and a pair of webs 940, 941 extending from the base portion 938. The webs 940, 941 include hook portions 942, 944 extending from the webs. The base 938 may also include surface alterations 963A on the mating side and surface alterations 963B on the non-mating side.

The male fastening strip 930 includes a male closure element 936. The male closure element 936 includes a base portion 947 and a pair of webs 950, 951 extending from the base portion 947. The webs 950, 951 include hook portions 952, 954 extending from the webs. The male fastening strip 930 may also include wings 937 to guide the webs of the female closure element.

In this embodiment, a portion of the side wall for the bag is used to provide the visual changing effect. Specifically, the portion 922 of the side wall 22 which contacts the fastening strip 931 is a first color. In this embodiment the first color is opaque. The base portion 938 has a second color and the first-color substantially hides the second color. The surface alterations 963B on the non-mating side extend through the side wall portion 922 and into the base portion 938. In this embodiment, the surface alterations 963B are substantially closed to hide the second color of the base portion 1047 when the fastening strips are occluded and open to expose the second color when the fastening strips are unoccluded. The combination of the first color for the side wall portion and the second color for the base achieves the visual change without the need for the coextruded portion. In another embodiment, the base could include edge an glow material and the first color of the side wall portion would not need to be opaque and could be transparent.

FIG. 38B illustrates the closure device 921 in the occluded position with an inward deformation. As the user applies forces to the fastening strips, the webs 940, 941 deflect outwardly in order to allow the hooks to pass each other. In addition, the hooks may also deflect during this process. As the user continues to apply the forces, the hooks engage as shown in FIG. 38B. During this process, the base 938 deflects inward and forms an inward deformation 957.

The deformation 957 is retained because the webs 940, 941, 950, 951 are more rigid than the base 938. Specifically, the distance between the hooks 952, 954 is greater than the distance between the webs 940, 941 when the fastening strip 931 is in the unoccluded position. The webs 940, 941 are urged away from each other in order to fit over the hooks 952, 954. The webs are rigid in comparison to the base 938 and thus the webs 940, 941 are permitted to be urged away from each other. In this embodiment, the base is less rigid due to the notches 956A, 956B. The notches allow the base to flex inward to form the deformation. Specifically, the notches 956A open to permit the mating surface of the base to increase and the notches 956B close to permit the non-mating surface of the base to decrease. The forces exerted by the deflected base are less than the force required to disengage the hooks.

As the base deflects inward, the surface alterations 963B close and hide the base portion 938 as shown in FIG. 38B. Prior to occlusion, the second color of the base portion 938 is visible. After occlusion, the user is able to determine that occlusion has occurred because the surface alterations 963B will be closed and the second color will not be visible.

In another embodiment, the base 938 includes an edge glow material. Prior to occlusion, the surface alterations 963B are open and the edge glow effect is visible as shown in FIG. 38A. As the base deflects inward, the surface alterations 963B close and substantially hide the edge glow effect as shown in FIG. 38B. The edge glow effect is not visible because the surface alteration 963B is closed. After occlusion, the user is able to determine that occlusion has occurred because the surface alterations 963B will be closed and the edge glow effect will not be visible.

In addition, as the base 938 deflects inward, the surface alterations 963A open and expose the edge glow effect as shown in FIG. 38B. The mating fastening strip is translucent or transparent. Thus, the edge glow effect is visible to the user through the mating fastening strip. Prior to occlusion, the edge glow effect is not visible because the surface alteration 963A is closed as shown in FIG. 38A. After occlusion, the user is able to determine that occlusion has occurred because the surface alteration 963A will be open and the edge glow effect will be visible.

Figure 39A:
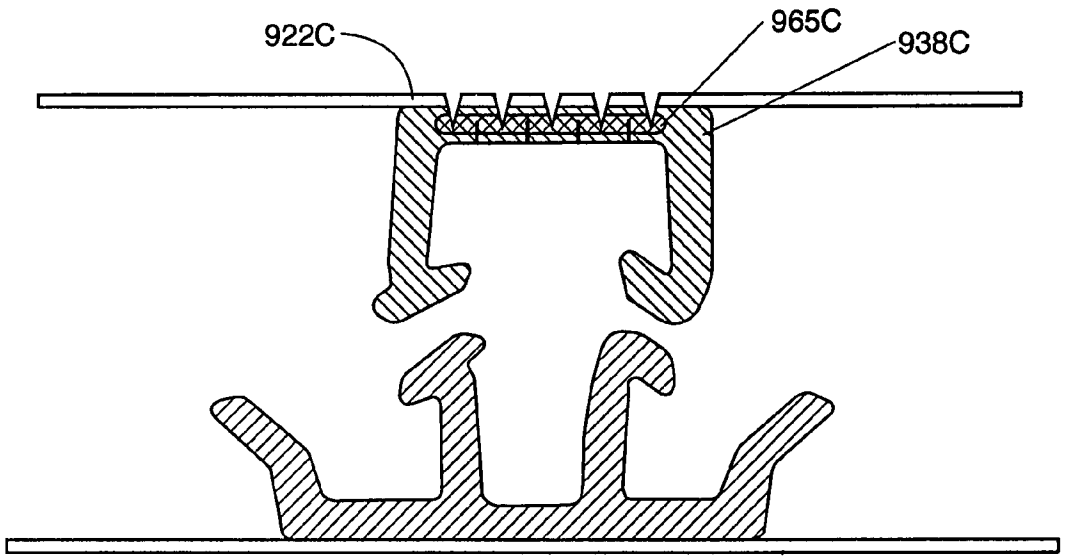
FIG. 39A is a cross-sectional view of another embodiment of the closure device in the unoccluded position.
Figure 39B:
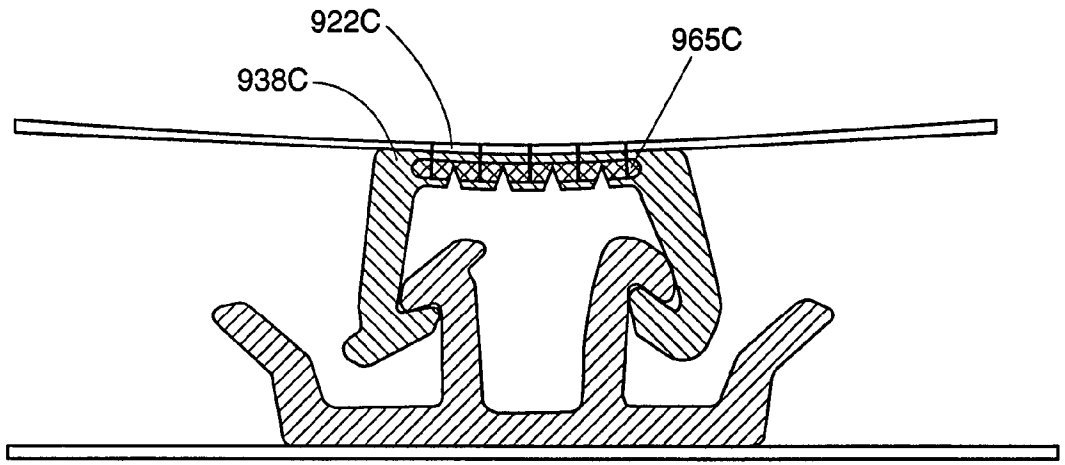
FIG. 39B is a cross-sectional view of the closure device in FIG. 39A in the occluded position with an inward deformation on one of the fastening strips.

FIGS. 39A and 39B illustrate another embodiment of a closure device which is similar to the embodiment in FIGS. 38A and 38B. However, the closure device in FIGS. 39A and 39B includes a coextruded portion 965C. The coextruded portion 965C can provide a third color. In another embodiment, the combination of a coextruded portion with a third color and a base 938C with a second color, would allow the first color to be eliminated from the sidewall 922C. In a third embodiment, the combination of a coextruded portion with a third color and a sidewall with a first color, would allow the second color to be eliminated from the base. In addition, in a fourth embodiment, the first, second and/or third color could be a fluorescent material.

Figure 40A:
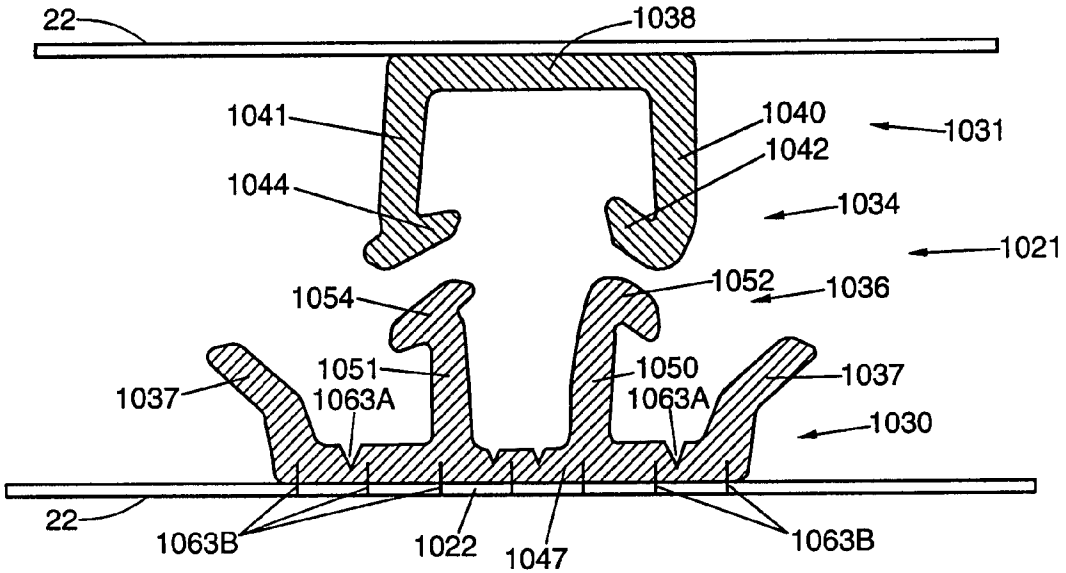
FIG. 40A is a cross-sectional view of another embodiment of the closure device in the unoccluded position with visually changing portions.
Figure 40B:
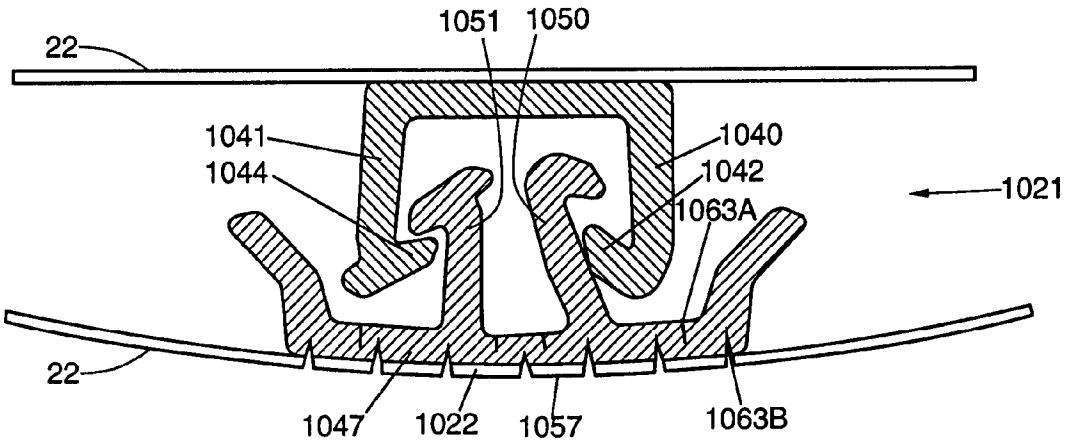
FIG. 40B is a cross-sectional view of the closure device in FIG. 40A in the occluded position with visually changing portions and an outward deformation on one of the fastening strips.

FIGS. 40A and 40B illustrate another embodiment of a closure device which has an outward deformation when occluded. The closure device 1021 includes a male fastening strip 1030 and a female fastening strip 1031. The female fastening strip 1031 includes a female closure element 1034. The female closure element 1034 includes a base portion 1038 and a pair of webs 1040, 1041 extending from the base portion 1038. The webs 1040, 1041 include hook portions 1042, 1044 extending from the webs.

The male fastening strip 1030 includes a male closure element 1036. The male closure element 1036 includes a base portion 1047 and a pair of webs 1050, 1051 extending from the base portion 1047. The webs 1050, 1051 include hook portions 1052, 1054 extending from the webs. The male fastening strip 1030 may also include wings 1037 to guide the webs of the female closure element. The base 1047 may also include surface alterations 1063A on the mating side and surface alteration 1063B on the non-mating side.

In this embodiment, a portion of the side wall for the bag is used to provide the visual changing effect. Specifically, the portion 1022 of the side wall 22 which contacts the fastening strip 1030 is a first color. In this embodiment the first color is opaque. The base portion 1047 has a second color and the first color substantially hides the second color. The surface alterations 1063B on the non-mating side extend through the side wall portion 1022 and into the base portion 1047. In this embodiment, the surface alterations 1063B are substantially closed to hide the second color of the base portion 1047 when the fastening strips are unoccluded and open to expose the second color when the fastening strips are occluded. The combination of the first color for the side wall portion and the second color for the base achieves the visual change without the need for the coextruded portion. In another embodiment, the base could include an edge glow material and the first color of the side wall portion would not need to be opaque and could be transparent.

FIG. 40B illustrates the closure device 1021 in the occluded position with an outward deformation. As the user applies forces to the fastening strips, the male webs 1050, 1051 deflect inwardly in order to allow the hooks to pass each other. In addition, the hooks may also deflect during this process. As the user continues to apply the forces, the hooks engage as shown in FIG. 40B. During this process, the base 1047 deflects outward and forms an outward deformation 1057.

The deformation 1057 is retained because the webs 1040, 1041, 1050, 1051 are more rigid than the base 1047. Specifically, the distance between the hooks 1042, 1044 is less than the distance between the webs 1050, 1051 when the fastening strip 1030 is in the unoccluded position. The webs 1050, 1051 are urged closer to each other in order to fit between the hooks 1042, 1044. The webs are rigid in comparison to the base 1047 and thus the webs 1050, 1051 are permitted to be urged closer to each other. In this embodiment, the base is less rigid due to the notches 1056A, 1056B. The notches allow the base to flex outward to form the deformation. Specifically, the notches 1056B open to permit the non-mating surface of the base to increase and the notches 1056A close to permit the mating surface of the base to decrease. The forces exerted by the deflected base are less than the force required to disengage the hooks.

As the base deflects outward, the surface alterations 1063B open and expose the base portion 1047 as shown in FIG. 40B. Prior to occlusion, the second color of the base portion 1047 is not visible because the first color of the sidewall portion 1022 hides the second color. After occlusion, the user is able to determine that occlusion has occurred because the surface alterations 1063B will be open and the second color will be visible.

In another embodiment, the base 1047 includes an edge glow material. Prior to occlusion, the surface alterations 1063B are closed and the edge glow effect is not visible as shown in FIG. 40A. As the base deflects outward, the surface alterations 1063B open and expose the edge glow effect as shown in FIG. 40B. The edge glow effect is visible because the surface alteration 1063B is open. After occlusion, the user is able to determine that occlusion has occurred because the surface alterations 1063B will be open and the edge glow effect will be visible.

In addition, as the base 1047 deflects outward, the surface alterations 1063A close and hide the edge glow effect as shown in FIG. 40B. The mating fastening strip is translucent or transparent. Thus, the edge glow effect is visible to the user through the mating fastening strip. Prior to occlusion, the edge glow effect is visible because the surface alteration 1063A is open as shown in FIG. 40A. After occlusion, the user is able to determine that occlusion has occurred because the surface alteration 1063A will be closed and the edge glow effect will not be visible.

Figure 41A:
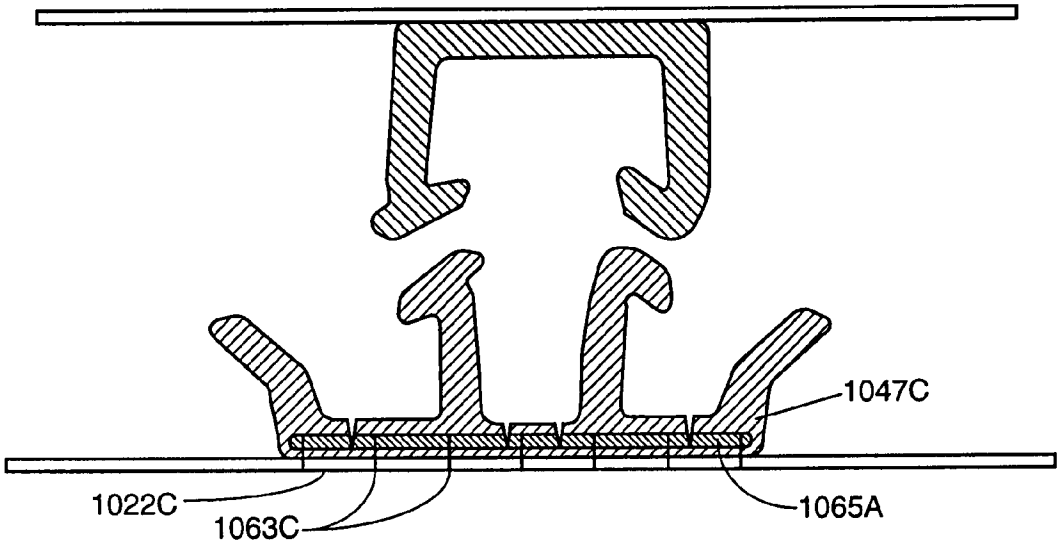
FIG. 41A is a cross-sectional view of another embodiment of the closure device in the unoccluded position with visually changing portions.
Figure 41B:
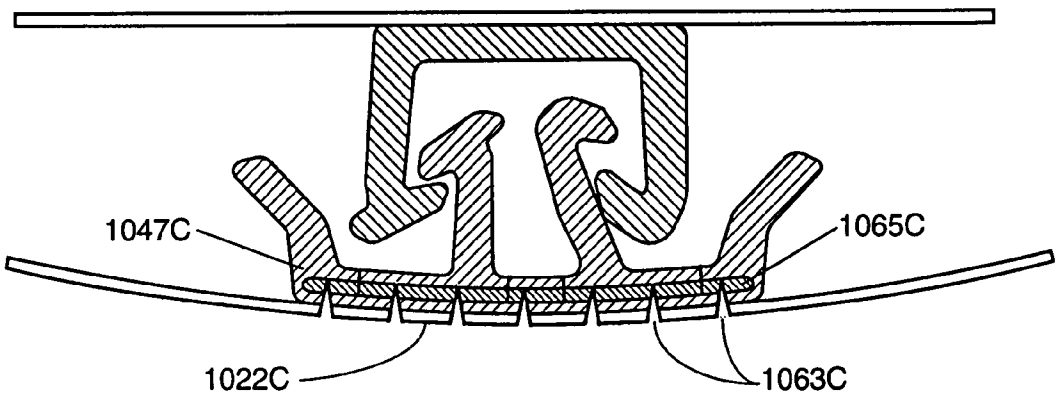
FIG. 41B is a cross-sectional view of the closure device in FIG. 41A in the occluded position with visually changing portions and an outward deformation on one of the fastening strips.

FIGS. 41A and 41B illustrate another embodiment of a closure device which is similar to the embodiment in FIGS. 40A and 40B. However, the closure device in FIGS. 41A and 41B includes a coextruded portion 1065C. The coextruded portion 1065C can provide a third color. In another embodiment, the combination of a coextruded portion with a third color and a base 1047C with a second color, would allow the first color to be eliminated from the sidewall 1022C. In a third embodiment, the combination of a coextruded portion with a third color and a sidewall with a first color, would allow the second color to be eliminated from the base. In addition, in a fourth embodiment, the first, second and/or third color could be a fluorescent material.

Figure 43:
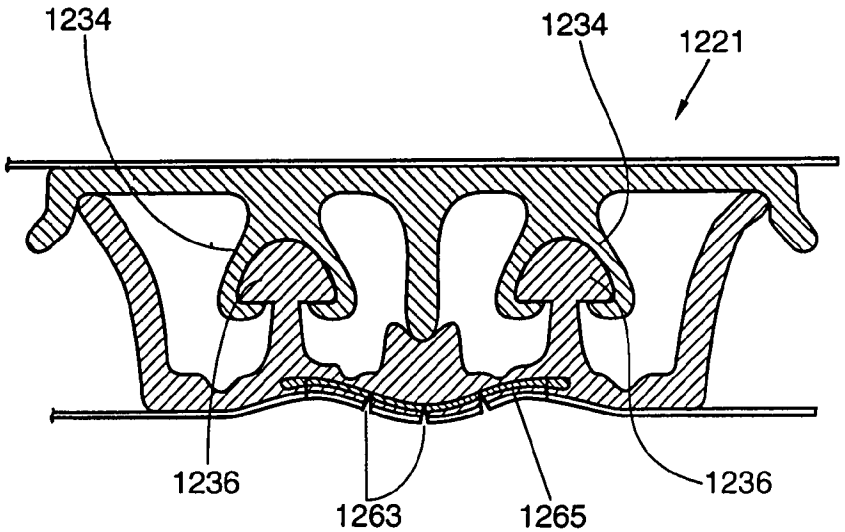
FIG. 43 is a cross-sectional view of another embodiment of the closure device with visual changing portions and multiple deformations in one of the fastening strips.
Figure 42:
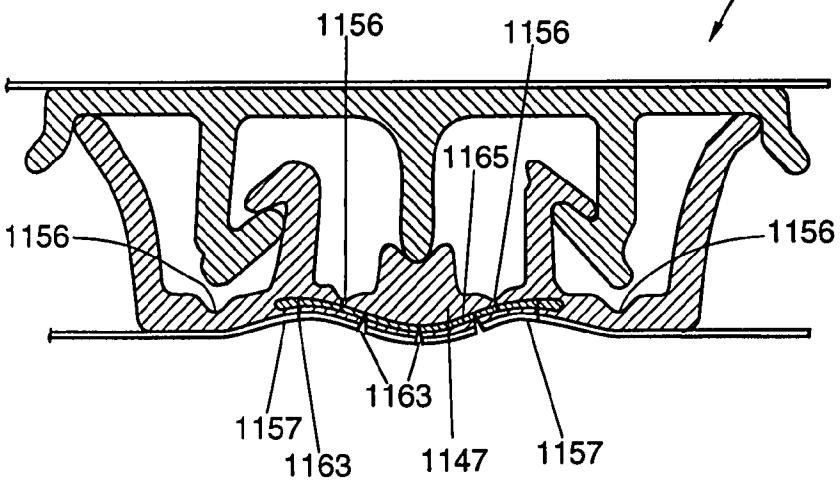
FIG. 42 is a cross-sectional view of another embodiment of the closure device with visually changing portions and multiple deformations in one of the fastening strips.

Referring to FIGS. 42 and 43, a closure device may also include multiple deformations upon occlusion of the closure device. In FIG. 42, the closure device 1121 includes two inward deformations 1157. The closure device 1121 is similar to the closure device in FIG. 16 except the closure device 1121 includes two additional notches 1156 to obtain additional flexibility in the base 1147. In addition, the closure device includes surface alterations 1163 and coextruded portion 1165. In FIG. 43, the closure device is similar to the closure device in FIG. 42 except the closure device 1221 uses two arrowhead closure elements 1234, 1236 versus the hook closure elements. The closure device includes surface alterations 1263 and a coextruded portion 1265.

Figure 43A:
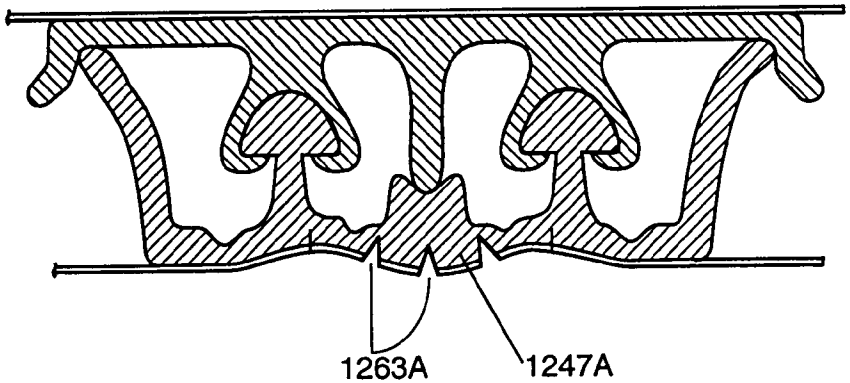
FIG. 43A is a cross-sectional view of another embodiment of the closure device in the occluded position.
Figure 42A:
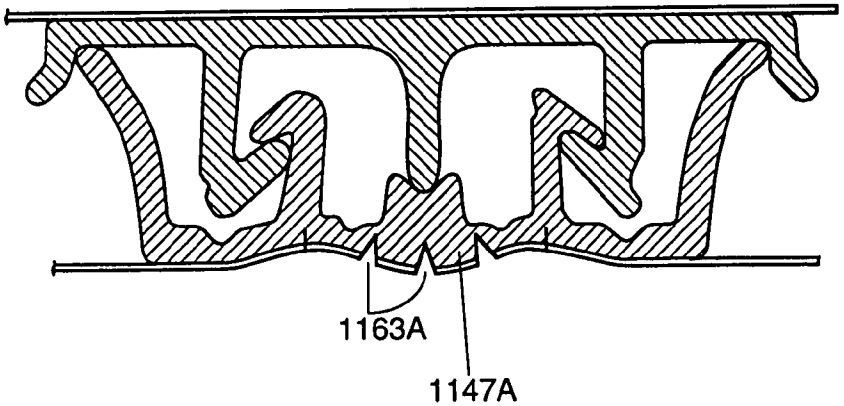
FIG. 42A is a cross-sectional view of another embodiment of the closure device in the occluded position.

FIGS. 42A and 43A show one of the edge glow embodiments of FIGS. 42 and 43 wherein the base 1147A, 1247A includes an edge glow material and the surface alterations 1163A, 1263A extend through the edge glow material. When the closure device is occluded, the surface alterations 1163A, 1263A are open and the edge glow effect will be visible.

Figure 44A:
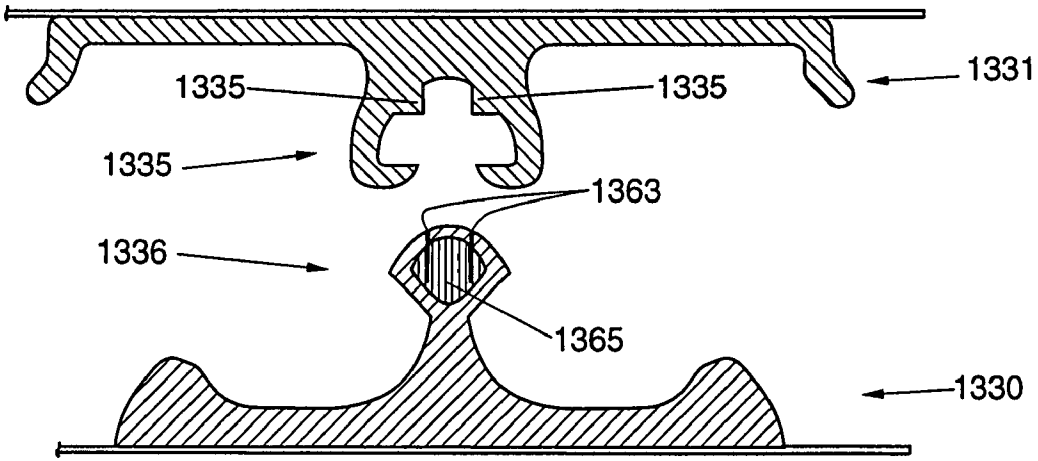
FIG. 44A is a cross-sectional view of another embodiment of the closure device in the unoccluded position with visually changing portions on one of the closure elements.

Referring to FIGS. 44A-45B, the closure elements may include the surface alterations to achieve a visual changing effect. As shown in FIGS. 44A and 44B, the closure device includes a male fastening strip 1330 and a female fastening strip 1331. The male fastening strip 1330 includes a male closure element 1336 and the female fastening strip 1331 includes a female closure element 1334. These closure elements are similar to the closure elements 734, 736 in FIG. 26 except that the male closure element 1336 includes surface alterations 1363 and coextruded portion 1365. In addition, the female closure element 1334 may include protrusions 1335 which facilitate the opening of the surface alterations 1363.

The male closure element is made from a material which has a first color. In this embodiment, the first color would be opaque. The male closure element 1336 includes a coextruded portion 1365 which has a second color. The second color may be surrounded by the first color in the closure element. The closure element includes surface alterations 1363 which extend into the coextruded portion 1365. While this embodiment has two surface alterations, the closure element may include one, three, four or more surface alterations.

In addition, the coextruded portion may extend along each of the surface alterations or the closure element may include a separate coextruded portion for each surface alteration. Furthermore, the separate coextruded portions may have a different color than the second color of the first coextruded portion. In addition, the coextruded portion may be continuous along the closure element or the coextruded portion may be discontinuous along the length of the closure element. Similarly, the surface alteration may be continuous along the length of the closure element or the surface alteration may be discontinuous along the length of the closure element. The surface alteration 1363 is substantially closed to hide the color when the fastening strips are unoccluded as in FIG. 44A and open to expose the color when the fastening strips are occluded as in FIG. 44B. A closure element with a surface alteration may be used with any embodiment described herein.

Figure 44B:
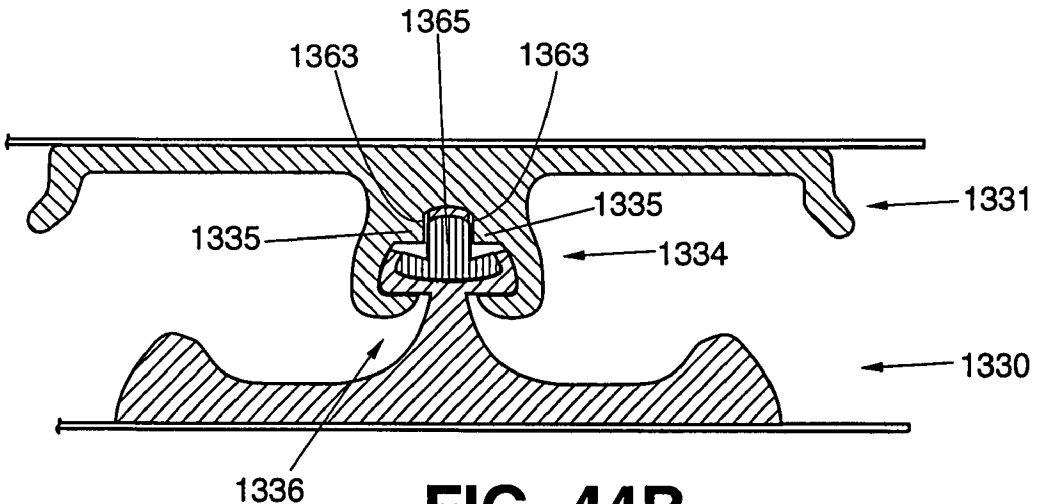
FIG. 44B is a cross-sectional view of the closure device in FIG. 44A in the occluded position illustrating the visually changing portions.

During occlusion, the user applies compression forces to the fastening strips as noted above. As the user occludes the fastening strips, the female closure element 1334 engages the male closure element 1336. The surface alterations 1363 open and expose the coextruded portion 1365 as shown in FIG. 44B. In this embodiment, the mating fastening strip 1331 is translucent or transparent. Thus, the second color of the coextruded portion 1365 is visible to the user through the mating fastening strip 1331. Prior to occlusion, the second color of the coextruded portion 1365 is not visible because the first color of the closure element 1336 surrounds the second color. After occlusion, the user is able to determine that occlusion has occurred because the surface alterations 1363 will be open and the second color will be visible.

Figure 45A:
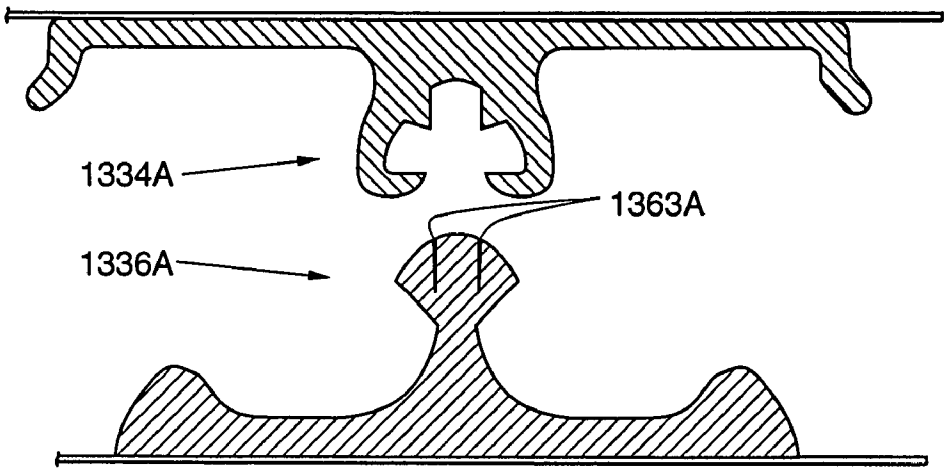
FIG. 45A is a cross-sectional view of another embodiment of the closure device in the unoccluded position with visually changing portions on one of the closure elements.
Figure 45B:
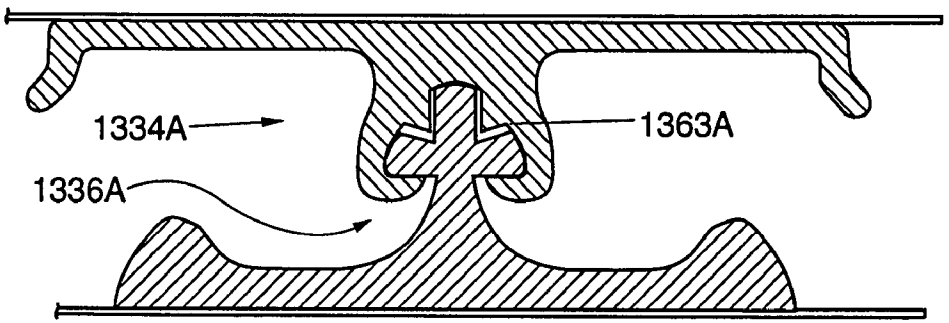
FIG. 45B is a cross-sectional view of the closure device in FIG. 45A in the occluded position illustrating the visually changing portions.

Referring to FIGS. 45A-45B, the closure elements include the surface alterations to achieve a visual changing effect. FIGS. 45A and 45B show one of the edge glow embodiments of FIGS. 44A and 44B wherein the male closure element 1336A is made of an edge glow material and the surface alterations 1363A extend through the edge glow material. The material provides an edge glow effect when the surface alteration 1363A is open. Prior to occlusion, the surface alterations 1363A are closed and the edge glow effect is not visible as shown in FIG. 45A. After occlusion, the surface alterations 1363A open and the edge glow effect is visible through the mating fastening strip as shown in FIG. 45B. Thus, the user is able to visually determine that occlusion has occurred because the edge glow effect will be visible.

Figure 47:
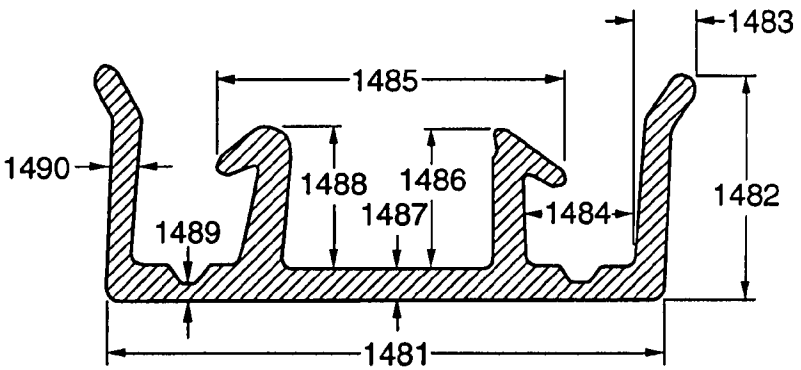
FIG. 47 illustrates a male fastening strip of a closure device according to the present invention.
Figure 46:
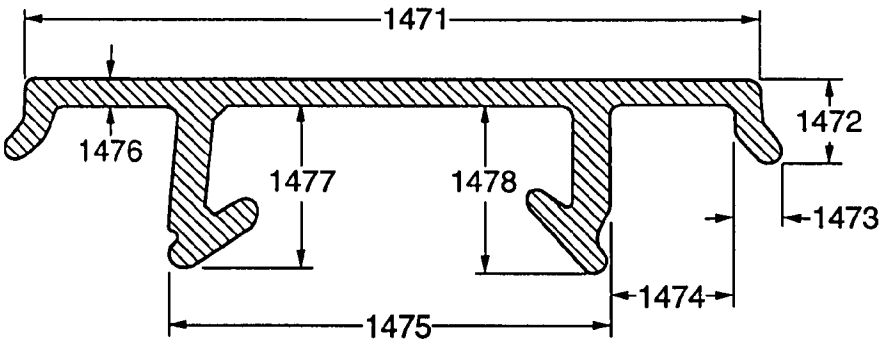
FIG. 46 illustrates a female fastening strip of a closure device according to the present invention.

FIGS. 46 and 47 illustrate the female and male fastening strips respectively of one embodiment of the closure device of the present invention. The representative dimensions of the various parameters are given as follows:

| PARAMETER | RANGE (mils) | PREFERRED (mils) |
|---|---|---|
| 1471 | 0.283-0.363 | 0.323 |
| 1472 | 0.007-0.047 | 0.027 |
| 1473 | 0.012-0.032 | 0.022 |
| 1474 | 0.024-0.094 | 0.059 |
| 1475 | 0.187-0.267 | 0.227 |
| 1476 | 0.010-0.016 | 0.013 |
| 1477 | 0.018-0.088 | 0.053 |
| 1478 | 0.016-0.086 | 0.051 |
| 1481 | 0.203-0.283 | 0.243 |
| 1482 | 0.029-0.099 | 0.064 |
| 1483 | 0.013-0.033 | 0.023 |
| 1484 | 0.015-0.065 | 0.040 |
| 1485 | 0.115-0.195 | 0.155 |
| 1486 | 0.022-0.052 | 0.037 |
| 1487 | 0.010-0.016 | 0.013 |

-continued

| PARAMETER | RANGE (mils) | PREFERRED (mils) |
|---|---|---|
| 1488 | 0.023-0.053 | 0.038 |
| 1489 | 0.004-0.010 | 0.007 |
| 1490 | 0.010-0.016 | 0.013 |

Referring to FIGS. 48-50D, the closure elements may include surface alterations which are perpendicular to the longitudinal axis of the closure device. FIGS. 48-50D illustrate another embodiment of a container according to the present invention in the form of a plastic bag 1520 having a sealable closure device 1521. The bag 1520 includes side walls 1522 joined at seams 1525 to form a compartment sealable by means of the closure device 1521. The side walls 1522 extend above the closure device 1521 to form mouth portions 1527. Mouth portions 1527 enable a user to grip the plastic bag 1520 in a fashion to more conveniently be able to deocclude or open the closure device 1521 to thereby open the bag 1520. The closure device 1521 includes fastening strips 1530, 1531.

Figure 48:
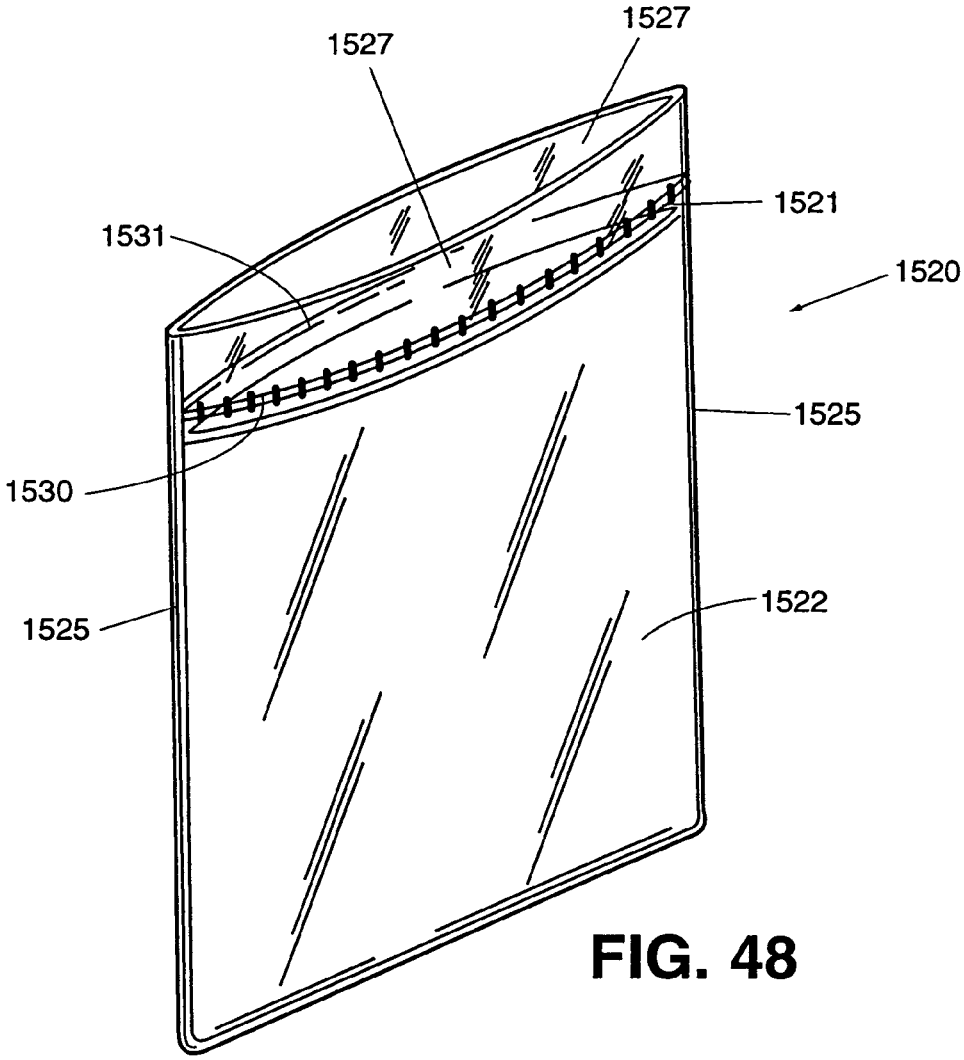
FIG. 48 is a perspective view of another embodiment of a container according to the present invention in the form of a plastic bag.
Figure 49A:
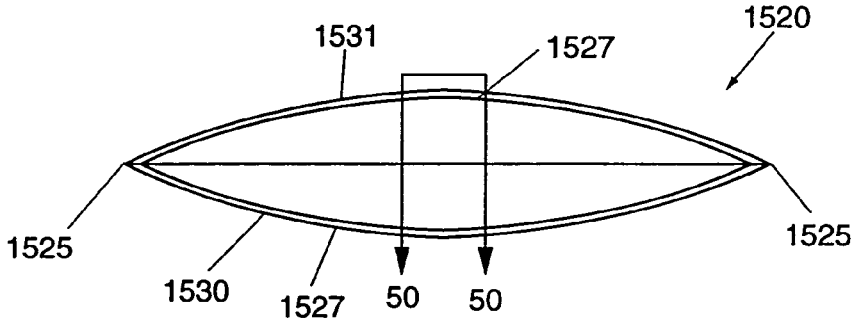
FIG. 49A is a top view of the container shown in FIG. 48 in the unoccluded position.
Figure 49B:
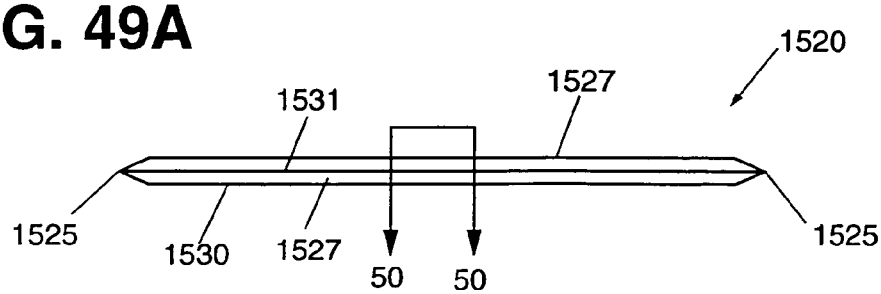
FIG. 49B is a top view of the container shown in FIG. 48 in the occluded position.

As shown in FIGS. 48 and 49, the fastening strips 1530, 1531, the side walls 1522 near the fastening strips and the mouth portions 1527 are deformed outwardly away from each other when the closure device is unoccluded. As shown in FIG. 49B, the fastening strips 1530,. 1531, the side walls 1522 near the fastening strips and the mouth portions 1527 are relatively parallel to each other when the closure device is occluded.

Figure 50A:
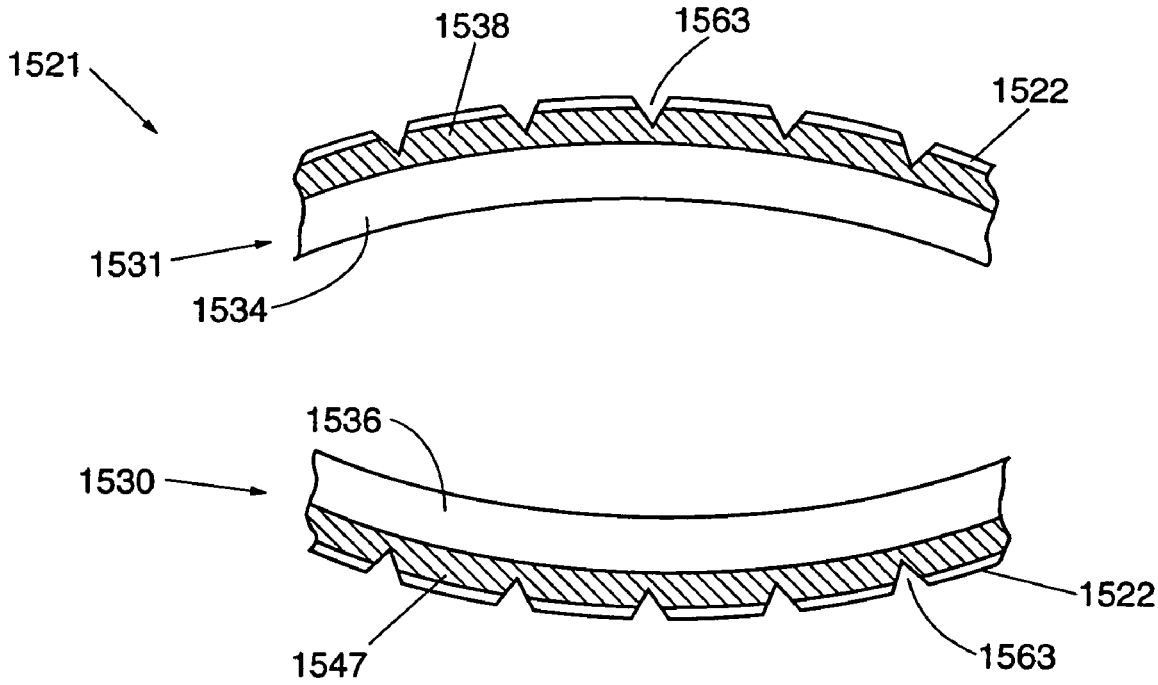
FIG. 50A is a cross-sectional view taken along line 50-50 in FIG. 49 illustrating a first embodiment in the unoccluded position.
Figure 50B:
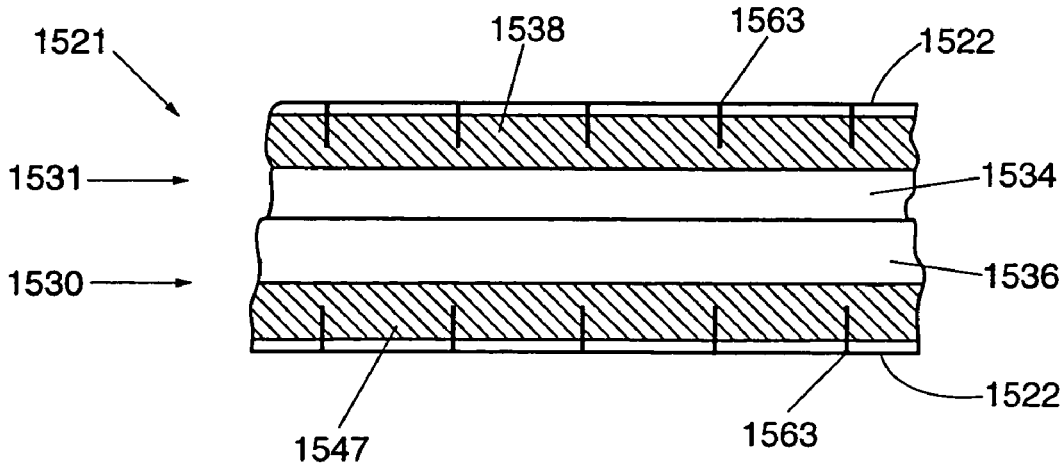
FIG. 50B is a cross-sectional view of the embodiment in FIG. 50A in the occluded position.

FIGS. 50A and 50B illustrate an embodiment of a closure device which has an outward deformation when unoccluded. The closure device 1521 includes a first fastening strip 1530 and a second fastening strip 1531. The first fastening strip 1530 includes a first closure element 1536. The first closure element 1536 includes a base portion 1547. The second fastening strip 1531 includes a second closure element 1534. The second closure element 1534 includes a base portion 1538. The closure elements 1534, 1536 can be any one of the embodiments described herein. The bases include surface alterations 1563 on the non-mating sides.

In this embodiment, a portion of the side wall for the bag is used to provide the visual changing effect. Specifically, the portion of the side wall 1522 which contacts the fastening strip 1531 is a first color. In this embodiment the first color is opaque. The base portion 1538 has a second color and the first color substantially hides the second color. The surface alterations 1563 on the non-mating side extend through the side wall portion 1522 and into the base portion 1538. In this embodiment, the surface alterations 1563 are substantially closed to hide the second color of the base portion 1547 when the fastening strips are occluded and open to expose the second color when the fastening strips are unoccluded. The combination of the first color for the side wall portion and the second color for the base achieves the visual change. In another embodiment, the base could include an edge glow material and the first color of the side wall portion would not need to be opaque and could be transparent.

FIG. 50A illustrates the closure device 1521 in the unoccluded position with an outward deformation. As the user applies forces to the fastening strips, the fastening strips 1530, 1531 move inward and become parallel with each other as in FIG. 50B. As the bases move inward, the surface alterations 1563 close and hide the base portions 1538, 1547 as shown in FIG. 50B. Prior to occlusion, the second color of the base portions 1538, 1547 were visible. After occlusion, the user is able to determine that occlusion has occurred because the surface alterations 1563 will be closed and the second color will not be visible.

In another embodiment, the bases 1538, 1547 include an edge glow material. Prior to occlusion, the surface alterations 1563 are open and the edge glow effect is visible as shown in FIG. 50A. As the bases move inward, the surface alterations 1563 close and substantially hide the edge glow effect as shown in FIG. 50B. The edge glow effect is not visible because the surface alteration 1563 is closed. After occlusion, the user is able to determine that occlusion has occurred because the slits 1563 will be closed and the edge glow effect will not be visible.

Figure 50C:
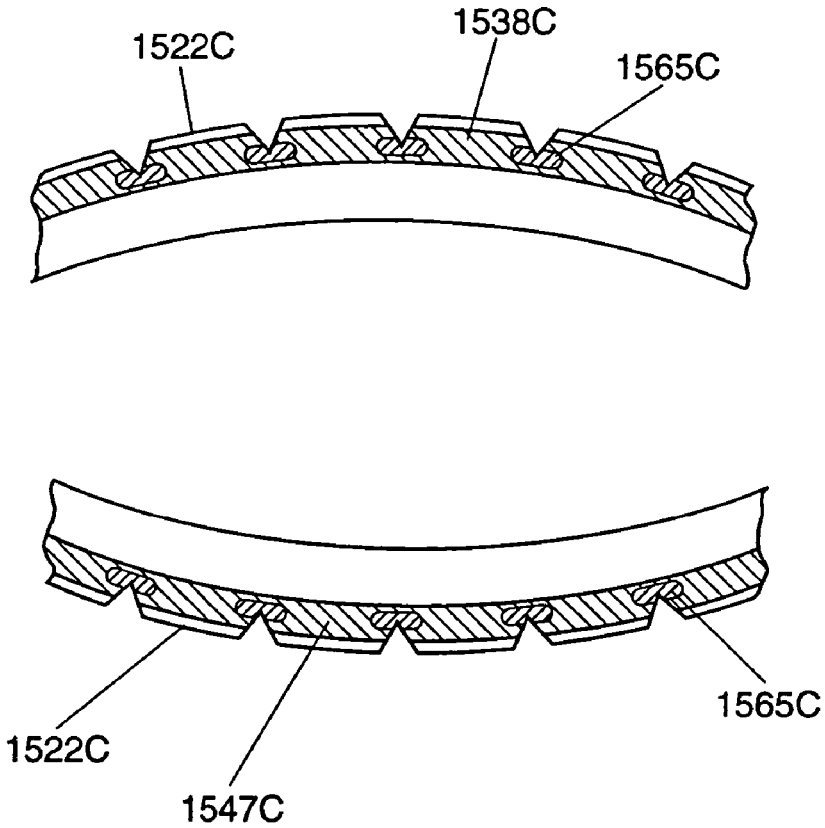
FIG. 50C is a cross-sectional view of a second embodiment in the unoccluded position.
Figure 50D:
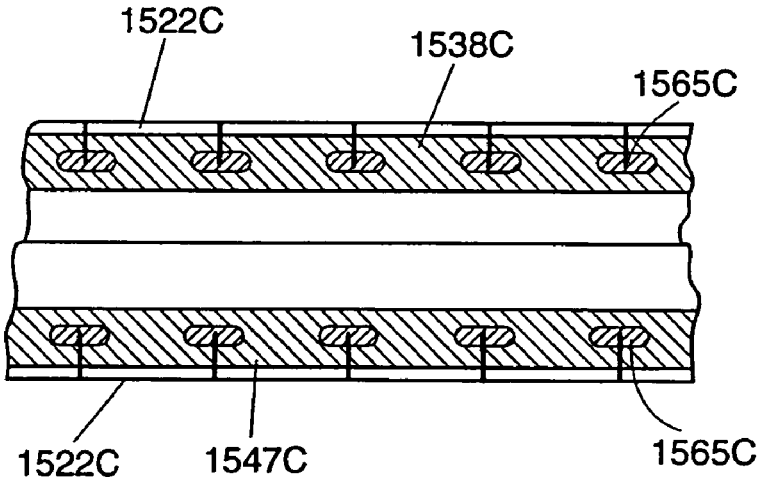
FIG. 50D is a cross-sectional view of the embodiment in FIG. 50C in the occluded position.

FIGS. 50C and 50D illustrate another embodiment of a closure device which is similar to the embodiment in FIGS. 50A and 50B. However, the closure device in FIGS. 50C and 50D includes a coextruded portion 1565C. The coextruded portion 1565C can provide a third color. In another embodiment, the combination of a coextruded portion with a third color and a base 1538C, 1547C with a second color, would allow the first color to be eliminated from the sidewall 1522C. In a third embodiment, the combination of a coextruded portion with a third color and a sidewall with a first color, would allow the second color to be eliminated from the base. In addition, in a fourth embodiment, the first, second and/or third color could be a fluorescent material.

The fastening strips may be manufactured by extrusion through a die that has the approximate dimensions given above, although the die should be made somewhat larger than the desired final dimensions of the fastening strip, inasmuch as shrinkage of the extruded fastening strip is likely upon cooling. The fastening strips of the closure device should be manufactured to have approximately uniform cross-sections. This not only simplifies the manufacturing of a device, but also contributes to the physical flexibility of the device, which is a desirable property in any event, and which is necessary to form a deformation in the fastening strip.

Generally, the closure elements of this invention may be formed from thermoplastic materials such as, for example, polyethylene, polypropylene, nylon, or the like, or from a combination thereof. Thus, resins or mixtures of resins such as high density polyethylene, medium density polyethylene and low density polyethylene may be employed to prepare the novel fastener of this invention. Preferably, the closure element is made from low density polyethylene. The selection of the thermoplastic material will be related to the closure design and its Young's Modulus and desired elasticity and flexibility correlated to provide the functionality of the closure as herein claimed.

Regarding the fluorescent or luminescent material used in this invention, a wide variety of suitable materials may be used. In general, from the functional standpoint, any fluorescent material may be used which provides a fluorescent appearance in the environment of the particular closure device in which the fluorescent material is utilized. Of course, as may be appreciated, the selection for a particular application may well be influenced by the intended application.

Fluorescent materials are generally described in Coloring of Plastics, by Thomas G. Webber, John Wiley & Sons, 1979, ISBN 0-471-92327-3. In Coloring of Plastics, fluorescent materials are described as follows:

"Fluorescence is the ability of a dye or pigment to absorb radiant energy at one set of wavelengths and to emit light at a longer wavelength. The process is essentially instantaneous. Measurement of fluorescence and its separation from ordinary reflectance requires special equipment.

Certain types of fluorescent agents absorb ultraviolet light in the 300-400 nanometer region and emit in the blue at about 440 nanometers, acting as whitening agents. These are organic compounds, and they may be considered dyes." Id. pages 207-208.

Further, Coloring of Plastics states "[I]n contrast to the fluorescent brightening agents, we have the daylight fluorescent dyes and the pigments obtainable from them. These materials are colored in the ordinary sense. In addition, they absorb ultraviolet or shortwave daylight and emit in the visible. The result is a very high degree of reflectance; the colored material appears to glow. The two principal classes of dyes that are involved are the rhodamines, which reinforce the red region, and the greenish yellow aminonaphthalimide derivatives." Id. Page 210.

In general, useful fluorescent materials are sometimes referred to as fluorescent daylight materials. Such materials have the ability to not only reflect color light selectively, but to give off an extra glow of fluorescent light upon being excited by daylight or an equivalent white light. With a few exceptions, daylight fluorescent pigments consist of particles of colorless resins containing dyestuffs that not only have color but are capable of intense fluorescence in solution. The resin is truly a solvent for the dyes. For example, in one resin system, a thermoplastic resin is formed containing the dye. Upon cooling to room temperature, the resin mass becomes very brittle and is then pulverized to the proper fineness. In this context, the term "dye" applies to any organic substance that exhibits strong absorption of light in the visible region of the spectrum without regard to any affinity for the substrate. Of the dyes which have been used for years, the brilliant red and salmon dyes of the rhodamine and rosamine classes may be used as fluorescent pigments. As further illustrative examples of important dyestuffs used as daylight fluorescent pigments, the following are included: Xylene Red B, Fluorescent Yellow Y, Maxilon 10GFF Alberta Yellow, Potomac Yellow and Macrolex Fluorescent Yellow 10GN.

When using the fluorescent material to achieve the edge glow effect for identifying the occluded or unoccluded position, the edge glow effect will be affected by a variety of variables including the particular optical properties of the closure elements and the physical characteristics of the material of construction, e.g., the selected plastic and any coloration ingredient or the like. The light scattering characteristics of the closure element are also important and are influenced by the depth of the channel of the closure element, the presence or absence of guide members, the width of the closure element and the like.

The fluorescent material may be incorporated into the suitable element or portion of the closure element in any way desired. One suitable method is simply to incorporate the fluorescent material in the plastics material from which the closure element is to be made in a fashion similar to the inclusion of other additives such as antioxidants and the like.

The following examples are illustrative, but not in limitation of, the present invention. One sample was made with C-62389A/PC Edge Glow Green supplied by Chroma Corporation of McHenry, Ill., U.S.A. Another sample was made with Lumogen F Red Dye from BASF Corporation of Rensselaer, N.Y., U.S.A.

When the fastener of the present invention is used in a sealable bag, the fastener and the films that form the body of the bag can be made from heat sealable material. The bag thus can be formed economically by heat sealing the aforementioned components to form the bag using thermoplastics of a type aforementioned for formation of the closure elements.

Preferably, the bag is made from a mixture of high pressure, low density polyethylene and linear low density polyethylene.

The closure elements of the invention may be manufactured by extrusion or other known methods. The closure device can be manufactured as individual fastening strips for later attachment to a film, or the fastening strips can be manufactured integrally with a film. In addition, the closure elements can be manufactured with or without flange portions on one or both of the closure elements depending upon the intended use or expected additional manufacturing operations.

Generally, the closure device of this invention can be manufactured in a variety of forms to suit the intended use. In the practice of the instant invention, the closure device may be integrally formed with the sidewalls of a container, or connected to a container, by the use of any of many known methods. For example, a thermoelectric device can be applied to a film in contact with a flange portion of a closure element or the thermoelectric device can be applied to a film in contact with the base portion of a closure element having no flange portion, to cause a transfer of heat through the film to produce melting at the interface of the film and a flange portion or base portion of the closure element. The thermoelectric device can be heated rotary discs, traveling heater bands, resistance-heated slide wires, or the like. The connection between the film and the closure element can also be established by the use of hot melt adhesives, hot jets of air to the interface, ultrasonic heating, or other known methods. The bonding of the closure element to the film stock may be carried out either before or after the film is U-folded to form a bag. In any event, such bonding is done prior to side sealing the bags at the edges by conventional thermal cutting. In addition, the male and female closure elements can be positioned on opposite sides of a film. Such an embodiment would be suited for wrapping an object or a collection of objects such as wires. The male and female closure elements on a film generally should be parallel to each other, but this will depend on the intended use.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention. All references and copending applications cited herein are hereby incorporated by reference in their entireties.

What is claimed is:

1. A closure device comprising first and second interlocking fastening strips arranged to be interlocked over a predetermined length, said first fastening strip has a surface alteration, said surface alteration opens or closes upon occlusion of said closure device to provide visual confirmation of occlusion of said closure device, wherein said closure device includes a first material and a second material, said surface alteration extends through said first material and into said second material, wherein said second material is hidden substantially when viewing said surface alteration and said surface alteration is closed, and wherein said first material substantially surrounds said second material.

2. The invention as in claim 1 wherein said closure device includes a portion of a container sidewall, said first material is a portion of a container sidewall and said second material is another portion of said closure device.

3. The invention as in claim 1 wherein said first material and said second material are coextruded.

4. The invention as in claim 1 wherein said first material is opaque.

5. The invention as in claim 4 wherein said second fastening strip is translucent.

6. A closure device comprising first and second interlocking fastening strips arranged to be interlocked over a predetermined length, said first fastening strip has a surface alteration, said surface alteration opens or closes upon occlusion of said closure device to provide visual confirmation of occlusion of said closure device, wherein said surface alteration exposes or hides a fluorescent material which becomes brighter in appearance or weaker in appearance upon occlusion of said closure device wherein said first fastening strip includes a base and a closure element, said surface alteration is located in said closure element.

7. A closure device comprising first and second interlocking fastening strips arranged to be interlocked over a predetermined length, said first fastening strip has a surface alteration, said surface alteration opens or closes upon occlusion of said closure device to provide visual confirmation of occlusion of said closure device, wherein said first fastening strip includes a first closure element, said first closure element comprises a first web integrally attached to said first fastening strip and extending therefrom, said first web terminating in an arrowhead wherein said surface alteration is located in said arrowhead.

8. The invention as in claim 7 wherein said surface alteration opens upon occlusion of said closure device.

9. The invention as in claim 8 wherein said surface alteration is made of a fluorescent material and becomes brighter in appearance or weaker in appearance upon occlusion of said closure device.

10. The invention as in claim 9 wherein said fluorescent material is an edge glow material and said visual confirmation is an edge glow effect.

11. The invention as in claim 10 wherein said weaker in appearance includes no appearance.

12. The invention as in claim 7 wherein said first fastening strip includes a first material and a second material, said surface alteration extends through said first material and into said second material.

13. The invention as in claim 12 wherein said second material is hidden substantially when viewing said surface alteration and said surface alteration is closed.

14. The invention as in claim 13 wherein said closure device includes a portion of a container sidewall, said first material is a portion of a container sidewall and second material is another portion of said closure device.

15. The invention as in claim 13 wherein said first material substantially surrounds said second material.

16. The invention as in claim 13 wherein said first material and said second material are coextruded.

17. The invention as in claim 13 wherein said first material is opaque.

18. The invention as in claim 17 wherein said second fastening strip is translucent.

* * * * *